US006463652B1

(12) United States Patent
Narushima et al.

(10) Patent No.: US 6,463,652 B1
(45) Date of Patent: Oct. 15, 2002

(54) APPARATUS AND METHODS FOR MANUFACTURING HOT ROLLED STEEL SHEETS

(75) Inventors: Shigeki Narushima, Yokosuka (JP); Kenichi Ide, Yokohama (JP); Yasushi Dodo, Kanagawa (JP); Kinichi Higuchi, Yokohama (JP); Hisashi Honjou, Yokohama (JP); Hajime Ishii, Yokohama (JP); Nobuhiro Tazoe, Yokohama (JP); Yasuhiro Fujii, Yokohama (JP); Kazuyuki Sato, Yokohama (JP); Sadakazu Masuda, Tokyo (JP); Shuichi Yamashina, Tokyo (JP); Satoshi Murata, Tokyo (JP); Masaaki Yamamoto, Tokyo (JP); Takumasa Terauchi, Tokyo (JP); Toru Minote, Tokyo (JP); Shinji Okazaki, Tokyo (JP); Yoichi Motoyashiki, Tokyo (JP)

(73) Assignees: Ishikawajima-Harima Heavy Industries Co., Ltd. (JP); NKK Corporation (JP)

( * ) Notice: Subject to any disclaimer, the term of this patent is extended or adjusted under 35 U.S.C. 154(b) by 0 days.

(21) Appl. No.: 09/355,208

(22) PCT Filed: Nov. 20, 1998

(86) PCT No.: PCT/JP98/05260

§ 371 (c)(1),
(2), (4) Date: Jul. 26, 1999

(87) PCT Pub. No.: WO99/26738

PCT Pub. Date: Jun. 3, 1999

(30) Foreign Application Priority Data

| | | |
|---|---|---|
| Nov. 26, 1997 | (JP) | 9-324667 |
| Nov. 26, 1997 | (JP) | 9-324670 |
| Dec. 9, 1997 | (JP) | 9-338377 |
| Dec. 18, 1997 | (JP) | 9-349138 |
| Feb. 24, 1998 | (JP) | 10-042327 |
| Feb. 27, 1998 | (JP) | 10-046787 |
| Mar. 23, 1998 | (JP) | 10-074482 |
| Jun. 15, 1998 | (JP) | 10-166545 |

(51) Int. Cl.[7] ..... B21B 13/22
(52) U.S. Cl. ..... 29/527.7; 29/33 C; 72/204
(58) Field of Search ..... 29/527.7, 33 C; 72/206

(56) References Cited

U.S. PATENT DOCUMENTS

| | | | | |
|---|---|---|---|---|
| 4,407,056 A | * | 10/1983 | Watanabe et al. | 29/527.7 |
| 5,992,502 A | * | 11/1999 | Blaimscein et al. | 29/33 C |

FOREIGN PATENT DOCUMENTS

| | | |
|---|---|---|
| JP | 46-5044 | 2/1971 |
| JP | 55-8355 | 1/1980 |
| JP | 57-106403 | 7/1982 |
| JP | 57-106409 | 7/1982 |
| JP | 59-85305 | 5/1984 |
| JP | 59-92103 | 5/1984 |
| JP | 63-90303 | 4/1988 |
| JP | 2-14139 | 1/1990 |
| JP | 2-175011 | 7/1990 |
| JP | 4-89190 | 3/1992 |
| JP | 06-165803 | 6/1994 |

* cited by examiner

*Primary Examiner*—P. W. Echols
(74) *Attorney, Agent, or Firm*—Griffin & Szipl, P.C.

(57) ABSTRACT

A high-quality hot rolled steel sheet is manufactured with a high production efficiency and a low cost, from a long, hot slab, using a combination of continuous casting facilities and a plate reduction press machine.

38 Claims, 36 Drawing Sheets

APPARATUS AND METHODS FOR MANUFACTURING HOT ROLLED STEEL SHEETS

BACKGROUND OF THE INVENTION

1. Technical Field of the Invention

The present invention relates to an apparatus and methods for manufacturing hot rolled steel sheets, using continuous casting equipment and a plate reduction press apparatus, with a high production efficiency, high quality and low cost.

2. Prior Art

1. According to the prior art of manufacturing hot rolled steel sheets, steel sheets (strips) are manufactured by hot rolling a continuously cast slab; the slab is reheated in a heating furnace, rough and finish rolled to a predetermined plate thickness, cooled on a runout table to a predetermined temperature, and then reeled into a coil using a coiler.

Such a conventional rolling system known in the prior art and described above (called "batch rolling" for short) leaves the worked material in an untensioned state during the period from the time that the leading end of a hot rolled steel sheet leaves a group of finish rolling mills to the time it is coiled by a coiler, and during the period from the time that the trailing end of the hot rolled sheet leaves the group of finish rolling mills to the time that it has been completely coiled in the coiler, and as a consequence, particularly with a thin steel sheet, the leading and trailing ends of the sheet become extremely distorted with a wave shape on the runout table. As a result, the leading and trailing ends of the steel sheet are not cooled satisfactorily and the quality of the material often become defective, which may lead to a reduction in product yield.

In batch rolling, the maximum length of a hot rolled steel sheet depends on the maximum dimensions of a slab that can be rolled, that is, the thickness and length of a slab that,can be inserted into a heating furnace. In addition, because the trailing end of a steel sheet moves unstably on the runout table during batch rolling as described above, the speed of rolling the leading end is reduced to about 600 mpm, and after the leading end of the steel sheet has been reeled onto the coiler, the speed is increased to the normal rolling speed of more than 1,000 mpm, then immediately before the trailing end of the steel sheet leaves the group of finish rolling mills, the speed is decreased, according to a predetermined sequence of controlling the speed. As a result, the time taken to roll the entire steel sheet is longer than the time it would have taken to roll the steel sheet from the leading end to the trailing end at the normal, constant speed, so consequently the production efficiency is low. Furthermore, there is an idle time between rolling one steel sheet and rolling the next steel sheet, which further aggravates the production efficiency.

In contrast to such a batch rolling process as described above, a rolling method has been proposed in which a slab with a plate thickness of less than 100 mm is cast continuously, rolled through all the stages up to finish rolling without cutting the slab at all, and after the slab has been made into a hot rolled steel sheet with a redetermined plate thickness, the sheet is cut. However, because the production capacity of a continuous casting machine is lower than that of a rolling mill, this method cannot yield a satisfactory throughput.

Under these circumstances, various methods have been proposed in the prior art, aimed at avoiding the problem of the low yield in batch rolling and assuring high productivity, regarding the methods of manufacturing hot rolled steel sheets using a slab with a plate thickness of more than 100 mm.

First, to solve the problem of the low yield caused by defective material in the leading and trailing ends of a hot rolled steel sheet, a method is proposed in which the trailing end of a preceding sheet bar (after the material has been rough rolled) and the leading end of the present sheet bar are joined together, and a plurality of sheet bars are continuously finish rolled to produce a hot rolled steel sheet (called the "continuous hot rolling method" for short).

With this method of continuous hot rolling, when n sheet bars are joined into one steel sheet, for example, the steel sheet is subjected to a constant tension between the finish rolling mill and the coiler, therefore when the steel sheet formed from n coils of steel sheets is rolled, material defects due to wave distortions on the runout table are produced only in the portion corresponding to the leading end of the first coil, and the other portion corresponding to the trailing end of the n-th steel coil, so that compared to batch rolling, the yield is higher. In addition, the low-speed rolling operation to keep the leading and trailing ends of the steel sheet moving stably on the runout table is required only for the portions corresponding to the leading end of the first coil and the trailing end of the n-th coil, and the other portions of the steel sheet can be rolled at a normal, constant speed, therefore compared to batch rolling, the rolling time is shorter and the efficiency of production is correspondingly higher. Moreover, there is no idle time during rolling of the entire steel sheet comprised of individual sheet bars joined together, which also contributes to a higher efficiency of production.

However, the roughing-down rolling used in this continuous hot rolling method is the same as that of batch rolling, so that planar, defective shapes known as tongues or fish tails are produced at the leading and trailing ends of each sheet bar. Consequently, before joining sheet bars, such planar defects at the leading and trailing ends of each sheet bar must be removed before finish rolling. Therefore, assuming n slabs are rough rolled, when the n sheet bars are joined, 2n portions (crops) are cut off (the number of such crops is the same as for batch rolling), so a reduction in the yield concerned cannot be avoided. In addition,. when joining sheet bars, portions to be joined must be heated, so defective material caused by the effects of heating, occur, although the effect is slight. Also the strength of the joints in the sheet bars is adversely affected in the continuous hot rolling method and may be so low that the production line might be stopped accidentally because a joint breaks during finish rolling.

When a slab is cast continuously, cut losses are produced during slab cutting and finishing, but the continuous hot rolling method gives rise to the same amount of cut losses as the batch rolling method because the length of the slab is identical to that used in batch rolling. In addition, when only slabs taken from one heating furnace are used in the continuous hot rolling method, a 100% efficiency of the rolling mill cannot be achieved, since the heating efficiency of the heating furnace is lower than the rolling efficiency of the rolling mill.

The unexamined Japanese patent publication No. 106403, 1982 proposes a line of continuous hot rolling facilities in which the ends of a preceding slab and the present slab are joined together, and the joined slabs are continuously rolled by a group of planetary mills and another group of finish rolling mills.

In this system, the slabs are connected together and rolled continuously, so the reduction of the yield caused by crop cutting can be avoided, but because the strength of the joints is low as in the case of the unexamined Japanese patent publication No. 89190, 1992, the joint may possibly break during rolling.

The unexamined Japanese patent publication No. 106409, 1982 proposes continuous hot rolling facilities in which a slab produced by a rotary caster is rolled continuously by a group of planetary mills and another group of finish rolling mills, and the unexamined Japanese patent publication No. 85305, 1984 offers a continuous hot rolling line in which a slab is produced by a rotary caster, the slab is rolled by a cast rolling mill, and after the rolled slab has been reeled up once inside a coil box, it is rolled to a predetermined plate thickness by a group of finish rolling mills.

The aforementioned unexamined Japanese patent publication No. 85305, 1984 describes that a slab with a thickness of about 200 mm can possibly be cast at a maximum speed of about 10 mpm using a rotary caster, but no such result has been reported so far, therefore this system cannot be applied in a practical hot rolling line aimed at high productivity, at least at present. In addition, this system has such difficulties as cracks produced during casting and the difficulty of applying the system to make a slab with a rectangular section.

The planetary mills and the cast rolling mills cited in the above-mentioned unexamined Japanese patent publications Nos. 106409, 1982 and 85305, 1984 are problematic in various aspects which will be detailed later, so these mills cannot be applied easily to a practical hot rolling process.

The unexamined Japanese patent publication No. 92103, 1984 proposes a rolling system in which the maximum work volume of one charge of a converter is cast continuously, and the continuously cast slab is formed into a sheet bar using a large-reduction rolling mill, and is reeled in an up-end state into a sheet bar coil, and the sheet bar coil is unwound and finish rolled by a subsequent rolling mill into a predetermined plate thickness, and the coil is cut when it is unwound by the coiler.

According to the rolling method of this unexamined Japanese patent publication No. 92103, 1984, a long slab with a maximum length corresponding to one charge of a converter is rolled, so there are only two crop portions to be cut off, i.e., the leading and trailing ends of the slab, hence the method provides the advantage that the reduction of yield that accompanies crop cutting and slab cutting is smaller than with the above-mentioned continuous hot rolling method. In addition, according to the proposal of the publication, the facilities are configured with a continuous casting machine, a plurality of rough rolling mills and a finish rolling line, in which a group of rough rolling mills supply the single finish rolling line with sheet bar coils, to prevent a reduction in rolling efficiency due to the imbalance between the production capacity of the continuous casting equipment and the production capacity of the finish rolling line (normally, the capacity of continuous casting is less than the capacity of finish rolling).

However, when a sheet bar is wound up once in an upended ended state and unwound in this rolling system, the sheet bar must be twisted through 90°, therefore a facility for twisting the sheet bar is needed. Moreover, the approximate dimensions of a continuously cast slab with a weight of loot, for instance, are 1,000 mm wide×250 mm thick×50 m long, and when the slab is pressed to a sheet bar coil, the diameter and weight of the coil is more than 4 m and 100 t, respectively, so that the coiling facilities become extremely large. Also, when a sheet bar is coiled, the surfaces of the sheet bar rub against each other and are scratched, resulting in flaws on the surface, and a hot rolled steel sheet with a good surface finish can no longer be manufactured, which is another problem associated with this rolling system.

2. In a hot rolling line in which a hot rolled steel sheet is to be manufactured from a hot slab with a high productivity, the normal practice is that a continuously cast slab (normally with a minimum thickness of 100 mm) is reheated while it is still hot or after it has once cooled down, or the continuously cast slab is directly transferred as a hot slab. In a roughing-down mill, i.e. the first rolling process of hot rolling, the hot slab is rolled through several passes with rolls of about 1,000 to 1,200 mm ϕ in diameter, into a sheet bar of about 15 to 50 mm in thickness, and then the sheet bar is rolled in a finish rolling process, the second rolling process, to a predetermined thickness, thus a hot rolled steel sheet is manufactured.

In the method of hot rolling a slab as described above, the temperature of the material during rolling varies depending on the temperature rise due to the heat caused by processing and the heat lost to the press rolls. In a normal roughing mill, the heat lost to the press rolls is greater because of the long length of material in contact with the rolls. Furthermore, when a plurality of passes of rough rolling are used, the material is in a so-called air-cooling state between each rolling pass, so that the temperature of the material decreases. Consequently, a considerable amount of the heat contained in the hot slab before the beginning of rolling is lost during a conventional rough rolling process known in the prior art.

As a result, in a system with a line of conventional hot rolling mills, it is difficult to maintain the temperature of the material at the beginning of finish rolling, in particular for a rolling process for manufacturing a thin sheet with a thickness of 2 mm or less, the temperature of the material decreases considerably during the finish rolling process, so that it is sometimes difficult to maintain the temperature of the material above the Ar3 point at the outlet of a finish rolling process.

To solve these problems, according to the prior art, a rolling system in which the heat loss is kept to a minimum by rough rolling the material at a high speed was developed, but this rolling system cannot be applied in practice because of the high equipment cost, in particular the driving system is very expensive.

A cast slab with a thickness of 100 mm or more is often accompanied by internal defects such as voids near the center part of the thickness of the slab, however, these defects cannot be easily eliminated by ordinary rough rolling because the slab is rather thick compared to the length of the contact arcs between rolls and the material, so the pressing strains cannot penetrate easily to the center part of the plate thickness. Consequently, there is the fatal problem that the internal defects still remain at the end of a finish rolling process, in the worst case.

3. A rolling system that rolls a so-called medium-thickness slab with a thickness of 50 mm to 150 mm, manufactured and supplied from a continuous casting machine, and rolled down to a thin sheet, is normally composed of rough rolling facilities for rolling the slab to a thickness of about 20 mm, and finish rolling facilities in which the slab is next rolled to a thickness of about 1 to 2 mm. Various configurations of rolling systems with such rolling facilities are known in the prior art.

FIG. 1 is an example of a configuration of conventional rolling facilities. The rolling facilities 1 shown in this figure are provided with table rollers 3 that carry and transport along a rolling line, a medium-thickness slab 2 manufactured by a continuous casting system in a batch line, not illustrated, and cut into a predetermined length (for instance, a length of 30 m with a plate thickness of 90 mm), a walking furnace 4 that houses and heats the slab 2 to a predetermined temperature, a plurality of rough rolling mills 6 (two mills in this figure) composed of vertical roll stands 5 at the inlet of the line, and an intermediate coiler 7 which winds and unwinds the rough rolled material in order to maintain the temperature of the material. The intermediate coiler 7 is provided to prevent the leading end of the slab 2 from being cooled while it is being rolled with the rough rolling mills 6 etc. or during transportation on the table rollers 3, and to prevent deformation of the shape of the slab due to heat strains, and the coiler first reels the slab with a thickness of 2 of 20 mm and then unwinds the slab from the trailing end thereof and sends it in the downstream direction.

In addition, as shown in FIG. 1, the rolling facilities 1 are provided with a plurality of finish rolling mills 9 (5 mills in this figure) with a vertical roll stand 8 at the inlet, and a plurality of down coilers 12 that wind the material 2' being pressed into a coil, in which the conveyed slab 2 is finish rolled by the finish rolling mills 9 to a product thickness of about 1 to 2 mm, and after being cut by a shear machine 10, the material 2' after being pressed is reeled into a coil by a coiler 12, through the pinch rolls 11.

Furthermore, the unexamined Japanese patent publication No. 90303, 1988 proposes a "Hot rolling apparatus" in which the group of rough rolling mills is omitted from an apparatus for rolling a medium-thickness slab. As shown in the schematic view of FIG. 2, this hot rolling apparatus 15 is composed of a heating and holding furnace 16, and on the downstream side of the heating and holding furnace 16, a coil box 17, a crop shear machine 18, a group of finish rolling mills 19 with five finish rolling mills F1 to F5, edgers E1, E2 at the inlet and outlet of F1, and a down coiler 20 at the end farthest downstream. F1 and F2 are reverse rolling mills that can roll a slab 21 backwards and forwards.

However, with the conventional rolling apparatus for a medium-thickness slab shown in FIG. 1, there are problems such as (1) to manufacture a slab with a thickness of about 20 mm, two rough rolling mills and an intermediate coiler for heating and holding are required, so the rolling line becomes so long that its cost is increased, (2) because a slab with a thickness of about 20 mm is rolled by rough rolling mills at a high speed in order to keep its temperature high, the rough rolling mills cannot be arranged to operate continuously (in tandem) with a finish rolling mill, (3) even when an intermediate coiler is provided, the slab must be reversed by coiling and uncoiling, therefore the temperatures of the leading and trailing ends and of both edges of the slab are not distributed evenly, so that the yield of the material to be pressed may often be low, and (4) consequently, very thin sheets (0.8 to 1.0 mm) for which there is a high demand cannot be manufactured with this apparatus.

On the other hand, the conventional hot rolling apparatus shown in FIG. 2 provides a fairly short rolling line by omitting the group of rough rolling mills, but it is accompanied by various problems such as (1) when a slab is reverse rolled with a reverse rolling mill, the surface temperature of the material being rolled decreases so much that rolling becomes difficult, (2) the temperatures of the leading and trailing ends and the edges of the material being rolled are unevenly distributed, resulting in a low yield of the material being rolled, and (3) a coil box is required.

4. Conventionally, the maximum length of an ordinary slab is about 12 m, but recently, a long slab with a length of more than 100 m can be manufactured by a continuous casting system.

However, there was no such equipment that could roll a slab with an ordinary length and a long slab, by hot rolling to produce a thin sheet, so there has been a demand for such equipment. With a long slab, there were no such facilities that could manufacture coils with various plate widths and plate thicknesses, wound separately according to each type of width and thickness, from a slab, therefore there has also been a demand for this type of equipment.

5. Moreover, with an ordinary rolling mill in which a material to be rolled is rolled between two work rolls, normally the reduction ratio is limited to about 25%. Consequently, a high reduction ratio cannot be achieved when a material is rolled in a single pass (for instance, reducing the material from about 250 mm to a thickness of 30 to 60 mm), therefore for this purpose, a tandem rolling system in which three or four rolling mills are arranged in tandem, or a reverse rolling system in which the material to be rolled is rolled backwards and forwards, are used in practice, however, there are problems such as that a long rolling line is needed.

In addition, a planetary mill, Sendzimir mill, cluster mill, etc. has been proposed as rolling methods that enable high-reduction pressing in one pass. However, with these rolling means, small diameter rolls press the material to be rolled at a high speed, and are accompanied with various problems such as large impacts, short life of bearings etc., unsuitability for mass production facilities, and so on.

To solve the above-mentioned problems, kinds of press apparatus modified from a conventional stentering press machine have been proposed for reducing the thickness of a plate (for instance, Japanese patent publication No. 014139, 1990, unexamined Japanese patent publication No. 222651, 1976 and unexamined Japanese patent publication No. 175011, 1990).

In the unexamined Japanese patent publication No. 175011, 1990 "Flying sizing press apparatus" shown in FIG. 3, rotating shafts 32 are arranged above and below or to the left and right of a transfer line Z of a material to be shaped, and the eccentric portions of these rotating shafts 32 are connected to the bosses of rods 33 with a predetermined shape, and dies 34 are connected to the tips of the rods 33, on opposite sides of the transfer line of the material to be shaped, in which the rotating shafts 32 are rotated, and the dies 34 are moved to press the material 31 to be shaped (material to be reduced) from above and below the transfer line through the rods 33 connected to the eccentric portions of the rotating shafts, thereby the thickness of the material 31 to be shaped is reduced.

However, a conventional plate reduction press apparatus, an example of which is shown in FIG. 3 has a problem in that there are difficulties with the transfer speed of the material 31 to be pressed, although the apparatus can achieve high-reduction pressing in a single pass. In other words, with this conventional plate reduction press apparatus, the material to be pressed is transferred in the downstream direction of the transfer line together with the dies 34 when the dies are pressing the material 31 to be reduced, but when the dies are separated from the material, feeding stops, and as a result, the material to be pressed is fed intermittently, not continuously.

Although the speed of feeding the material can be adjusted intermittently by changing the frequency of the pressing cycles, it is difficult to adjust the speed in synchronism with a downstream finish rolling mill etc., continuously and precisely, because of the intrinsic structure of the plate reduction press apparatus, and even if such an adjustment can be achieved, the required pressing frequency and pressing loads (pressing forces) become excessively large when only the pressing frequency is used for the adjustment, which has given rise to problems such as large vibrations and a remarkable reduction in the life of the equipment.

6. FIG. 4 shows an example of a rough rolling mill used for hot rolling, which is provided with work rolls 42*a*, 42*b* arranged opposite each other above and below a transfer line S on which a plate-like material 41 to be shaped is passed substantially horizontally, and backup rolls 43a, 43*b* in contact with the work rolls 42*a*, 42*b*, respectively, on the opposite side from the transfer line.

In the aforementioned rough rolling mill, the work roll 42*a* above the transfer line S is rotated counterclockwise, and the work roll 42*b* below the transfer line S is rotated clockwise, while the material 41 to be shaped is inserted between both work rolls 42*a*, 42*b*, and at the same time, the upper backup roll 43*a* is pressed downwards, and while the material 41 to be shaped is moved from the upstream A side of the transfer line to the downstream B side of the transfer line, the material 41 to be shaped is reduced and formed in the direction of the plate thickness. However, unless the nip angle of the work rolls 42*a*, 42*b* with respect to the material 41 to be shaped is less than about 17°, slipping takes place between the upper and lower surfaces of the material 41 and the outer peripheries of both work rolls 42*a*, 42*b*, and the work rolls 42*a*, 42*b* can no longer grip the material 41 to be shaped.

Therefore, when the diameter D of the work rolls 42*a*, 43*b* is 1,200 mm, the amount of the reduction T per pass becomes about 50 mm according to the above-mentioned condition of the nip angle of the work rolls 42*a*, 42*b*, so when a material 41 with a plate thickness T0 of 250 mm is reduced, and formed by the rough rolling mill, the plate thickness T1 after pressing is about 200 mm.

Consequently, a plurality of rough rolling mills are arranged conventionally, or the plate thickness is reduced sequentially as the material 41 to be shaped is moved backwards and forwards, through one rolling mill, which is called reverse rolling, and after the plate thickness of the material 41 being shaped is reduced to about 90 mm, the material 41 being shaped is transferred to a finish rolling mill.

However, when reverse rolling such as described above is carried out, space for pulling out the material 41 to be or being shaped must be prepared on both the upstream A and downstream B sides of the transfer line in a group of rolling mills, therefore the equipment becomes so long and large that the material 41 to be shaped cannot be efficiently reduced in plate thickness, which imposes a practical problem.

In addition, if the material to be shaped is passed through the rough rolling mills many times, the temperature of the material 41 to be shaped decreases, so the material 41 being shaped must be reheated before finish rolling.

7. Another type of high-reduction press system capable of reducing the thickness of a slab to about one half in a single pass has also been developed. FIG. 5 shows the shapes of a slab 51 when its thickness is highly reduced by such a high-reduction press system or mill. View (A) shows the state before pressing the slab 51 with dies or rolls 61, and (B) shows the shape of the slab 51 after its thickness has been reduced to nearly one half. Before and after pressing, the volume of the slab remain substantially the same so when the thickness is reduced to one half, approximately, the volume of the other remaining one half must spread in the longitudinal and lateral directions of the slab 51. The volume pressed out in the lateral direction produces bulges 62 at both edges.

FIG. 6 shows edge cracks 63 created in the bulges 62. The surface of a bulge 62 is often stressed because the surface is cooled, and edge cracks 63 are produced frequently. FIG. 7 illustrates the conditions when a highly reduced slab 51 is rolled in a downstream rolling mill. (A) and (B) show the state immediately before rolling with the rolls 64 and seam flaws 66 have appeared on the surface of the rolled material. The portion at the peak 65 of a bulge 62 is cooled early, so the edge cracks shown in FIG. 6 often appear, and even if there are no apparent cracks, the surface is liable to have cracks, and when the material is rolled, longitudinal flaws are produced after rolling. These are called seam flaws. These edge cracks and seam flaws are not desirable because they sometimes remain in the product. Also when a slab 801 is highly reduced by means of dies 804 with inclined surfaces 804*b* in the longitudinal direction of the slab as shown in FIG. 34, there is the problem that slipping may often occur between the slab 801 and the dies, so that the slab cannot be reduced satisfactorily.

8. On the other hand, according to the prior art, a sizing press and a roughing mill are used to reduce the width and thickness of a slab, respectively. In this case, the slab to be reduced is as short as 5 m to 12 m, and after the slab has been pressed with a sizing press to a uniform width over the entire length of the slab, the thickness is then reduced with a roughing mill. The slab is moved backwards and forwards through sizing press and the roughing mill while pressing and rolling the slab to obtain the predetermined width and thickness, in a reversing pressing and rolling process.

However, since a long slab has been introduced following the development of the continuous casting system, reversing pressing with a sizing press or rolling with a roughing mill cannot be applied to a long slab. Another problem is that when a slab is pressed and rolled simultaneously using a sizing press and a roughing mill, the operations of the sizing press and the roughing mill adversely affect each other.

SUMMARY OF THE INVENTION

1. The present invention was aimed at solving the various problems described above. That is, the first object of the present invention is to provide a hot rolled steel sheet manufacturing apparatus that can manufacture a hot rolled steel sheet from a hot rolled long slab in which a plurality of steel sheet coils are manufactured continuously (that is, "long slab" means a slab with a length such that a hot rolled steel sheet is produced with a length corresponding to that of a plurality of hot rolled steel coils each of which has a normal length," throughout this specification), can reduce the loss of heat from the hot slab during the manufacture of the hot rolled steel sheet, with a high quality free from internal defects etc., with a high production efficiency and a high yield, and a method of manufacturing the hot rolled steel sheet using this apparatus.

To achieve the first object of the present invention, according to the first preferred embodiment of the present invention, the hot rolled steel sheet manufacturing apparatus is provided with continuous casting facilities for continuously casting a hot slab, rough processing facilities for processing the hot slab cast by the aforementioned continuous casting facilities and forming the slab into a sheet bar, a group of finish rolling mills that roll the sheet bar manufactured by the above-mentioned rough processing facilities, and a coiler that reels the hot rolled steel sheet, which are located in that order, a hot rolled steel sheet manufacturing apparatus, in which the aforementioned rough processing facilities are provided with a casting means at least as a part of the thickness reducing and processing means, and a cutting means that cuts a hot rolled steel sheet while moving between the above-mentioned group of finish rolling mills and the coiler, and is arranged between them.

According to the second preferred embodiment, the hot rolled steel sheet manufacturing apparatus according to the first preferred embodiment is provided with rough processing facilities located closer to the group of finish rolling mills than the mid-point between the outlet of the continuous casting facilities and the inlet of the group of finish rolling mills.

According to the third preferred embodiment, using the hot rolled steel sheet manufacturing apparatus according to the first two preferred embodiments, a heating furnace is installed that can supply the rough processing facilities with a reheated slab in addition to the system comprised of the continuous casting facilities, rough processing facilities, group of finish rolling mills and the coiler.

Further according to the fourth preferred embodiments, using the hot rolled steel sheet manufacturing apparatus according to any one of the three previous embodiments, means for heating and holding and/or heating a material to be processed are arranged at one location or two or more locations either inside the rough processing facilities, between the continuous casting facilities and the rough processing facilities, inside the rough processing facilities, or between the rough processing facilities and the group of finish rolling mills.

Also according to the fifth preferred embodiment, in the method of manufacturing a hot rolled steel sheet using the hot rolled steel sheet manufacturing apparatus according to any one of the previous four embodiments, a hot rolled steel sheet is manufactured from a long, hot rolled slab with a thickness of 100 mm or more and with a length corresponding to the length of a plurality of coils of hot rolled steel sheets, which is cast in a continuous casting facility, and the aforementioned long, hot rolled slab is processed into a sheet bar, by transferring the slab to the rough processing facilities where the slab produced at least by the casting means is reduced and processed with a large reduction ratio, and in continuation, the above-mentioned sheet bar is rolled by the group of finish rolling mills, into a hot rolled steel sheet with a predetermined thickness, and then the hot rolled steel sheet is reeled onto a coiler, and when so required, the sheet is cut while the steel sheet is moving, thus the hot rolled steel sheet is manufactured as a coil with a predetermined length.

The sixth preferred embodiment is the method of manufacturing a hot rolled steel sheet according to the sixth preferred embodiment, in which at the outlet of the continuous casting facilities, a hot slab is cut into long slabs the length of each of which corresponds to the length of a plurality of hot rolled steel sheets, and the above-mentioned long slabs are supplied to the rough processing facilities.

The seventh preferred embodiment, using the hot rolled steel sheet manufacturing apparatus specified in the third or fourth preferred embodiments, a reheated slab with a normal length, taken from the heating furnace is supplied to the rough processing facilities, during the period between the time that the rough processing facilities complete the reducing and processing of a long, slab supplied from the continuous casting facilities and the time that the next long, hot slab is supplied from the continuous casting facilities, and the reheated slab is reduced and processed by the rough processing facilities and is rolled by the group of finish rolling mills, thereby manufacturing a hot rolled steel sheet.

Also according to the eighth preferred embodiment, a hot rolled steel sheet manufacturing apparatus is provided with rough processing facilities that reduce and process a hot slab into a sheet bar, and a group of finish rolling mills that roll the sheet bar manufactured in the aforementioned processing facilities, into a hot rolled steel sheet with a predetermined thickness, in which the above-mentioned rough processing facilities are composed of a casting and processing means at least as a part of the thickness reducing and processing means.

The ninth preferred embodiment discloses a method of manufacturing a hot rolled steel sheet, using the hot rolled steel sheet manufacturing apparatus of the eighth preferred embodiment, in which a hot slab with a thickness of 100 mm or more is reduced and processed into a sheet bar by the rough processing facilities, in which the hot slab is forged and processed at least with a forging reduction ratio of 30% or more per pass of reduction and forming, using forging and processing means, and in continuation the aforementioned sheet bar is rolled by the group of finish rolling mills into a hot rolled steel sheet with a predetermined thickness.

2. The second object of the present invention is to provide a method of manufacturing a hot rolled steel sheet and the apparatus concerned which has the advantages that (1) a plate reduction press apparatus is used in place of a rough rolling mill, thereby the length of the rolling line can be reduced and the cost of the whole equipment can be reduced greatly, (2) because a press machine can reduce the thickness of a slab with a medium thickness of 50 mm to 150 mm to about 20 mm, and the slab with a thickness of 20 mm can be maintained at a high temperature, a press machine and a finish rolling mill can be operated continuously (in tandem), (3) since a slab with a length that can be reeled into one coil in a batch system is supplied, and is highly reduced and can then be rolled, a shear machine with a complicated structure, located immediately before the coiler, can be omitted and the rolling line can be shortened, (4) because the plate reduction press apparatus is used, high temperature material does not have to be worked backwards and forwards, and can be conveyed to a finish rolling mill, therefore an intermediate coiler or a coil box can be eliminated thereby shortening the rolling line, and a high yield of the material being rolled can be achieved, (5) the use of the plate reduction press apparatus means that the temperature for heating the slab can be lower, therefore the energy consumption can be reduced, and (6) very thinly rolled material can be manufactured.

To achieve the second object of the present invention, a method of manufacturing a hot rolled steel sheet is provided, in which a continuous casting machine manufactures a slab with a thickness of 50 to 150 mm, next the slab is heated to and maintained at a predetermined temperature while the slab is being conveyed on a press line, by means of a slab heating and holding furnace, then the slab is highly reduced to a predetermined thickness by a plate reduction press machine as the slab is being taken from the slab heating and holding furnace, to produce a pressed material, and next the pressed material is rolled continuously by a plurality of finish rolling mills as the pressed material is being transferred from the plate reduction press machine, to produce a steel sheet with a predetermined thickness, and thereafter the steel sheet is cut into predetermined lengths and reeled onto a coiler.

According to the method of the tenth preferred embodiment of the present invention, (1) a continuous casting machine manufactures a slab with a thickness of 50 mm to 150 mm, (2) next the slab is heated to and maintained at a predetermined temperature while the slab is being conveyed to a press machine, by means of a slab heating and holding furnace, (3) then the slab is highly reduced to a predetermined thickness (about 20 mm) by a plate reduction press machine while the slab is being transferred from the slab heating and holding furnace, and next (4) the pressed material is rolled continuously by a plurality of finish rolling mills while the pressed material is transferred from the plate reduction press machine to produce a steel sheet with a predetermined thickness (0.8 to 12.0 mm), and then (5) the steel sheet is cut into predetermined lengths and reeled onto a coiler.

Therefore, because a slab manufactured by the continuous casting machine that has cooled to some extent during conveying on the rolling line, can be heated to and maintained at a predetermined temperature by the slab heating and holding furnace, the slab can be pressed and formed easily and quickly by the plate reduction press apparatus on the downstream side. In addition, because a slab with a length of about 20 m, is pressed and formed by the plate reduction press apparatus instead of a plurality of rough rolling mills used in the prior art before being conveyed to the finish rolling mills, the slab can be pressed and formed quickly in a good condition with a smaller temperature decrease than in the prior art. Furthermore, the pressed material can be transferred continuously (in tandem) at a high temperature to the finish rolling mills, so a very thin sheet of 0.8 to 1.0 mm can be manufactured.

According to the eleventh preferred embodiment of the present invention, a hot rolled steel sheet manufacturing apparatus is provided with a continuous casting machine for manufacturing a slab with a thickness of 50 mm to 150 mm, a slab heating and holding furnace that heats the slab, as the slab is being conveyed on a press line, and holds the slab at a predetermined temperature, a plate reduction press machine that presses the slab, as the slab is being transferred from the slab heating and holding furnace, by a large amount of reduction into a pressed material with a predetermined thickness, a plurality of finish rolling mills that continuously roll the pressed material as the material is being transferred from the plate reduction press machine, a shear machine that cuts the material that has been pressed into predetermined lengths, and a coiler that reels the material being cut.

In the configuration of the eleventh preferred embodiment according to the present invention, a plate reduction press apparatus highly reduces a medium-thickness slab in the direction of the plate thickness as the slab is continuously supplied from the continuous casting facilities, thereby eliminating the plurality of rough rolling mills for the rough rolling process and an intermediate coiler for heating and holding the slab, conventionally used in the prior art, therefore the rolling line can be shortened and the cost of the equipment can be reduced. In addition, a slab can be conveyed continuously from the continuous casting machine, so that coils can be mass produced very efficiently, and the productivity of the material being rolled can be increased.

According to the twelfth preferred embodiment, the aforementioned slab heating and holding furnace is composed of a tunnel furnace or a double walking beam furnace, together with a looper for delaying the slab before and after the plate reduction press machine. Also according to the thirteenth preferred embodiment, the hot rolled steel sheet manufacturing apparatus is provided with a stentering press machine or a vertical rolling mill that presses the slab in the lateral direction thereof, located before the plate reduction press machine, and/or a vertical rolling mill that presses the slab in the lateral direction thereof, located at the inlet of the finish rolling mills.

In this configuration, a slab manufactured by the continuous casting machine and cooled during transportation on the rolling line, can be quickly and easily heated to and maintained at a predetermined optimum temperature, thanks to induction heating or gas heating tools provided on the ceiling or side surfaces of the tunnel furnace. In addition, any excess (or deficit) of the slab, caused by a difference in the pressing speeds of the plate reduction press apparatus and the finish rolling mills, can be accommodated by the looper, so the excess (or deficit) can be evened out. Moreover, a change or constraint in the lateral dimensions of the slab can be produced speedily and easily because the slab can be pressed before being transferred to the plate reduction press apparatus, by using the lateral pressing dies of the stentering press machine or the vertical rolls of the vertical rolling mill. In addition, because a vertical rolling mill is located at the inlet of the finish rolling mills, variations in the width of the slab, produced in the press apparatus, can be corrected so that the material being rolled will have a high-quality flat shape.

According to the fourteenth preferred embodiment, a shear machine is also provided and is located between the aforementioned continuous casting machine and the tunnel furnace, and cuts the slab when so required. In this configuration, a shear machine is located between the continuous casting machine and the tunnel furnace, so that when a slab which is normally conveyed continuously and efficiently, must be stopped from being transferred to the rolling line because of some operational reason, or when a slab is to be manufactured for several coils or one coil, the slab can be cut quickly. The fifteenth preferred embodiment provides a hot rolled steel sheet manufacturing apparatus with a tunnel furnace located at the inlet of the finish rolling mills, that heats the slab and maintains the slab at a predetermined temperature. In this configuration, because the tunnel furnace with the same heating and holding mechanisms as described above is located at the inlet of the finish rolling mills, the tunnel furnace heats the slab and maintains it at a predetermined temperature to compensate for the temperature drop that is expected to occur when the slab is held up in the looper, therefore the slab can be conveyed to the finish rolling mills at an optimum temperature.

The hot rolled steel sheet manufacturing apparatus according to the sixteenth preferred embodiment of the present invention is provided with a line A composed of any or all of the apparatus and methods embodiments tenth through the fifteenth, a line B comprised of a second continuous casting machine and a second heating furnace (tunnel furnace or walking beam furnace), and a second slab heating and holding furnace that transfers a slab on line B to line A, in which the second slab heating and holding furnace can transfer slabs corresponding to one coil or a plurality of coils.

The seventeenth preferred embodiment of the present invention relates to a method of manufacturing hot rolled steel sheet using only the line A specified in the sixteenth preferred embodiment; a. the material is continuous from the continuous casting facilities to the coiler, and several coils are manufactured with the sheet being cut before the coiler, and/or b. a slab corresponding to several coils is cut by a cutting machine at the outlet of the continuous casting facilities, continuously rolled, and the coils are produced by cutting the rolled sheet before the coiler, and/or c. a slab corresponding to one coil is cut by the cutter at the outlet of the continuous casting facilities, and each coil is rolled and reeled individually.

The eighteenth preferred embodiment of the present invention discloses a method of manufacturing hot rolled steel sheet using the lines A and B, according to the sixteenth preferred embodiment, in which the line A is configured with a, b and c of the seventeenth preferred embodiment, the line B is configured with b and c of the seventeenth preferred embodiment, and is combined with the line A, and slabs taken from the lines A and B are rolled alternately.

According to the nineteenth preferred embodiment of the present invention, a method of manufacturing hot rolled steel sheet is offered, in which a slab with a plate thickness of about 50 mm to 150 mm is manufactured by a continuous casting machine, next the slab is cut into predetermined lengths each of which can be reeled into one coil of rolled material, by a shear machine, then the slab is heated to and maintained at a predetermined temperature by a slab heating and holding furnace, while the slab is being conveyed on a rolling line, next the slab is pressed by a large amount and reduced to a pressed material with a predetermined thickness by a plate reduction press machine, while the slab is being conveyed from the slab heating and holding furnace, then the pressed material is rolled to the thickness of the product continuously by a plurality of finish rolling mills, as the pressed material is conveyed from the plate reduction press machine, and the material after being rolled to the thickness of the product is reeled into a coil, as the material is rolled coil by coil.

The process of the method according to the nineteenth preferred embodiment described above can be broken down into (1) the continuous casting machine manufactures a slab with a thickness of about 50 mm to 150 mm, (2) next the shear machine cuts the slab to predetermined lengths each of which after the material has been rolled can be reeled into one coil, (3) then while the slab is conveyed on the rolling line, the slab is heated to and maintained at a predetermined temperature by the slab heating and holding furnace, (4) the slab is reduced by a large amount to a predetermined thickness (about 20 mm) by the plate reduction press apparatus while the slab is being conveyed from the slab heating and holding furnace, (5) then while the slab is being transferred from the plate reduction press apparatus, the pressed material is rolled continuously by a plurality of finish rolling mills to the thickness of the product (about 0.8 to 1.0 mm), and (6) the material after being rolled is reeled coil by coil as it is being rolled.

Therefore, because the slab manufactured by the continuous casting machine and cut to a length corresponding to one coil is heated to and maintained at a predetermined temperature by the slab heating and holding furnace, and the slab can be conveyed to the plate reduction press apparatus in this state, the reducing and forming operations can be carried out easily and quickly. In addition, since a plate with a thickness of about 20 mm is reduced and formed by the plate reduction press apparatus, instead of a plurality of rough rolling mills according to the prior art, consequently the temperature of the slab is less than that used in conventional methods, and high-quality forming and reducing operations can be completed quickly. Furthermore, the pressed material can be conveyed continuously (in tandem) and quickly at a high temperature to the finish rolling mills, so that a very thin rolled material of about 0.8 to 1.0 mm can be produced. Also, the rolling line can be shortened by using the plate reduction press apparatus and batch operation in which one slab corresponds to one coil.

The twentieth preferred embodiment of the present invention discloses a hot rolled steel sheet manufacturing. apparatus provided with a continuous casting machine for manufacturing a slab with a thickness of about 50 mm to 150 mm, a shear machine located at the outlet of the continuous casting machine, for cutting the slab to a predetermined length from which material after being rolled can be reeled into one coil, a slab heating and holding furnace for heating the slab and holding it at a predetermined temperature as the slab is being conveyed on the rolling line, a plate reduction press machine for pressing the slab by a large amount as the slab is conveyed from the slab heating and holding furnace, to a predetermined thickness, a plurality of finish rolling mills for continuously rolling the material after being pressed by and conveyed from the plate reduction press machine, to a rolled material with the thickness of the product, and a coiler for reeling the rolled material as the material for one coil is conveyed from the finish rolling mills.

In the configuration of the twentieth preferred embodiment, the plate reduction press apparatus reduces a medium-thickness slab by a large amount in the direction of the plate thickness, that has been produced by the continuous casting facilities, in a batch system for a plurality of coils, instead of a plurality of rough rolling mills conventionally used for rough rolling and so eliminating the intermediate coiler also used in the prior art for heating and holding a slab, therefore the rolling line can be shortened and the cost of the equipment can be reduced. In addition, the use of the plate reduction press apparatus enables a slab with a thickness of about 20 mm to be conveyed to the finish rolling mills at a high temperature, so that the amount of heat used for heating the slab can be reduced, thus conserving energy.

In the twenty-first preferred embodiment, the aforementioned slab heating and holding furnace is a tunnel furnace or a double walking beam furnace and a looper for holding up a slack portion of the slab is provided between the plate reduction press machine and the finish rolling mills. According to the twenty-second preferred embodiment, the hot rolled steel sheet manufacturing apparatus is provided with a stentering press machine or a first vertical rolling mill located on the upstream side of the plate reduction press machine, for rolling the slab in the lateral direction thereof, and/or a second vertical rolling mill located at the inlet of the finish rolling mills, for rolling the slab in the lateral direction thereof.

In this configuration, an induction heating or gas heating system is provided on the ceiling or side surface of the tunnel furnace to heat the slab and maintain the temperature thereof, and the slabs manufactured by the continuous casting machine and cut into lengths corresponding to individual coils can be quickly and easily heated to and maintained at a predetermined optimum temperature. In addition, an excess (or deficit) portion of the slab, produced by a difference between the reducing speeds of the plate reduction press machine and the finish rolling mills is held up in the looper, so that the excess (or deficit) length can be evened out. Furthermore, the slab can be pressed in the lateral direction thereof by means of the lateral pressing dies of the stentering press machine or the vertical rolls of the vertical rolling mill, before being transferred to the plate reduction press apparatus, so the lateral dimensions of the slab can be changed or constrained quickly and easily. Also, since the vertical rolling mill is located at the inlet of the finish rolling mills, any variations in the lateral dimensions, produced by pressing, can be corrected, and a rolled material with a good shape can be produced.

The hot rolled steel sheet manufacturing apparatus according to the twenty-third preferred embodiment of the present invention is provided with a line A according to any or all of claims 19 through 22, a line B comprised of a second continuous casting machine and a second heating furnace (tunnel furnace or walking beam furnace), which is located alongside the casting machine and the heating furnace of line A, and a second heating and holding furnace for transferring a slab in line B to line A, in which the aforementioned second heating and holding furnace can transfer slabs corresponding to one coil. Also, the method of manufacturing a hot rolled steel sheet specified in the twenty-fourth preferred embodiment relates to the case in which the line A and the line B according to the twenty-third preferred embodiment are installed, and each slab corresponding to one coil, output from the lines A and B, in sequence is pressed with a high reduction ratio, into a pressed material, and then the pressed material is rolled coil by coil, and the rolled material is reeled into one coil.

Therefore, according to the aforementioned casting apparatus and methods, the production efficiency can be improved because slabs can be supplied alternately, from the continuous casting facilities, to the rolling line in a batch system in an efficient manner.

In the twenty-fifth preferred embodiment of the present invention, a hot rolled steel sheet manufacturing apparatus is provided with a rolling line comprised of a stentering press machine or a first vertical rolling mill for pressing or rolling a slab in the lateral direction thereof, downstream from a slab heating and holding furnace, a plate reduction press apparatus for pressing the slab with a high reduction ratio, to a predetermined thickness, a looper for holding up a slack portion of the slab, a second vertical rolling mill located at the inlet of the finish rolling mill, for pressing the slab in the lateral direction thereof, into a pressed material, a plurality of finish rolling mills for rolling the pressed material continuously to a rolled material with the thickness of the product, and a coiler for reeling the rolled material, corresponding to one coil, in which a plurality of continuous casting machines located on the upstream side of the aforementioned slab heating and holding furnace in the rolling line, opposite each other for manufacturing slabs with a thickness of about 50 mm to 150 mm, a shear machine located at the outlet of the continuous casting machines for cutting the slabs into lengths corresponding to the length of rolled material to be rolled into one coil, and heating furnaces of the walking beam type are installed. According to twenty-sixth preferred embodiment, when the hot rolled steel sheet manufacturing apparatus of the twenty-fifth preferred embodiment is provided with a plurality of walking beam type heating furnaces, a hot rolled steel sheet is manufactured by the method in which slabs are transferred from the walking beam type heating furnaces in sequence to the rolling line, pressed with a high reduction ratio into pressed material, then the material is rolled into rolled material, coil by coil, and the rolled material for one coil is reeled into a coil.

Consequently, the casting facilities and the methods according to the present invention can also improve the productivity of the rolled material, because medium-thickness slabs manufactured by a plurality (for instance, 2 machines) of continuous casting machines and cut so that they can be reeled by the coiler into one coil, in a batch system, can be supplied efficiently into the rolling line.

3. The third object of the present invention is to provide an apparatus capable of hot pressing and rolling both a slab of a normal length and a long slab. In addition, the object also includes presenting an apparatus that manufactures coils of thin sheets with different widths and/or thicknesses, from a long slab.

To achieve the third object described above, the twenty-seventh preferred embodiment provides a hot rolled steel sheet manufacturing apparatus with a heating furnace for heating a slab supplied from upstream, at least one first roughing mill located on the downstream side of the heating furnace, a plate reduction press apparatus located on the downstream side of the first roughing mill, at least one second roughing mill located on the downstream side of the plate reduction press apparatus, a plurality of finish rolling mills located on the downstream side of the second roughing mill, a flying shear machine located on the downstream side of the plurality of finish rolling mills, and a coiler located on the downstream side of the flying shear machine.

With this apparatus, a slab with a normal length is processed by the heating furnace, first roughing mill and second roughing mill, finish rolling mills, and coiler. For a long slab, the heating furnace is not used because the slab has been heated before entering the pressing line, therefore the plate reduction press apparatus or the plate reduction press apparatus and second roughing mill, or the first roughing mill and plate reduction press apparatus and second roughing mill, and finish rolling mills, flying shear machine and coiler are used.

In the invention of the twenty-eighth preferred embodiment using the hot rolled steel sheet manufacturing apparatus specified in the twenty-seventh preferred embodiment, a slab with a normal length is heated by the aforementioned heating furnace, rough rolled by the first roughing mill or the plate reduction press apparatus, rough rolled by the second roughing mill, finish rolled by the finish rolling mills, and reeled by the coiler. A long slab is rough pressed or rolled by the plate reduction press apparatus, or the plate reduction press apparatus and the second roughing mill, or the first roughing mill, the plate reduction press apparatus and the second roughing mill, then finish rolled by the finish rolling mills, cut by the flying shear machine into predetermined lengths, and reeled by the coiler.

When the first roughing mill is used for a slab with a normal length, reverse rolling is also applied normally, and the slab is rolled in a plurality of passes. With the plate reduction press apparatus, the slab is reduced in one pass. For a long slab, the means of rough rolling is selected from the plate reduction press apparatus, or the plate reduction press apparatus and the second roughing mill, or the first roughing mill, the plate reduction press apparatus and the second roughing mill, depending on what plate thickness is to be achieved by the rough rolling. In addition, the rolled material cannot be reeled into one coil, therefore the flying shear machine is used so that the material can be reeled into a plurality of coils.

In the twenty-ninth preferred embodiment of the invention, a stentering press is located between the aforementioned heating furnace and the above-mentioned first roughing mill. Using such a stentering press machine, coils of thin steel sheets with different widths can be manufactured.

In the thirtieth preferred embodiment of the invention, thin steel sheets with different widths and/or thicknesses are pressed or rolled by the stentering press machine and the plate reduction press apparatus, or the plate reduction press apparatus and the second roughing mill, or the first roughing mill, the plate reduction press apparatus and the second roughing mill, and the finish rolling mills, and then each type of very thin steel sheets with different widths and thicknesses is reeled by the coiler and cut by the flying shear machine.

If a finished very thin steel sheet cannot be reeled into one coil, it must be divided into a plurality of coils each of which is reeled separately. Therefore, it is possible to classify each combination of widths and thicknesses of very thin steel sheet, coil by coil, when rolling the sheet. The stentering press machine presses the width of a slab, to the required width for each coil to be reeled. In addition, a length of the slab corresponding to each width, is pressed and rolled so that the very thin sheets reeled into coils can be classified according to the required thicknesses and widths, using the plate reduction press apparatus, or the plate reduction press apparatus and the second roughing mill, or the first roughing mill, the plate reduction press apparatus and the second roughing mill. Thus, a plurality of coils with different widths and thicknesses can be manufactured from a slab.

4. The fourth object of the present invention is to present a hot rolled steel sheet manufacturing apparatus in which a material to be pressed or rolled can be moved substantially continuously in synchronism with finish rolling mills etc. located on the downstream side of a production line, without having to make fine adjustments to the frequency of the pressing cycles.

According to the thirty-first preferred embodiment of the invention established to achieve the fourth object, a hot rolled steel sheet manufacturing apparatus is composed of a plate reduction press apparatus constructed so that the dies can move in the downstream direction of a pressing line for a material to be pressed, while the material is being pressed by the dies, and a feeding device that moves the aforementioned material to be pressed in the downstream direction, in which while the dies of the plate reduction press apparatus are not in contact with the material to be pressed, or when the dies are pressing the material to be pressed or not in contact therewith, the feeding device moves the material to be rolled in the downstream direction.

In the configuration of the thirty-first embodiment described above, the plate reduction press apparatus moves the material to be pressed in the downstream direction of the pressing line while the material is being pressed by the dies, and in addition, the feeding device also moves the material to be pressed in the downstream direction even when the dies are not in contact with the material, therefore by adjusting the feeding speed of the device, the material to be rolled can be moved substantially continuously, in synchronism with the finish rolling mills etc. located on the downstream side without having to make fine adjustments to the frequency of the pressing cycles.

In the thirty-second preferred embodiment of the invention, the aforementioned plate reduction press apparatus is provided with pressing mechanisms that move the dies eccentrically in a circular path with a radius of r, the dies come in contact with the material to be pressed when the angle of rotation from the upstream horizontal line to the material to be pressed has a positive value the dies press the material and move while pressing, the speed at which the dies move reaches a maximum V when=90°, the above-mentioned feeding device feeds the material to be pressed at a speed v=Vsin when the dies are pressing, and feeds the material to be pressed substantially at a constant speed v0 during the period when the material is not being pressed, and the aforementioned constant speed v0 can be varied.

In this configuration, the feeding device feeds the material to be pressed at a speed v=Vsin when the dies are pressing, so slipping of the material to be pressed relative to the means of feeding (for instance, conveyor rollers) can be prevented, thus preventing energy losses, scratches, etc. due to slipping. In addition, the material to be roiled is fed substantially at a constant speed v0 during then period when the material is not being pressed, and because this speed is variable, the speed is adjusted so that the material to be rolled can be moved substantially continuously, in synchronism with the finish rolling mills etc. located on the downstream side without having to make fine adjustments to the frequency of the pressing cycles.

The thirty-third preferred embodiment of the present invention provides a hot rolled steel sheet manufacturing apparatus with a plate reduction press apparatus that moves a material to be pressed in the downstream direction of a pressing line while the material is being pressed by the dies, a feeding device for moving the material to be pressed in the downstream direction, a rolling mill located on the downstream side of the plate reduction press apparatus, that continuously presses the material to be rolled, and a looper device located between the plate reduction press apparatus and the rolling mill, that accommodates a slack portion of the material to be rolled, produced therebetween, in which the mean feeding speed vs at the inlet of the plate reduction press apparatus is set to be identical to the mass flow of the material to be rolled on the downstream side of the rolling mill, and the feeding speed v0 of the feeding device during the period when the material is not being pressed is set such that the mean feeding speed during a pressing cycle agrees with the aforementioned speed vs.

In this configuration, the mean feeding speed vs at the inlet of the plate reduction press apparatus is set to be identical to the mass flow of the material being rolled on the downstream side of the rolling mill, and the feeding speed v0 of the feeding device during the period when the material is not being pressed is set such that a mean feeding speed during a pressing cycle agrees with the aforementioned speed, therefore the maximum amount of slack produced in the material to be rolled, between the plate reduction press apparatus and the rolling mill, is only that due to the differences in the feeding speed during a pressing cycle, so the looper device can be made compact.

5. The fifth object of the present invention is to provide a hot rolled steel sheet manufacturing apparatus that can efficiently press, roll and form a material to be shaped in the direction of the plate thickness, and a method of manufacturing a hot rolled steel sheet.

In the method of manufacturing a hot rolled steel sheet, described in the thirty-fourth preferred embodiment of the present invention, with the aim of achieving the fifth object, dies are moved towards and away from each other on both sides of a material to be shaped, heated to a predetermined temperature, and press and form the aforementioned material in the direction of the plate thickness of the material, a portion of the material after being shaped by the dies is inserted between the upper and lower work rolls and rolled and formed therebetween, and a slack portion is produced in the pressed material between the dies and the above-mentioned work rolls located in the close vicinity of the dies.

According to the method of manufacturing a hot rolled steel sheet specified in the thirty-fifth preferred embodiment of the present invention, first dies are moved towards and away from each other in the left and right directions of a material to be shaped, and press and form the material in the direction of the plate width, the portion of the material that has been shaped by the first dies is heated to a predetermined temperature, second dies are moved towards and away from each other in the up and down direction of the material to be shaped, and press and form the material in the direction of the plate thickness, the portion of the material after being shaped by the second dies is inserted between the upper and lower work rolls, and rolled and formed, and an appropriate slack portion is produced in the material being shaped between the second dies and the work rolls located close to the aforementioned second dies.

In the method of manufacturing a hot rolled steel sheet specified in the thirty-sixth preferred embodiment of the present invention, first dies are moved towards and away from each other on the left and right sides of a material to be shaped, heated to a predetermined temperature, and press and form the material in the direction of the plate width, second dies are moved towards and away from each other in the up and down direction of the portion of the material, that has been pressed by the first dies in the left and right direction of the material, and press and form the material in the direction of the plate thickness, the portion of the material, that has been pressed by the second dies is next inserted between the upper and lower work rolls, and rolled and formed, and a slack portion of the material being shaped is formed by an appropriate deflection downwards between the second dies and the work rolls located close to the aforementioned second dies.

According to the method of manufacturing a hot rolled steel sheet specified in the thirty-seventh preferred embodiment of the invention, in addition to the means for manufacturing a hot rolled steel sheet, specified in either the thirty-fifth or the thirty-sixth embodiments of the present invention, a slack portion of the material to be shaped is formed by an appropriate deflection downwards between the dies for press forming in the lateral direction and the dies for press forming in the direction of the plate thickness.

The hot rolled steel sheet manufacturing apparatus specified in the thirty-eighth preferred embodiment of the present invention is provided with a tunnel furnace that can heat the material to be shaped which is moving on a transfer line, a plate reduction press machine with a pair of upper and lower dies that can move towards and away from each other in the up and down direction of the transfer line, in synchronism with each other and are located on the downstream side of the aforementioned tunnel furnace on the transfer line, a plurality of roughing mills each of which is comprised of a pair of upper and lower work rolls located opposite each other above and below the transfer line and are located in series on the downstream side of the above-mentioned plate reduction press machine on the transfer line, and a looper mechanism that is located between the plate reduction press machine and the first roughing mill in the upstream direction of the transfer line and can form a slack portion of the material to be shaped in a downward deflection, when the material is moving on the transfer line.

In the hot rolled steel sheet manufacturing apparatus specified in the thirty-ninth preferred embodiment of the invention, there is a stentering press machine with a pair of left and right dies that can move towards and away from a transfer line on the left and right sides of the transfer line in synchronism with each other, a tunnel furnace that can heat the material to be shaped, which is moving on the transfer line and is located on the downstream side of the aforementioned plate reduction press machine on the transfer line, a plate reduction press machine with a pair of upper and lower dies that can move towards and away from the transfer line in the up and down direction of the transfer line and is located on the downstream side of the above-mentioned tunnel furnace on the transfer line, a plurality of roughing mills each of which is comprised of a pair of upper and lower work rolls located opposite each other above and below the transfer line and are located in series on the downstream side of the aforementioned plate reduction press machine on the transfer line, and a looper mechanism that is located between the plate reduction press machine and the first roughing mill in the upstream direction of the transfer line and can form a slack portion of the material to be shaped in a downward deflection, when the material is moving on the transfer line.

The hot rolled steel sheet manufacturing apparatus described in the fortieth preferred embodiment of the present invention is composed of a tunnel furnace that can heat a material to be shaped, which is moving on a transfer line, a stentering press machine with a pair of left and right dies that can move towards and away from the transfer line on the left and right sides of the transfer line, in synchronism with each other, and is located on the downstream side of the above-mentioned tunnel furnace on the transfer line, a plate reduction press machine with a pair of upper and lower dies that can move towards and away from the transfer line in the up and down direction of the transfer line and is located on the downstream side of the aforementioned stentering press machine on the transfer line, a plurality of roughing mills each of which is comprised of a pair of upper and lower work rolls located opposite each other above and below the transfer line, and are located in series on the downstream side of the above-mentioned plate reduction press machine on the transfer line, and a looper mechanism that is located between the late reduction press machine and the first roughing mill in the upstream direction of the transfer line and can form a slack p portion of the material to be shaped in a downward deflection, when the material is moving on the transfer line.

In the hot rolled steel sheet manufacturing apparatus specified in the forty-first preferred embodiment of the present invention, in addition to the means described in claim 39, a second looper mechanism is located between the stentering press machine and the tunnel furnace or between the tunnel furnace and the plate reduction press machine, and can form a slack portion of the material to be shaped in a downward deflection, when the material is moving on the transfer line.

The hot rolled steel sheet manufacturing apparatus specified in the forty-second preferred embodiment of the present invention, which in addition to including the configuration of components of the hot rolled steel sheet manufacturing apparatus mentioned in the fortieth preferred embodiment of the invention, a second looper mechanism is provided between the stentering press machine and the plate reduction press machine, and can form a slack portion of the material to be shaped in a downward deflection, when the material is moving on the transfer line.

In any of the methods of manufacturing a hot rolled steel sheet according to the thirty-fourth through the thirty-seventh preferred embodiments of the present invention, the material to be shaped is heated to a predetermined temperature and sequentially pressed and reduced with upper and lower dies in the direction of its plate thickness and a plurality of upper and lower work rolls, thereby the material to be shaped is efficiently pressed, reduced and shaped.

In addition, between the dies for pressing, reducing and forming the thickness of the plate and the work rolls located adjacent to these dies, a slack portion of the material to be shaped is formed by an appropriate downward deflection to adjust for differences in the operating speeds of the dies for pressing the plate thickness and the work rolls for reducing the plate thickness, of the material to be shaped.

In the method of manufacturing a hot rolled steel sheet according to the thirty-seventh preferred embodiment of the invention, a slack portion of a material to be shaped is formed by an appropriate downward deflection between the dies for pressing, reducing and forming a plate in the direction of its width and the dies for pressing, reducing and forming a plate in the direction of its thickness, and adjusts for differences in the operating speeds for reducing the width with the former dies and reducing the plate thickness using the latter dies, of the material to be shaped.

In any one of the hot rolled steel sheet manufacturing apparatus according to any one of the thirty-eighth through the forty-second preferred embodiments of the present invention, the thickness of the material to be shaped, after heating in the tunnel furnace, is reduced sequentially by means of the dies of the plate reduction press machine and the work rolls of a plurality of roughing mills, thereby the material to be shaped is pressed, reduced and formed efficiently in the direction of the plate thickness.

In addition, a looper mechanism is provided between the plate reduction press machine and the first roughing mill in the upstream direction of the transfer line, and forms a slack portion in the material to be shaped in a downward deflection, and adjusts for differences in the operating speeds for reducing the plate thickness using the plate reduction press machine and reducing the plate thickness with the roughing mills, of the material to be shaped.

According to the hot rolled steel sheet manufacturing apparatus according to the forty-first preferred embodiment of the present invention, another looper mechanism is located between the stentering press machine and the tunnel furnace or between the tunnel furnace and the plate reduction press machine, as specified in claim 39 of the invention, and can form a slack portion in the material to be shaped in a downward deflection, when the material is moving on the transfer line.

The hot rolled steel sheet manufacturing apparatus specified in the forty-second preferred embodiment is, in addition to the conditions described in the fortieth preferred embodiment, provided with another looper mechanism located between the stentering press machine and the plate reduction press machine, and can form a slack portion in the material to be shaped in a downward deflection, when the material is moving on the transfer line.

According to the method of manufacturing a hot rolled steel sheet specified in the forty-third preferred embodiment of the present invention, aimed at achieving the fifth object of the invention, a material to be shaped is heated to a hot processing temperature and moved from the upstream side to the downstream side of a transfer line, a plurality of dies located along the direction of the transfer line are moved alternately towards and away from the material to be shaped, from above and below the material to be shaped, thus the material to be shaped is processed and formed in the direction of the plate thickness, by means of a plurality of plate thickness reducing operations, then the material after being reduced in the direction of the plate thickness by a plurality of plate thickness reducing operations is rolled by work rolls from above and below the material to further reduce and form the material in the direction of the plate thickness, and a slack portion in the material being shaped is formed in an appropriate downward deflection between the last dies in downstream direction of the transfer line and the work rolls.

The hot rolled steel sheet manufacturing apparatus according to the forty-fourth preferred embodiment is provided with a heating and holding furnace for heating a material to be shaped, located on a transfer line, a plate reduction press machine comprised of a plurality of upper and lower dies located opposite each other above and below the transfer line, and in series in the longitudinal direction of the transfer line, that can press and reduce the material to be shaped in the direction of the plate thickness, and the aforementioned plate reduction press machine being located on the downstream side of the heating and holding furnace on the transfer line, a roughing mill composed of work rolls located opposite each other above and below the transfer line, on the downstream side of the above-mentioned plate reduction press machine on the transfer line, that can roll the material to be shaped in the direction of the plate thickness, and a looper mechanism located between the aforementioned plate reduction press machine and the roughing mill, that can form a slack portion in the material to be shaped in a downward deflection.

In the hot rolled steel sheet manufacturing apparatus according to the forty-fifth preferred embodiment of the present invention, which is a modified form of the forty-fourth preferred embodiment, the looper mechanism is composed of an upstream table located in the vicinity of the plate reduction press machine in the downstream direction of the transfer line, means for raising and lowering the aforementioned upstream table, a plurality of upstream rollers installed on the above-mentioned upstream table in such a manner that the upstream rollers can contact the lower surface of the material to be shaped and the positions of the bearings supporting the rollers gradually slope downwards in the downstream direction of the transfer line, upstream pinch rolls located in the vicinity of aforementioned upstream table in the upstream direction of the transfer line, that can grip the material to be shaped in the direction of the plate thickness, a downstream table located in the vicinity of the roughing mill in the upstream direction of the transfer line, a plurality of downstream rollers installed on the above-mentioned downstream table in such a manner that the downstream rollers can contact the lower surface of the material being shaped and the positions of the bearings supporting the rollers gradually slope downwards in the downstream direction of the transfer line, and downstream pinch rolls located in the vicinity of the aforementioned downstream table in the downstream direction of the transfer line, that can grip the material being shaped in the direction of the plate thickness.

When a hot rolled steel sheet is manufactured by the method specified in the forty-third preferred embodiment of the present invention, a material to be pressed, reduced and shaped is heated to a hot processing temperature, its thickness is reduced several times by a plurality of upper and lower dies arranged along the transfer line, and then the portion of the material to be shaped, that has been subjected to several operations to reduce its thickness, is further pressed, reduced and formed in the direction of the plate thickness with upper and lower work rolls, thereby the material to be shaped is pressed, reduced and formed efficiently in the direction of the plate thickness.

Furthermore, a portion of the material to be shaped, whose plate thickness has been reduced completely through several operations, is formed into slack downward deflection between the last dies in the downstream direction of the transfer line and the work rolls, so as to contain a portion of the material to be shaped, already output after being pressed with the dies.

In any of the hot rolled steel sheet manufacturing apparatus according to the forty-fourth or the forty-fifth preferred embodiments of the present invention, a material to be pressed and shaped is heated in the heating and holding furnace, pressed in the direction of its plate thickness by a plurality of dies arranged along the transfer direction of the plate reduction press machine, and the portion of the material to be shaped, that has been pressed, reduced and formed completely by the plate reduction press machine, is pressed, reduced and formed in the direction of the plate thickness using the work rolls of the roughing mill, thus the material to be shaped is efficiently reduced, pressed and formed in the direction of the plate thickness.

In addition, a portion of the material to be shaped, already pressed, reduced and formed by the plate reduction press machine, is deflected downwards to form a slack portion using the looper mechanism, that contains a portion of the material to be shaped, after it has already been pressed by the plate reduction press machine.

6. The sixth object of the present invention is to adjust the width of a slab as well as to prevent cracks at the edges or the occurrence of seam flaws. The object also includes the prevention of slipping between the dies of the press machine and the slab.

To achieve the sixth object described above, the forty-sixth preferred embodiment of the present invention provides a rough pressing apparatus with an edger for pressing a slab in the lateral direction thereof, located at the inlet of a press machine.

When a slab is pressed and reduced in the lateral direction with an edger, any gaps, voids, etc. existing inside the edges of the slab, which may possibly cause cracks later, are compressed, so that even if the slab is later pressed and reduced in the direction of the thickness with a press machine, cracks or flaws may not be produced so easily. Hence, the edger can prevent the occurrence of cracks or flaws as well as adjusting the width of a slab. In addition, as the stentering rolls of the edger rotate, they have the effect of pushing the slab into the press machine. In addition, because of the rotation of the stentering press rolls, slippage between the surfaces of the dies that slope in the longitudinal direction of the slab and the slab can also be prevented.

According to the forty-seventh preferred embodiment of the invention, the above-mentioned edger is provided with cylindrical rolls that press the lateral edges of the slab while the rolls are rotating.

Because the cylindrical rolls compress any gaps etc. that if present in the slab, may cause cracks, by pressing the lateral edges of the slab, therefore even when the slab is later pressed and reduced in the direction of its thickness with a reduction press machine, cracks or flaws will not be produced so easily. Although the edges become thicker at this time, no cracks will be created when the slab is pressed in the direction of its thickness, because the slab has been compressed by being pressed and reduced in the lateral direction.

According to the forty-eight preferred embodiment of the invention, the center portions of each of the cylindrical rolls is provided with a projecting portion with a convex cross section, formed on the peripheries of the cylindrical rolls.

The projecting portion of the rolls produces a linear recess at the center of the surface of the lateral edge of a slab, therefore afterwards when the thickened edges of the slab are pressed and reduced in the direction of the thickness using a plate reduction press machine, the linear recesses can compensate for the excess volume of the slab, so that pressing to reduce the thickness can be carried out smoothly.

According to the forty-ninth preferred embodiment of the invention, the edger is provided with bobbin-shaped rolls that press the edges of the slab while the rolls are rotating, and each of the bobbin-shaped rolls has a cylindrical center portion, tapered portions connected to both ends of the center portion, and outer cylindrical portions connected to the outsides of the tapered portions.

When the bobbin-shaped rolls press a slab in the lateral direction, the lateral edges of the slab can be formed in a shape with vertical surfaces at the center and sloping surfaces at the top and bottom. As a result, the shape of the edges can prevent the large build-ups which would otherwise be produced when the slab is later pressed with the reduction press machine in the direction of the thickness. Therefore, edge cracks and seam flaws, that may otherwise arise during later pressing and rolling in the direction of the thickness, can be prevented.

In the fiftieth preferred embodiment of the invention, projecting portions with convex cross sections are formed on the peripheries of the cylindrical portions of the bobbin-shaped rolls.

The projecting portions of the rolls produce linear recesses at the centers of the surfaces of the lateral edges of a slab, and the linear recesses absorb the build-ups produced at both edges, when the slab is later pressed and reduced in the direction of its thickness by a plate reduction press machine, therefore pressing and reducing the thickness can be carried out smoothly.

According to the fifty-first preferred embodiment of the invention, in which the aforementioned plate reduction press machine and the above-mentioned edger are combined, the rolling speed of the edger is made identical to the speed of conveying the slab during a period when there is no pressing, and the aforementioned rolling speed is made equal to the speed at which the slab is conveyed during a pressing period, minus the speed at which the material of the slab is forced backwards during pressing.

The plate reduction press machine is constructed as a flying press machine in which a slab is also conveyed while it is being pressed. Although the slab extends longitudinally when pressed, the speed at which the slab is forced backwards, that is, in the reverse direction to the transfer direction of the slab (in the direction of the edger) is called the backward speed. The rolling speed of the edger is adjusted to be equal to the speed of conveying the slab during the period when there is no pressing, and it is made equal to the speed at which the slab is conveyed during pressing minus the backward speed due to pressing, thereby both the width and thickness can be pressed and reduced simultaneously.

7. The seventh object of the present invention is to offer a hot rolled steel sheet manufacturing apparatus that can sequentially press the width and thickness of a slab.

To achieve the seventh object as described above, according to the fifty-second preferred embodiment of the present invention, a stentering press machine and a thickness reduction press machine are installed along a line on which a slab moves, a width pressing operation and a thickness pressing operation are carried out such that they operate at different times, the speed at which the slab is moved during the width pressing operation is made identical to the speed at which the pressing unit of the stentering press machine is moved, and the speed at which the slab is moved during the thickness pressing operation is made identical to the speed at which the pressing unit of the thickness press machine is moved.

By installing the stentering and thickness press machines along the line on which the slab moves, and by actuating the stentering and thickness pressing operations at different times, each pressing operation can be carried out without adversely affecting the other machine. In addition, because the slab is moving even during the stentering pressing or thickness pressing period, continuous pressing or rolling can be performed. In this way, reversing operation is not required for either press machine.

According to the fifty-third preferred embodiment of the invention, a stentering press machine and a thickness reduction press machine are provided and located along a line on which a slab is transferred, in which the aforementioned stentering press machine is composed of a first pressing device that moves in the direction of flow of the slab, together with the slab during a stentering period, the above-mentioned thickness reduction press machine is provided with a second pressing device that moves in the direction of flow of the slab, together with the slab during a thickness pressing period, and the aforementioned stentering and thickness reduction press machines are operated at different times.

The pressing unit of the stentering press machine moves in the direction of flow of the slab together with the slab during a stentering pressing period, and the pressing unit of the thickness reduction press machine also moves in the direction of flow of the slab together with the slab when it is being pressed in the direction of its thickness, and the slab moves at the normal conveying speed when neither unit is operated, therefore the slab can be rolled continuously. In addition, since a stentering pressing operation and a thickness reduction pressing operation are actuated at different times instead of being carried out simultaneously, they have no adverse effect on each other.

In the fifty-fourth preferred embodiment of the invention, the distance L for moving a slab in one cycle of the stentering period, the thickness reduction pressing period, and the period for conveying at the normal speed, as specified in the fifty-third preferred embodiment, is no larger than either the length L1 of the stentering dies in the direction of flow of the slab or the length L2 of thickness reduction pressing dies in the direction of flow of the slab.

Although the slab is fed by a length L in one of the above cycles, L is not larger than either the length L1 of the stentering dies or the length L2 of the thickness reduction pressing dies, both in the direction of flow of the slab, therefore both the lengths pressed by the stentering press and by the thickness reduction press in the next cycle slightly superimpose the corresponding lengths pressed in the previous cycle. Consequently, the slab can be properly pressed in the stentering direction and the thickness direction without leaving any unpressed portions.

The other objects and advantages of the present invention will be clarified in the following description by referring to the attached drawings.

DESCRIPTION OF ILLUSTRATIVE EMBODIMENTS

Figure 1:
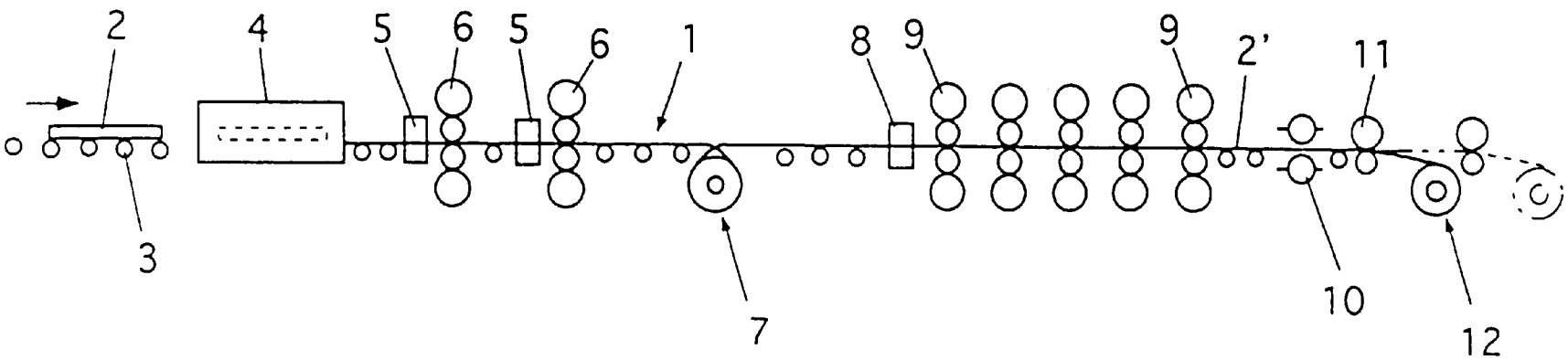
Fig. 1 PRIOR ART
FIG. 1 is a schematic view showing the layout of conventional rolling facility.
Figure 2:
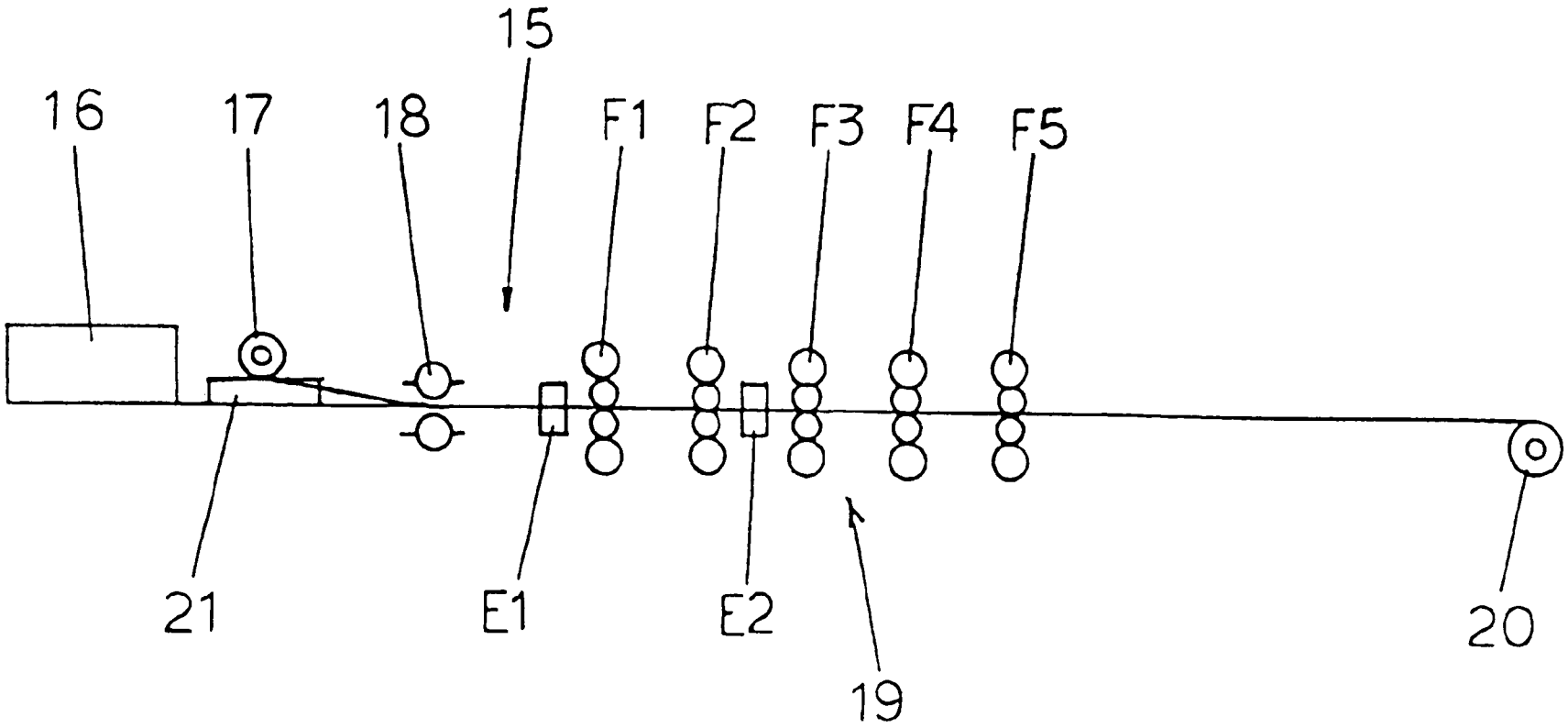
Fig. 2 PRIOR ART
FIG. 2 is a schematic view showing the arrangement of another conventional rolling facility.
Figure 3:
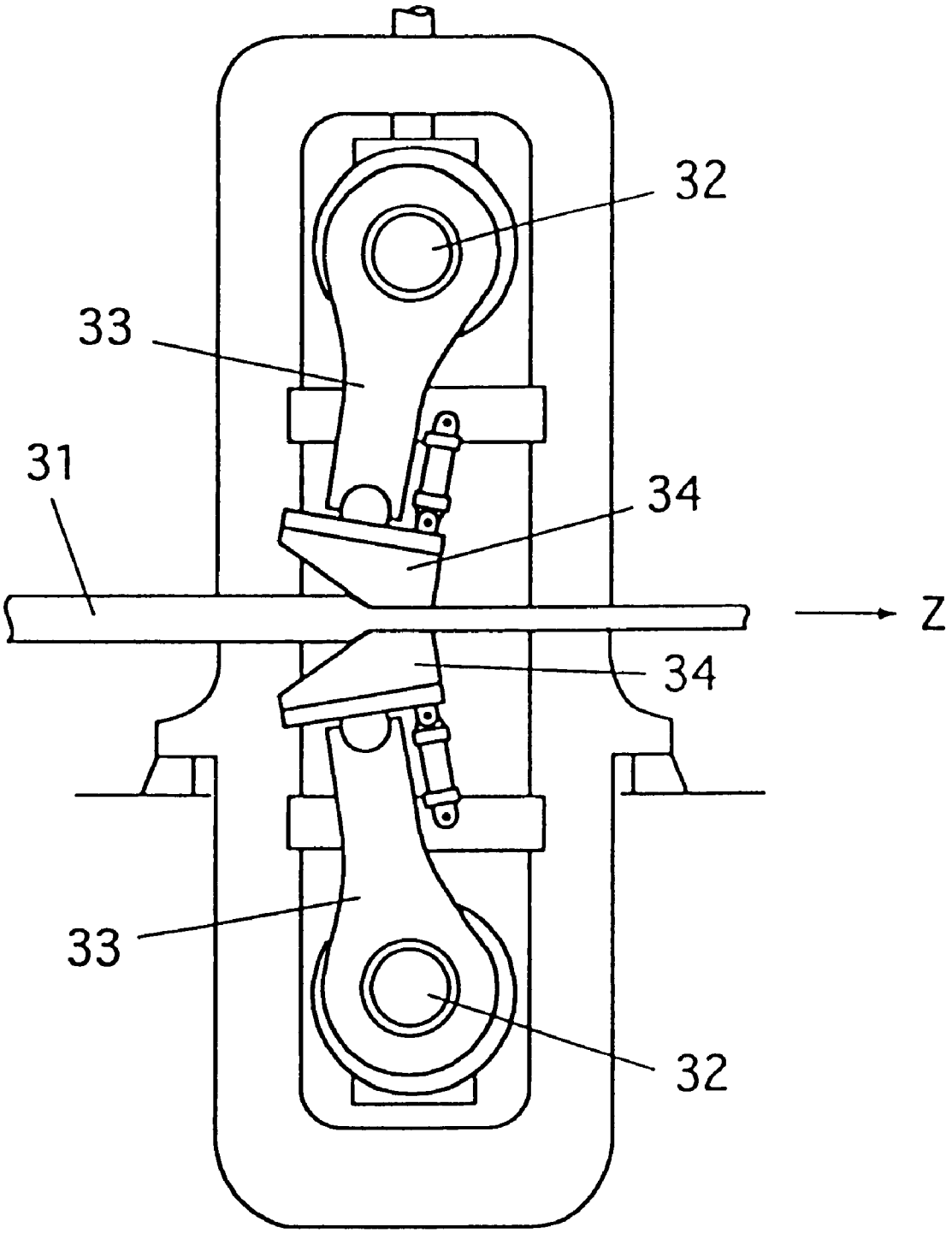
Fig. 3 PRIOR ART
FIG. 3 is a schematic view of a conventional plate reduction press machine.
Figure 4:
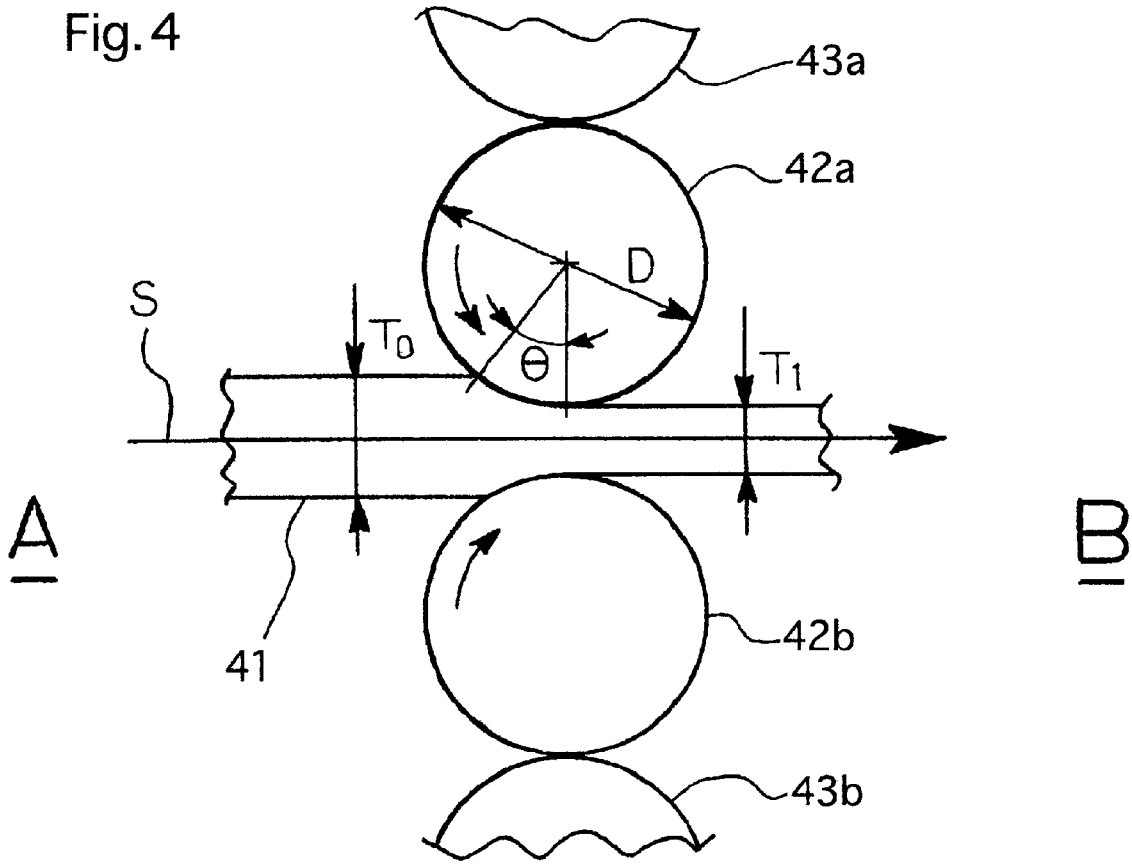
FIG. 4 is a conceptual view of a roughing mill.
Figure 5A:
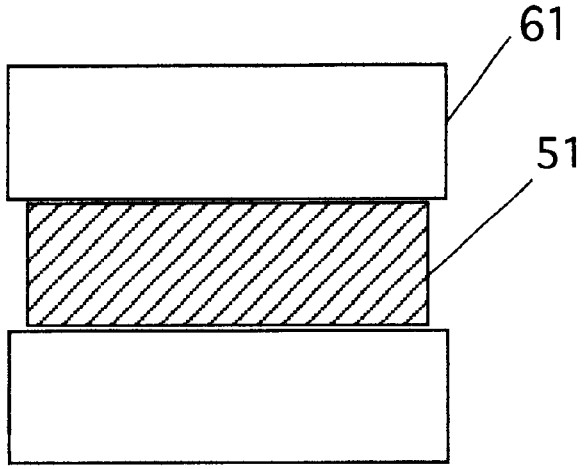
FIG. 5A is a view of a slab before being pressed with a large reduction.
Figure 5B:
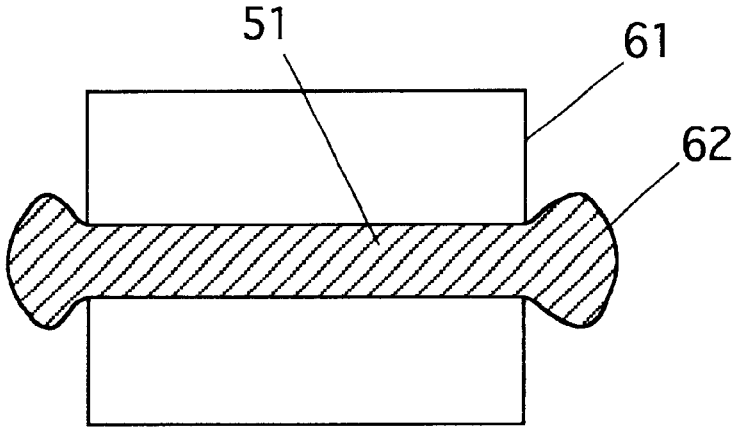
FIG. 5B illustrates how swollen portions are produced at the lateral edges of the slab after being pressed with a large reduction.
Figure 6:
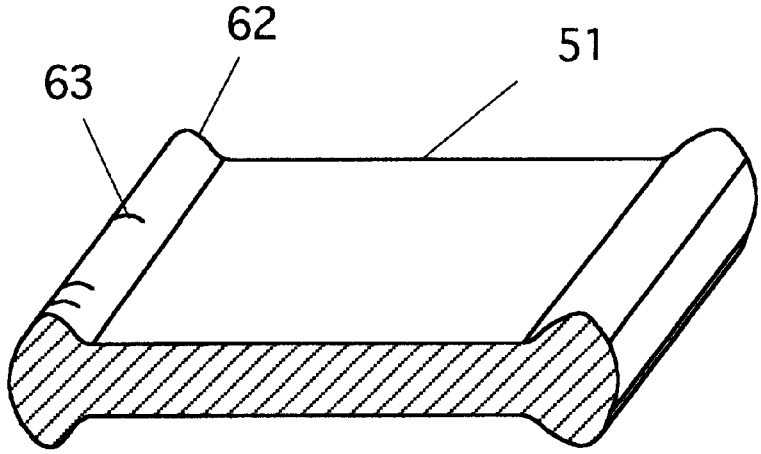
FIG. 6 shows cracks produced on the swollen portions.
Figure 7A:
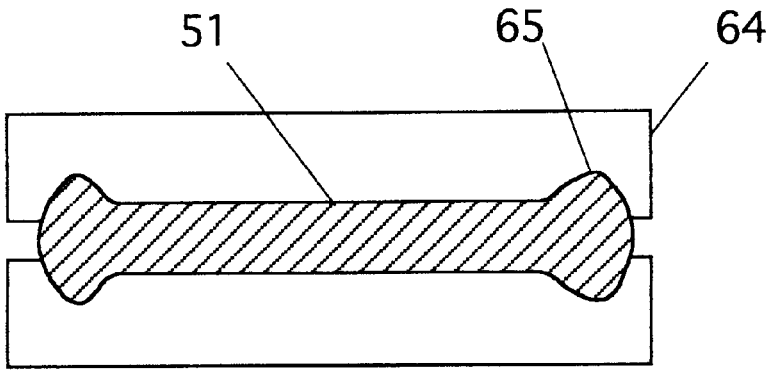
FIG. 7A is a view immediately before being rolled.
Figure 7B:
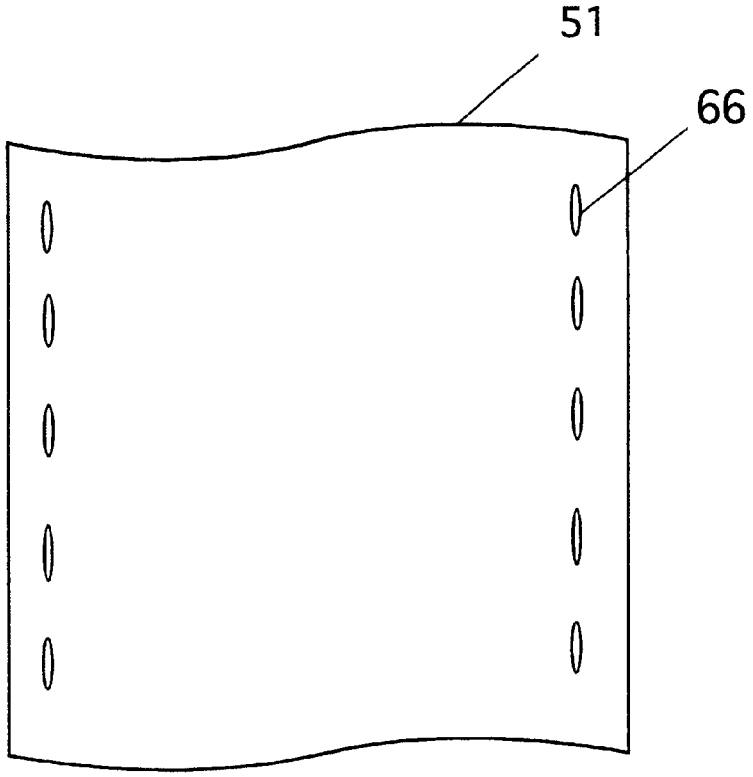
FIG. 7B shows how seam flaws are produced during rolling.

Illustrative embodiments of the present invention are described below referring to the drawings. The following illustrative embodiments do not necessarily correspond one-to-one with the preferred embodiments described above in the Summary of the Invention.

The hot rolled steel sheet manufacturing apparatus according to the present invention utilizes a direct feed rolling technology in which continuous casting facilities and a hot rolling process are directly connected, and continuously casts a slab with a length corresponding to a plurality of coils of hot rolled steel sheet and, as a maximum, corresponding to one charge of a converter (called "a long slab" for short), and enables direct-feed rolling (however, the slab is processed in part by means other than rolling equipment), and is composed of continuous casting facilities for continuously casting a hot slab, rough processing facilities for processing the hot slab cast by the aforementioned continuous casting facilities and forming the slab into a sheet bar, a group of finish rolling mills that roll the sheet bar manufactured by the above-mentioned rough processing facilities, and a coiler that reels the aforementioned hot rolled steel sheet, which are located in that order.

In a hot rolled steel sheet manufacturing system such as the apparatus according to the present invention, in which a hot rolled long slab, corresponding to a plurality of coils of hot rolled steel sheets (for instance, n coils of hot rolled steel sheets) is cast, and its thickness is reduced to manufacture a hot rolled steel sheet, only two cropped portions at the leading and trailing ends of the slab are cut off and wasted before being finish rolled, even though n coils of steel sheets have been rolled. In addition, unlike a conventional continuous hot rolling method, there is no need to join materials, so that there are no problems such as the lower strength at a joint, and degradation of material quality due to local heating at a joint. Even when a slab corresponding to n coils of steel sheets is rolled, the defective material that is produced may be limited only to that due to wave distortions on the runout table, that is, a portion corresponding to the leading end of the first coil of steel sheet and a part of the trailing end of the n-th coil of steel sheet, so that compared to a conventional batch rolling process, the yield is improved. In addition, a similar advantage can be obtained also by reducing losses due to cutting when a slab is cut.

In addition, it can be expected that a higher yield will be obtained by continuously rolling a slab with a length as long as that corresponding to one charge of a converter, as a maximum. Furthermore, the problem of flaws produced on the surface of a sheet bar, after it has been coiled in a conventional method of continuous hot rolling, will not occur. Moreover, low-speed rolling to enable the leading and trailing ends of a steel sheet to move stably on the runout table, need only be applied to the portion corresponding to the leading end of the first coil of a steel sheet and another portion corresponding to the trailing end of the n-th steel sheet coil, therefore the other portions of the steel sheet can be rolled at a constant rolling speed, so that the rolling time required is shorter and the production efficiency is higher. In addition, at least n coils of steel sheet can be produced without requiring the special rolling procedures for the leading and trailing ends of a steel sheet, so no idle time arises, and accordingly the production efficiency is further improved.

When a long slab is rolled to produce a hot rolled steel sheet, there is a limit in the amount of reduction per pass with a conventional rolling method, therefore rolling with a plurality of passes is required normally. For this purpose, reverse rolling or tandem rolling may be employed, but both systems have the following problems when applied to the rolling of a long slab, so both systems cannot be applied in practice.

When a long slab is rough rolled by reverse rolling, the lengths of the facilities upstream and downstream of the rolling mill become extremely large, and when the material is rolled repeatedly by reverse rolling, the time that the material is cooled by air increases in proportion to the length of the long slab, therefore the heat retained in the material is dissipated, and this is a problem.

On the other hand, when a long slab is rough rolled by tandem rolling, the amount of heat in the material is dissipated to a less extent than during reverse rolling, and the material being tandem rolled is cooled less rapidly by air. However, in this method of tandem rolling, the equipment cost is higher because the number of rolling mills required is the same as the number of passes of rough rolling.

If a long slab is rough rolled, the length of the sheet bar produced is so long that the sheet bar cannot possibly fit into the section between the outlet of a group of rough rolling mills and the inlet of a group of finish rolling mills, therefore the bar must be rolled simultaneously by the finish rolling mills and the rough rolling mills in tandem. In this case, the rolling speed of the system depends on the speed at the outlet of the finish rolling mills, consequently the rough rolling mills on the upstream side must be operated at a low speed. For instance, if it is assumed that the thickness of the slab is 200 mm and the speed of the finish rolling mills at the outlet is 1,000 mpm, then the speed of the rough rolling mills at the inlet is 60 mpm when the thickness of the product is 3 mm, and 20 mpm for a product with a thickness of 1 mm, which are very low speeds for rough rolling. Also if it is assumed that the rough rolling mill in the upstream direction has a roll diameter of 1,200 mm and a reduction of 60 mm, then the time during which the rolls and the material are in contact is as long as 0.5 seconds or more, which is more than four times as long as with a conventional rolling system. The temperature of a slab is normally about 1,000 to 1,200° C., therefore the rough rolling rolls on the upstream side must withstand such high temperatures under a heavy load, and the materials currently used for the rolls cannot maintain normal surface conditions due to the effects of heat.

For the reasons described above, it is difficult to apply normal rolling methods (tandem rolling or reverse rolling) to rough rolling a long slab. Therefore, when a long slab is to be reduced and processed properly into a sheet bar it seems to be necessary that processing facilities should be equipped with a pressing means with the capability of pressing the slab with a great amount of reduction in one pass so that the slab can be reduced to a predetermined thickness with a small number of passes and that the means of pressing should be free from damage due to the effects of heat. When a material is pressed and reduced by a large amount, more processing heat is generated, so that the temperature drop of the material when it is made into a sheet bar can be less than with a normal rolling system.

Here, "large reduction" in practice means more than 30%, or preferably, more than 50% in the amount of reduction (thickness reduction ratio).

Meanwhile, according to the conventional technologies described previously (unexamined Japanese patent publications Nos. 106409, 1982, and 85305, 1984), a planetary mill or a roll cast mill are used as the means of reducing a slab by a large amount. When these means are used, however, the following problems appear, despite the advantage that the temperature drop during rough rolling can be reduced.

(1) Because a planetary mill or roll cast mill cannot grip material by itself, the material must be pushed in with pinch rolls at the inlet of the mill, but in the pinch rolls, the surface layers of the rolls cannot be free from heat damage, as in the case of the aforementioned tandem rolling rolls.

(2) A rolling system using a planetary mill or a roll cast mill may be similar to a forging system in terms of processing, however basically in these systems, rolls with small diameters repeatedly roll the material by small amounts. As a result, the lateral edges of the work after rolling are split into two portions which are known as V edges, and trimming the lateral edges is required at a later stage, which leads to the problem of a reduced yield.

(3) A planetary mill or roll cast mill has the structural limitation that the rolling speed cannot be varied greatly, so that when the mill is used as a tandem strip mill, production efficiency is low.

(4) A continuously cast slab may suffer from internal defects such as voids near the center of the plate thickness, however in a normal rough rolling process, the plate thickness is rather large compared to the length of the contact arc between the rolls and the material, so that the strains caused by pressing may not easily penetrate to the center of the plate thickness, and the internal defects may not disappear so easily. As a consequence, internal defects may still remain at the outlet of finishing mills. In this regard, with the above-mentioned planetary mill or roll cast mill, the length of the contact arc between the rolls and the material is extremely small, so the strains caused by rolling cannot penetrate to the center of the plate thickness, and penetration is more difficult than with normal rough rolling. Therefore, the probability that the internal defects will remain is much higher than for ordinary rough rolling.

As described above, there are various problems in using a planetary mill or roll cast mill as the means for reducing a slab by a large amount, and it is difficult to apply the mills in practice.

Under these circumstances, the inventors thought of using forging and processing, as new means of producing large reductions to replace the above-mentioned mills. By means of forging and processing, the plate thickness of a slab can be greatly reduced in one operation of compressing and forming without the restrictions associated with the aforementioned planetary and roll cast mills, and in addition, the following advantages are achieved when a long slab is reduced and processed.

(1) The means of forging and processing come in contact with and separate from a material repeatedly during processing, so the means come in contact with the material at a high temperature for a shorter time than in the case of rolling. Therefore, forging dies are free from damage caused by contact with a high-temperature slab.

(2) Because the slab is restrained by the dies from the top and bottom of the plate thickness, no V edges are produced at lateral edges, and instead the slab may be deformed as a single bulge. Consequently, the finished work need not be trimmed in the next process, resulting in a higher yield.

(3) A feature of forging and processing that is different from rolling, is that the hydrostatic component of the stress acting on a material is higher. Hence, internal defects present in the material may more easily disappear under pressure. In addition, a greater amount of reduction (reduction in thickness due to pressing and forming) can be achieved as described above, and the pressing strains are greater, which are more advantageous for compressing and eliminating internal defects. According to an experiment made by the inventors (FIG. 9), when a slab is pressed and formed by forging and processing in the direction of the plate thickness, internal defects can be eliminated satisfactorily if the forging reduction ratio (={[reduction in the plate thickness per pressing cycle]/[plate thickness before the pressing operation concerned]}×100) is greater than 30%, and substantially completely removed with a forging reduction ratio of 50% or more.

(4) Conditions for forging and processing can be optimized by adjusting the length of contact between the dies and the material, so that little heat is dissipated from the material to the dies, and additional heat is generated during processing. In addition, because large reductions can be used, much processing heat can be generated in one pass of pressing and forming.

Figure 8:
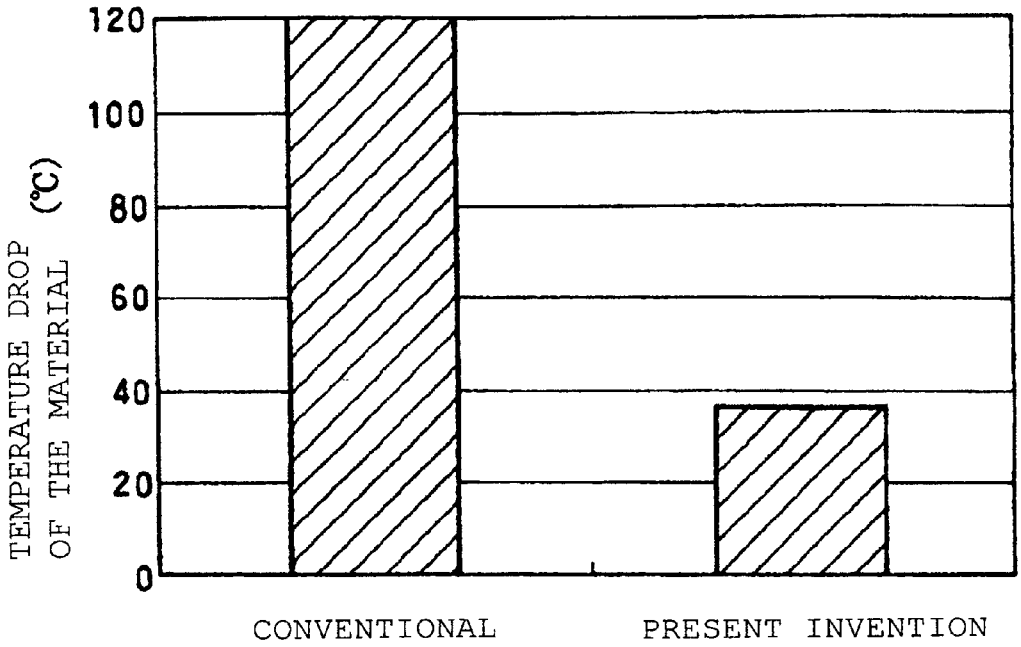
FIG. 8 is a chart comparing the drop in temperature of a material in a conventional rough rolling facility with that for a rough processing facility using forging equipment.

FIG. 8 shows a comparison of the temperature drops of a material during rough rolling using a conventional hot rolling line and rough processing using a forging apparatus as the means of reducing and processing, on the assumption that a slab with a thickness of 250 mm is reduced and processed to a sheet bar with a thickness of 30 mm. It can be understood from FIG. 8 that when forging and processing facilities are used as the means of rough processing, the temperature drop of the material can be reduced to about ⅓ of that when a conventional hot rolling line is used for rough rolling. Therefore, if the temperature of a slab at the inlet of the rough processing facilities is identical to that of a conventional hot rolling line, the temperature of the material at the inlet of the finish rolling mills is higher than for a conventional hot rolling line, so that the temperature of the material at the outlet of the finish rolling mills can easily be kept higher than the Ar3 point of the material.

As described above, the facilities according to the present invention are provided with the means of forging and processing at least as a part of the means for reducing and processing in the rough processing facilities. Thus, the rough processing facilities can be composed of either one or two or more means of forging and processing (forging equipment) that can reduce and process a hot slab with a large reduction ratio, or a combination of one or two or more means of forging and processing and other means of reducing the thickness and processing, for instance one or two or more rough rolling mills. The means of forging and processing uses processing dies for pressing (compressing and forming) a slab once or two or more times, so as to reduce its thickness and process the slab. However, there are no particular restrictions on the construction, mechanism, functions, etc. of the means.

A hot rolled steel sheet with a length corresponding to a plurality of coils of steel sheet cannot be reeled by an ordinary coiler, therefore according to the present invention, means for cutting the hot rolled steel sheet while it is traveling, are provided between a group of finish rolling mills and the coiler. Normally, the means of cutting is a flying shear machine.

The other facilities that configure the hot rolled steel sheet manufacturing apparatus according to the present invention can be composed of types used so far in the prior art, and after a hot slab has been reduced to a sheet bar, it does not need to be further reduced by a large amount, so a group of finish rolling mills, as used conventionally so far, can be used.

A sheet bar manufactured by reducing and processing a long slab is so long that it would be very difficult to accommodate it in the section between the outlet of the rough processing facilities and the inlet of a group of finish rolling mills. Consequently, rough processing and finish rolling must be carried out in tandem, and as a sheet bar after it has been reduced and processed by the rough processing facilities is thinner than a slab, the temperature of the bar soon decreases, therefore the time during which it is kept as a sheet bar should be as short as possible. As a result, the rough processing facilities should preferably be located nearer to the group of finish rolling mills than the mid-point between the outlet of the continuous casting facilities and the inlet of the group of finish rolling mills, and preferably, as near to the inlet of the finish rolling mills as possible.

When comparing the volumetric flow rates of the material at the outlet of the continuous casting facilities, outlet of the rough processing facilities, and outlet of the group of finish rolling mills to each other, the volumetric flow rate of the material at the outlet of the continuous casting facilities is normally the smallest. Therefore, the highest rolling speed can be attained by beginning to reduce and process the work in the rough processing facilities after a long slab has been cast and cut, and in this way the temperature drop of the material can be kept small. From this point of view, it is preferable that the means of cutting a slab is provided on the outlet side of the continuous casting facilities, a cast slab is cut into long slabs each of which corresponds to a plurality of coils of steel sheet, and each long slab is supplied to the rough processing facilities where the slab is reduced in thickness and processed.

To cast a long slab corresponding to n coils of steel sheet, takes about n times as long a time as the time for casting a slab with a normal length. Therefore, a furnace for heating a slab with a normal length is added to the installed facilities, and when a long slab is being cast, a reheated slab with a normal length is taken out of the heating furnace and supplied to the rough processing facilities. In this configuration, the time in which the rough processing facilities are not operating can be minimized, and the productivity of manufacturing hot rolled steel sheets can be increased further. Hence, it is desirable to install a heating furnace that can also supply the rough processing facilities with a reheated slab, in addition to an equipment line composed of the continuous casting facilities—rough processing facilities—group of finish rolling mills—coiler. Normally, the heating furnace is installed along the line between the continuous casting facilities and the rough processing facilities.

When a long slab corresponding to a plurality of coils of steel sheets is rolled into a steel sheet, slabs are held for a long time in the continuous casting facilities, and the times for rolling the slab and waiting are also long because of the long length of the slab, therefore compared to batch rolling, the temperature drop of the material during manufacturing a steel sheet is greater. From this viewpoint, it is preferable to install a heating facility to prevent the loss of heat from a material to be processed and/or a heating facility that can heat the material to be processed on-line, at least at one of the following locations (1) inside the continuous casting facilities, (2) between the continuous casting facilities and rough processing facilities, (3) inside the rough processing facilities, and (4) between the rough processing facilities and the group of finish rolling mills.

Next, the methods of manufacturing a hot rolled steel sheet according to the present invention using the hot rolled steel sheet manufacturing apparatus described above, are described below.

In the continuous casting facilities, a slab with a thickness of 100 mm or more is cast. Normally with continuous casting facilities, the production capability increases with the thickness of the slab, and to achieve a satisfactory production capacity, a slab thicker than 100 mm must be cast. If a slab is less than 100 mm, it can be easily processed to the thickness of a sheet bar without being processed with a large reduction by the rough processing facilities, so a large reduction process cannot be applied to reduce the thickness and process the work, therefore internal defects in the slab cannot be removed by such a large reduction process.

A hot slab, cast by the continuous casting facilities, is input into the rough processing facilities continuously without being cut (in this case, a long slab with a length corresponding to one charge of a converter is input continuously), or after the slab is cut into lengths each of which corresponds to a plurality of coils of steel sheet, using means of cutting a slab, each length of the slab is input into the rough processing facilities in which part or all of the means for reducing thickness and processing a slab are composed of means of forging and processing, in which each length of the slab is reduced in thickness and processed to produce a sheet bar.

Figure 9:
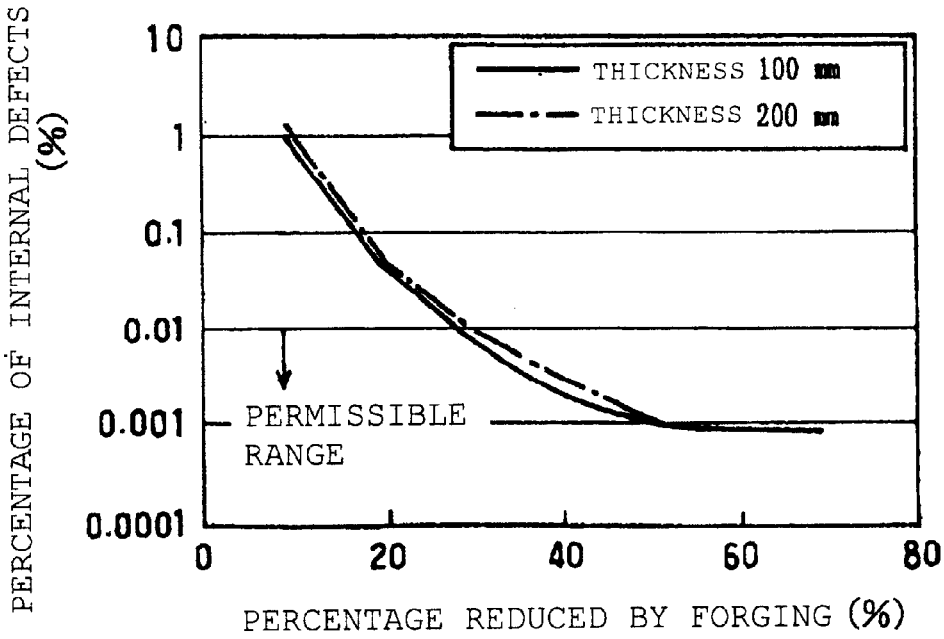
FIG. 9 is a graph showing the relationship between the percentage of internal defects in a sheet bar after pressing in a rough processing facility with a means of forging and the reduction ratio per pressing during forging.

The reduction ratio by forging during one pressing and forming operation by the means of forging and processing (={[the reduction of plate thickness in one cycle of press forming]/[plate thickness before the press forming concerned]}×100) should be 30% or more, or more preferably, 50% or more, thereby internal defects at the center of the plate thickness of the slab are eliminated substantially completely, so high-quality hot rolled steel sheets can be manufactured. FIG. 9 is a chart showing the relationship between the reduction ratios by forging during one pressing and forming operation with the means of forging and processing, and the probability of the presence of internal defects in the sheet bars; in FIG. 9, the probability of the occurrence of internal defects can be reduced to less than 0.01% by operating the facilities with forging reduction ratios of 30% or more during one pressing and forming operation, and with a forging reduction ratio of 50% or more, the probability of the presence of internal defects is about 0.001%, which means that internal defects are eliminated substantially completely.

The means of forging and processing can compress and form a hot slab in a free number of cycles, and normally one or two or more pressing and forming operations are carried out according to the preferred reduction in the thickness (when the rough processing facilities are provided with other means of processing to reduce the thickness, the preferred amount of reduction will be determined according to the amount of reduction by the other means of processing to reduce the thickness).

As described above, a hot long slab is reduced and processed by the rough processing facilities, into a sheet bar, and then the sheet bar is finish rolled to a predetermined plate thickness by a group of finish rolling mills, into a hot rolled steel sheet, which is reeled by the coiler to produce coils of hot rolled steel sheets. During this time, as the hot rolled steel sheet is reeled onto the coiler, the steel sheet is cut, while it is moving into the lengths required for each coil of steel sheet.

In the process of manufacturing the slab and the sheet bar as described above, the drop in temperature of the material during the process of manufacturing a steel sheet can be prevented by appropriately holding the temperatures of the slab and the sheet bar and/or heating them by means of heat retaining and/or heating devices provided at one location or 2 or more of the locations (1) through (4) as described above.

In the system in which a cast slab is cut into long slabs the length of each of which corresponds to a plurality of coils of steel sheets and each long slab is rough processed, another slab with an ordinary length is heated beforehand in a heating furnace, and after the rough processing facilities have finished reducing the thickness of and processing the preceding long slab and before the next long slab is supplied from the continuous casting equipment, the other slab that has been reheated in and taken from the heating furnace is supplied to the rough processing facilities, thereby a hot rolled steel sheet can be manufactured from this slab with an ordinary length. In this way of operating the rough processing facilities, the rough processing facilities can also be operated during the time that a long slab is being cast by appropriately combining the processing of a long slab directly fed from the continuous casting facility and an ordinary slab reheated in and supplied from the heating furnace to reduce their thicknesses and process the slabs, therefore the efficiency of production can be increased. This method can increase the efficiency of the combined production by as much as about 10%, compared to the case, for example, in which only long slabs sent directly from the continuous casting facility are reduced and processed in the rough processing facilities.

Figure 10:
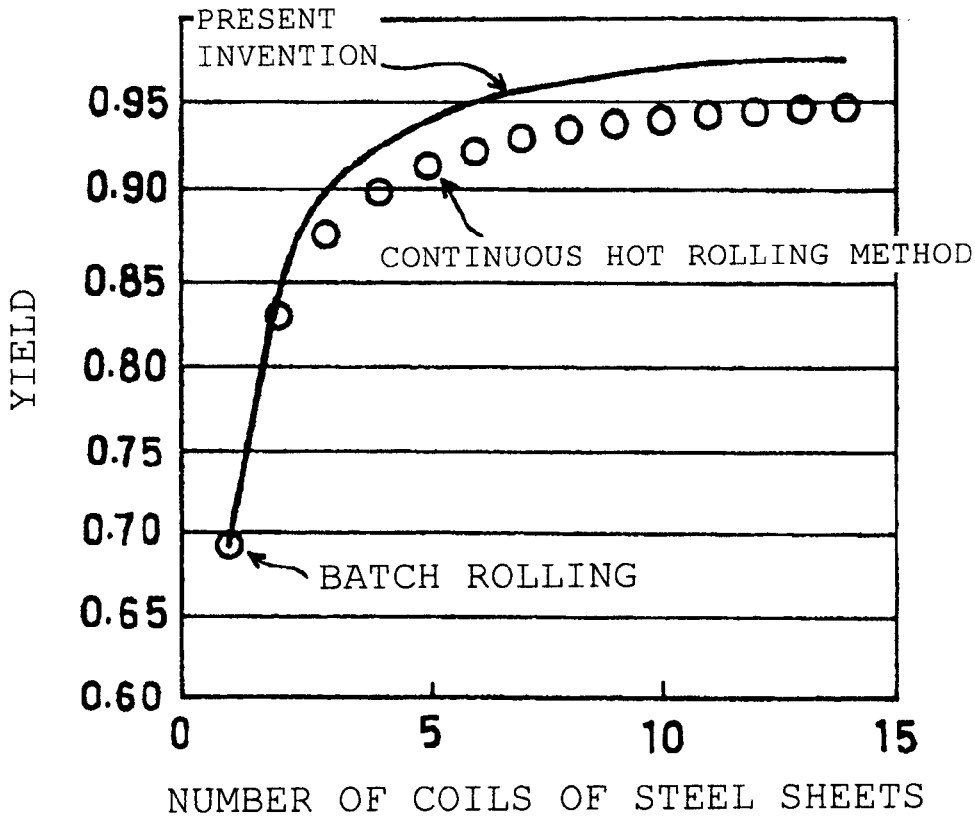
FIG. 10 compares the present invention to the prior art in terms of the number of coils of steel sheets and the yield of products manufactured.

FIG. 10 shows a comparison of the product yield as a function of the number of steel sheet coils between the method of manufacturing a hot rolled steel sheet according to the present invention and conventional methods of continuous heating and rolling and batch rolling; obviously, the method of manufacturing a hot rolled steel sheet according to the present invention provides higher yields than those of the conventional methods.

First Illustrative Embodiment

Figures 11A, 11B, 11C:
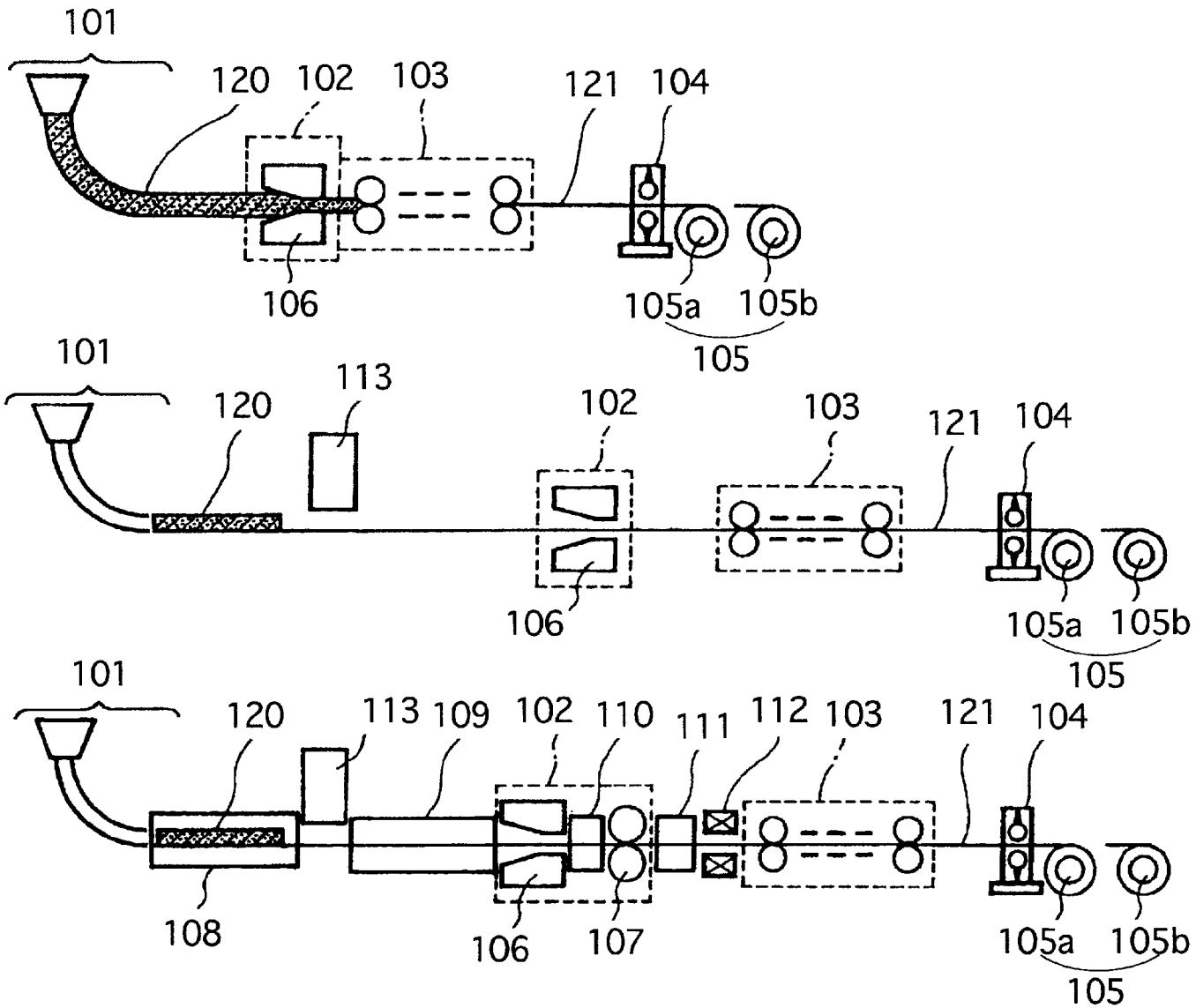
FIG. 11A is a schematic view showing the first illustrative embodiment of the hot rolled steel sheet manufacturing apparatus according to the present invention.
FIG. 11B shows the second illustrative embodiment of the same apparatus.
FIG. 11C is the third illustrative embodiment of the same.

FIGS. 11A through 11C show the first illustrative embodiment of the hot rolled steel sheet manufacturing apparatus according to the present invention and the process of manufacturing a hot rolled steel sheet using this apparatus.

In FIG. 11A, item numbers refer to the continuous casting facilities as 101, rough processing facilities as 102, a group of finish rolling mills as 103, a flying shear machine as 104, and coilers as 105*a* and 105*b*; in this embodiment, the rough processing facilities 102 are composed only of a plate reduction press machine 106. The hot rolled steel sheet manufacturing facilities of this embodiment can reduce the thickness of, process, and finish roll a hot, long slab cast in the continuous casting facilities 101, continuously without cutting the slab, to produce a hot rolled steel sheet.

In the hot rolled steel sheet manufacturing facilities shown in FIG. 11A, a long slab 120 cast in the continuous casting facilities 101 is supplied to the rough processing facilities 102 without being cut, and is forged in the direction of its thickness and processed by the plate reduction press machine 106 that constitutes the rough processing facilities 102, and the thickness of the slab is reduced to the thickness of a sheet bar which then continues to the group of finish rolling mills 103 in which it is rolled into a predetermined plate thickness to produce a hot rolled steel sheet 121, and the steel sheet is reeled by the coilers 105 into coils of steel sheets. During this process, the steel sheet 121 is reeled first by the coiler 105*a*, and when a predetermined length of the product coil has been reeled, the steel sheet 121 is cut by the flying shear machine 104 while it is moving, and then the steel sheet 121 following after the portion which has been cut off is reeled by the coiler 105*b*. When a predetermined length of the steel sheet has been reeled also by the coiler 105*b*, the steel sheet 121 is again cut by the flying shear machine 104, and the coiler used to reel the steel sheet 121 is switched from coiler 105*b* to coiler 105*a*, in the same way as described above.

Second Illustrative Embodiment

FIG. 11B shows the second illustrative embodiment of the present invention; the hot rolled steel sheet manufacturing apparatus of this embodiment is provided with a means for cutting a slab, not illustrated, at the outlet of the continuous casting facilities 101, and a cast slab is cut into predetermined lengths of long slabs (for instance, a slab with a length that corresponds to 3 or more coils of hot rolled steel sheets), and each cut long slab is reduced in thickness and processed to manufacture a hot rolled steel sheet, in a line of manufacturing facilities. In addition, a heating furnace 113 for heating a slab with an ordinary length is installed off the main line alongside the continuous casting facilities 101 and the rough processing facilities 102. The other equipment and facilities such as the continuous casting facilities 101, rough processing facilities 102, group of finish rolling mills 103, flying shear machine 104, and coilers 105*a*, 105*b* are arranged in the same configuration as for the embodiment shown in FIG. 11A.

In the hot rolled steel sheet manufacturing facilities shown in FIG. 11B, a slab cast by the continuous casting facilities 101 is cut into long slabs 120 the length of each of which corresponds, for instance, to 3 coils or more of hot rolled steel sheets, by a means of cutting the slab, and a hot rolled long slab 120 is forged and processed by the plate reduction press machine 106, which is a component of the rough processing facilities 102, and the thickness of the slab is reduced to the thickness of a sheet bar, and then the sheet bar passes continuously to the group of finish rolling mills 103 where it is rolled to a redetermined thickness to produce a hot rolled steel sheet 121 which is reeled by the coiler 105, as a coil of steel sheet. During this process, like the case shown in FIG. 11A, the steel sheet 121 is reeled first by the coiler 105*a*, and when a predetermined length of the product coil has been reeled, the flying shear machine 104 cuts the steel sheet 121 while it is moving, and the steel sheet 121 following after the portion which has been cut off is reeled by the coiler 105*b*. Also with the coiler 105*b*, as soon as a predetermined length of the product coil has been reeled, the steel sheet 121 is cut by the flying shear machine 104, and then the coiler used to reel the steel sheet 121 is changed from the coiler 105*b* to the coiler 105*a*, in the same way as above.

In addition, because it takes a considerable time to cast a long slab 120 in the continuous casting facilities 101, another slab with a normal length is heated beforehand by the heating furnace 113, and after the preceding long slab 120 has been processed completely in the rough processing facilities 102 and before the next long slab 120 is supplied from the continuous casting facilities 101 to the rough processing facilities 102, the reheated slab is taken from the heating furnace 113 and supplied to the rough processing facilities 102, and manufactured into a hot rolled steel sheet.

Third Illustrative Embodiment

FIG. 11C shows the third illustrative embodiment of the present invention; in the hot rolled steel sheet manufacturing facilities according to this illustrative embodiment, the means for reducing the thickness of and processing a slab in the rough processing facilities 102 are composed of the plate reduction press machine 106 on the upstream side and the rough rolling mill 107 on the downstream side; in addition, heat retaining facilities 108 are installed inside the continuous casting facilities 101 close to the outlet, heat retaining facilities 109 are placed between the continuous casting facilities 101 and the rough processing facilities 102, heat retaining facilities 110 are provided between the plate reduction press machine 106 and the rough rolling mill 107 in the rough processing facilities 102, and heat retaining facilities 111 are installed between the rough processing facilities 102 and the group of finish rolling mills 103; and furthermore, heating facilities 112 that can heat the ends and/or all the surfaces of a sheet bar are installed between the aforementioned heat retaining facilities 111 and the group of finish rolling mills 103. The other details of the configuration, such as the continuous casting facilities 101, rough processing facilities 102, group of finish rolling mills 103, flying shear machine 104, coilers 105*a*, 105*b*, heating furnace 113, and means of cutting a slab at the outlet of the continuous casting facilities are the same as those of the embodiments shown in FIGS. 11A and 11B.

Using the hot rolled steel sheet manufacturing facilities shown in FIG. 11C, a slab cast by the continuous casting facilities 101 is cut into long slabs 120 each of which for instance corresponds to 3 coils or more of hot rolled steel sheets, by the means for cutting a slab, and the hot rolled long slab 120 is sequentially forged, processed and rough rolled by the plate reduction press machine 106 and the rough rolling mill 107 that constitute the rough processing facilities 102, thereby the thickness of the bar is reduced to the thickness of a sheet bar, and then the sheet bar passes continuously to the group of finish rolling mills 103 where it is rolled to a predetermined thickness to produce a hot rolled steel sheet 121 which is reeled by coilers 105 as a coil of steel sheet. During this process, the method of reeling the steel sheet 121 is the same as that described above referring to FIGS. 11A and 11B.

In this illustrative embodiment shown in FIG. 11C, the above-mentioned heat retaining facilities 108, 109, 110 and 111 and the heating facilities 112 are installed to effectively prevent a drop in temperature of a material to be processed, consequently the temperature of a slab can be made low at the outlet of the continuous casting facilities 101, and the temperature of the work at the outlet of the finish rolling mills can be maintained at predetermined levels.

The above-mentioned heat retaining facilities 108 to 111 normally used are composed of heat retaining covers lined with ceramic fibers, metal foils, etc., and by using such heat retaining covers, the material to be processed can be effectively prevented from radiating heat. In addition, means for heating such as gas burners can also be provided inside the heat retaining facilities so that the means for heating provide heat to compensate for heat losses.

Although it might also be assumed that coil boxes etc. could be used as heat retaining facilities, it is difficult in practice to apply such coil boxes to the facilities according to the present invention. A coil box can accommodate a coil of material to be pressed, so a smaller amount of heat may be dissipated than when the material to be pressed is exposed on a table, therefore it may be an effective means for preventing a temperature drop in a material while it is waiting to be finish rolled. However, if a coil box of this type is applied to facilities according to the present invention, the coil box must be extremely large because a sheet bar with a length corresponding to a plurality of coils of steel sheets must be reeled in the coil box. Consequently, it is impossible to install such very large equipment in the facilities in practice.

As for the aforementioned heating facilities 112 for heating a material to be processed in an on-line process, various systems can be applied. In particular, as a means of heating the entire surface of a plate, an induction heating system is excellent because of its quick response, high heating efficiency and capability of heating without contact. Of the various induction heating systems, the solenoid-type induction heating device is especially preferable due to the uniformity of the temperature distribution during heating, low equipment cost, high heating efficiency in a practical range of plate thicknesses of a material to be processed, etc.

The inventors performed a trial calculation of the temperatures of a sheet bar at the outlet of a finish rolling mill when the heat retaining facilities 108, 109, 110, 111 and heating facilities 112 (solenoid-type induction heating system) were installed as shown in FIG. 11C, and the heating facilities 112 were used, when required, for supplementary heating of the sheet bar, and as a result, it was shown that the temperatures at the outlet of the finish rolling mill for all sizes of sheets can be made higher than with conventional systems (rolling using a conventional hot rolling line), by as much as about 20° C. This means that the temperature of a slab at the outlet of the continuous casting facilities can be made as much as 50 to 100° C. lower.

The plate reduction press machine 106 used in the embodiments shown in FIGS. 11A to 11C is shown with dies provided with surfaces that slope on the upstream side of the manufacturing line and surfaces that continue in a straight line on the downstream side thereof, and the machine that is presented is capable of pressing a slab once or two or more times (to reduce and form it) using the dies. However, the construction, functions, etc. of the plate reduction press apparatus are not limited only to these conditions, and its construction, functions, etc. are not essential as long as the facilities can compress, form, reduce the thickness of, and process a slab in the direction of the plate thickness as a forging system.

As can easily be understood from any of the embodiments shown in the above FIGS. 11A to 11C, the rough rolling facilities 102 can be configured by one or two or more means for reducing the thickness of a plate including a plate reduction press machine, and thus, the facilities can be composed of only one or two or more plate reduction press machines 106 or a combination of one or two or more plate reduction press machines 106 and other means for reducing and processing, such as one or two or more rough rolling mills 107. In the latter case, as shown in the embodiment in FIG. 11C for instance, the means for reducing and processing can be provided on the upstream side and/or the downstream side of the plate reduction press machine 106 in the manufacturing line.

In addition, means for adjusting the plate width of a material to be processed can also be provided in the rough processing facilities 102 or in the group of finish rolling mills 103. When the rough rolling facilities 101 are composed of the plate reduction press machine 106 located on the upstream side of the manufacturing line and the rough rolling mill 108 on the downstream side of the manufacturing line, a means of speed compensation can also be provided in the rough processing facilities 102 to compensate for speed differences between the plate reduction press machine 106 that forges (reduces and forms) a slab once or twice or more and the rough rolling mill 107 that rolls the work continuously.

According to the hot rolled steel sheet manufacturing apparatus according to the present invention as described above, a compact configuration of facilities can be used for manufacturing hot rolled steel sheets from a continuously cast hot slab with a length corresponding to a plurality of coils of steel sheets, with a high production efficiency and with a high quality without internal defects.

Furthermore, the production efficiency can also be increased by adding a heating furnace that can heat a slab with an ordinary length, to the row of the facilities, because by appropriately combining the thickness reduction and processing of a hot long slab sent directly from the continuous casting facility in the rough processing facilities and the thickness reduction and processing of a reheated slab supplied from the heating furnace, the rough processing facilities can also be operated during the time when a long slab is being cast.

Moreover, the cost of manufacturing a hot rolled steel sheet can be reduced from that of conventional systems, by providing means for heat retaining and/or heating of a material to be processed at appropriate locations in the hot rolled steel sheet manufacturing apparatus, because the temperature of the material at the outlet of the finish rolling mill can be maintained more easily and the temperature of a slab at the outlet of the continuous casting facilities can be made lower than those in conventional facilities.

Fourth Illustrative Embodiment

The hot rolled steel sheet manufacturing apparatus according to the present invention is provided with rough processing facilities that reduce the thickness of and process a hot slab into a sheet bar, and a group of finish rolling mills that roll the sheet bar manufactured in the aforementioned rough processing facilities, into a hot rolled steel sheet with a predetermined plate thickness.

When the inventors were creating the present invention, they studied methods of rough rolling with a view to effectively preventing the dissipation of the heat held in a hot slab when manufacturing a hot rolled steel sheet, and first a large-reduction rolling mill was used as a rough rolling mill and a method of rolling the work in one pass was employed to reduce the plate thickness with a reduction corresponding to that ordinarily produced by several passes of rough rolling.

Conventionally, a system using a planetary mill or a roll cast rolling mill is known in the prior art as a technology for hot rolling with a large reduction rolling mill. For example, according to the unexamined Japanese patent publication No. 106403, 1982, leading and trailing ends of a slab are joined to the trailing end of the preceding slab and the leading end of the following slab, respectively, and these joined slabs are continuously rolled by a hot rolled steel sheet manufacturing apparatus composed of a group of planetary mills and another group of finish rolling mills. In addition, the unexamined Japanese patent No. 106409, 1982 discloses a hot rolled steel sheet manufacturing apparatus in which a slab taken from a rotary caster is rolled continuously using a group of planetary mills and a finish rolling mill. In addition, the unexamined Japanese patent No. 85305, 1984 proposes a continuous hot rolling line in which a slab is extracted from a rotary caster, rolled by a roll cast rolling mill, and then rolled to a predetermined thickness by a group of finish rolling mills.

When any of these conventional large-reduction rolling systems using a planetary mill or a roll cast rolling mill known in the prior art are applied to rough rolling a slab, the advantages to be expected include (1) because the work rolls to be used are rather small in diameter, the contact lengths between the material and the work rolls are relatively short, so a small amount of heat is lost through the rolls, (2) because large-reduction pressing is employed, a small number of passes is required, and accordingly there is less cooling of the work between passes, and (3) on the other hand, more heat is generated during processing because of the large reduction in one pass. Therefore, there is the advantage that a smaller amount of heat is dissipated from the work material than during ordinary rough rolling.

However, it was shown that these means of rolling are accompanied with the following problems.

1. A planetary mill or a roll cast rolling mill cannot grip a material by itself. Consequently, the material must be pushed in using pinch rolls on the inlet side of the rolling mill. At that time, the material is, in fact, slightly rolled by the pinch rolls, but the amount of reduction is less than that of ordinary rough rolling. In addition, the speed of the material at the pinch rolls is low (this can be easily understood by taking into account the fact that the material at the inlet of a large reduction rolling mill is a slab with a large thickness, but it becomes a sheet bar with a small thickness at the outlet of the large-reduction rolling mill), therefore the material is in contact with the pinch rolls for a long time, so that a large amount of heat is dissipated from the material to the pinch rolls. Consequently, when the whole rough rolling line is considered, the heat dissipated from the material to the pinch rolls cancels the effect of reducing the drop in temperature of the material due to large-reduction rolling, hence the loss of heat from the hot slab cannot be avoided satisfactorily.

2. Although a rolling system with a planetary mill or roll cast mill might be a similar processing system as forging, basically small diameter rolls repeatedly press (roll) the work by a small amount. As a result, the lateral edges of the work after rolling are split into 2 fins called V edges, so both the lateral edges must be trimmed later, which adversely affects the yield.
3. The rolling speed of a planetary mill or roll cast mill cannot be easily changed because of structural restrictions, therefore when these mills are applied to a tandem strip mill, production efficiency is low.
4. With the planetary mill or roll cast mill, the length of the contact arc between the roll and the material is extremely short, consequently rolling strains cannot easily penetrate into the center of the plate thickness, to an even less degree than with an ordinary rough rolling system, so that the risk of internal defects remaining is still higher than for a conventional rough rolling system.

As described above, there are various problems in using a planetary mill or roll cast mill as a means of reducing the thickness of a slab by a large amount, and as a consequence, these mills cannot be used in practice.

Therefore, the inventors studied and investigated new means for reducing material with a large reduction to replace these means of rolling known in the prior art, and revealed as a result that a hot slab can be reduced and processed very effectively into a sheet bar by using means for forging and processing, and the following advantages can be provided in practice.

(1) In rolling, the attainable reduction is limited by the maximum permissible amount of reduction determined by the roll diameter, friction coefficient, etc., however in a forging process, there is no such limit, rather the plate thickness can be greatly reduced in one reducing and forming operation, and in addition, much processing heat can be generated during such a large reduction.

(2) In a forging process, the contact area between the processing means (dies) and the material can be adjusted more freely than in a rolling process using rolls, and as a consequence, it is possible to select conditions such that less heat is lost from the material to the means of processing and at the same time, more heat is generated during processing, so that the heat lost from the hot slab can be made smaller.

(3) One of the features of a forging process is that the hydrostatic component of the stress acting on the material is high, unlike in a rolling process. Consequently, internal defects existing in the material can be compressed more easily. In addition, because of the greater amount of reduction (the reduction in the plate thickness due to compressing and forming) possible as described above, larger pressing strains can be applied, and therefore forging is also more advantageous from the viewpoint of compressing internal defects. According to an experiment (FIG. 9) carried out by the inventors, when a slab was pressed and formed in the direction of its thickness by forging, internal defects could be decreased satisfactorily with a reduction ratio by forging in one pressing and forming operation (={[reduction of plate thickness by one pressing and forming operation]/[plate thickness before the pressing and forming operation concerned]}×100) of 30%, and could be removed substantially completely with a forging reduction ratio of more than 50%.

(4) Because the slab is constrained by the dies from the top and bottom of the plate thickness, no V edges are produced at the lateral edges, but the slab may rather be deformed into a single bulge. Consequently, no trimming is required in the next process, resulting in a higher yield.

FIG. 8 shows trial calculations of the temperature drop in the material of a slab with a thickness of 250 mm that is reduced and processed into a sheet bar with a thickness of 30 mm, using conventional rough rolling facilities in a hot rolling line known in the prior art, and the proposed rough processing facilities using forging equipment as the means of reducing and processing the plate thickness. It can be understood from FIG. 8, that the temperature drop in the material can be reduced to about ⅓ of that when the material is rough rolled in a conventional hot rolling line, by using the rough processing facilities provided with the means of forging and processing. In other words, compared to the case in which a conventional hot rolling line is used for rough rolling, the temperature for heating the slab can be reduced by about 50 to 75° C., therefore the temperature at the outlet of the finish rolling mill can be maintained much more easily than with the method known in the prior art.

Hence, in the facilities according to the present invention, means of forging and processing are provided at least as part of the means of reducing and processing the thickness of a plate that constitute the rough processing facilities. Thus, the rough processing facilities can be composed of only one or two or more means of forging and processing (forging equipment) that can reduce the thickness of and process a hot slab with a large amount of reduction, or can also be composed of a combination of one or two or more means of forging and processing and another means of reducing and processing a plate thickness, for example, one or two or more rough rolling mills. In. addition, the means of forging and processing uses dies for processing and reducing the plate thickness by pressing (compressing and forming) the slab once or twice or more, however the structure, mechanism, and functions, etc. thereof are not limited especially.

Furthermore, once the hot slab is manufactured into a sheet bar using the rough processing facilities, no further large reduction is required, so that a conventional group of finish rolling mills can be used as the subsequent facilities.

The configuration of the equipment upstream of the rough processing facilities is not restricted particularly, and normally a furnace for heating a slab is installed. However, other configurations of the equipment may also be applied, in which continuous casting equipment is provided on the upstream side of the rough processing facilities, and a slab continuously cast by the equipment can be supplied to the rough processing facilities as it is, that is, without reheating, or a continuously cast slab is slightly reheated and then supplied to the rough processing facilities.

The sheet bar, the plate thickness of which has been completely reduced and processed by the rough processing facilities, is thinner than the plate thickness of the slab, so the temperature of the sheet bar may decrease more rapidly, therefore the shorter the time it remains in the form of a sheet bar, the better. Consequently, it is preferred that the rough processing facilities are located as close to the inlet of the group of finish rolling mills as possible, and when continuous casting facilities are installed on the upstream side of the rough processing facilities, it is preferable that the rough processing facilities should be installed closer to the group of finish rolling mills than the mid-point between the outlet of the continuous casting facilities and the inlet of the group of finish rolling mills.

To prevent a decrease in the temperature of the material during processing, it is desirable to provide heat retaining facilities to reduce the loss of heat from the material to be processed, heating facilities capable of heating the material to be processed on-line, or facilities with both the functions of the aforementioned heat retaining and heating facilities, at least at one or two or more of the following locations (1) on the inlet side of the rough processing facilities, (2) in the rough processing facilities, or (3) between the rough processing facilities and the group of finish rolling mills.

Next, the method of manufacturing a hot rolled steel sheet according to the present invention is presented, using the hot rolled steel sheet manufacturing apparatus described above.

According to the method of the present invention, a hot rolled steel sheet is manufactured from a hot slab with a thickness of 100 mm or more. Normally, with a thicker slab, more hot rolled steel sheet can be manufactured, so a slab with a thickness of 100 mm or more must be used as the raw material to assure that a sufficient amount of a hot rolled steel sheet can be produced. A slab with a thickness of less than 100 mm can be made into a sheet bar as regards its thickness without the need to reduce the thickness by a large amount in rough processing facilities, therefore a large-reduction process for reducing and processing the plate thickness cannot be used, so that internal defects in the slab cannot be removed by a large-reduction process of this kind.

Normally, a hot slab taken from a heating furnace is put into rough processing facilities provided with means for forging and processing as part or all of the means for reducing and processing the plate thickness, in which the thickness of the slab is reduced and processed into the thickness of a sheet bar.

The reduction ratio by forging in one pressing and forming operation with the means of forging and processing (={[reduction of plate thickness by one pressing and forming operation]/[plate thickness before the pressing and forming operation concerned]}×100) should be 30% or more, or more preferably 50% or more, thereby most of the inner defects in the center part of the plate thickness of the slab are substantially eliminated, and a hot rolled steel sheet with a good quality can be manufactured. FIG. 9 shows the relationship between the percentage of internal defects remaining in a sheet bar and the forging reduction ratio in one pressing and forming operation with the forging means, and shows that the percentage of remaining internal defects can be reduced to 0.01% or less by making the forging reduction ratio of one pressing and forming operation 30% or more, and with a forging reduction ratio of 50% or more, the percentage of remaining internal defects is only about 0.001%, that is, the internal defects have disappeared substantially completely.

As a result of surveying. the percentage of defective products caused by internal defects in hot rolled steel sheet manufactured according to the present invention, as carried out by the inventors, the percentage of defective products was reduced by as much as about 5%, for a material with a plate thickness of 10 mm or more which normally has a particularly high percentage of defective products due to internal defects, compared to that of hot rolled steel sheets manufactured by a conventional hot rolling line.

The number of pressing and forming cycles carried out on a hot slab by the means of forging and processing can be freely selected, that is, pressing and forming can be carried out once or two or more times according to the required reduction in thickness (when the rough processing facilities are provided with another means of reducing and processing the plate thickness, the amount of reduction will be determined by taking into account the amount to be reduced in the above-mentioned other means of reducing and processing the plate thickness).

In the way described above, the thickness of the hot slab is reduced and processed by the rough processing facilities into a sheet bar, and the sheet bar is continuously passed to a group of finish rolling mills in which it is finish rolled to a predetermined thickness to produce a hot rolled steel sheet which is reeled by a coiler as a coil of hot rolled steel sheet.

In addition, decreases in the temperature of the material during the manufacturing process can be prevented by appropriately retaining the heat and/or heating the slab or the sheet bar using heat retaining and/or heating facilities installed at one or more of the locations at the aforementioned positions (1) to (3) in the manufacturing process of the slab and the sheet bar.

Figure 12:
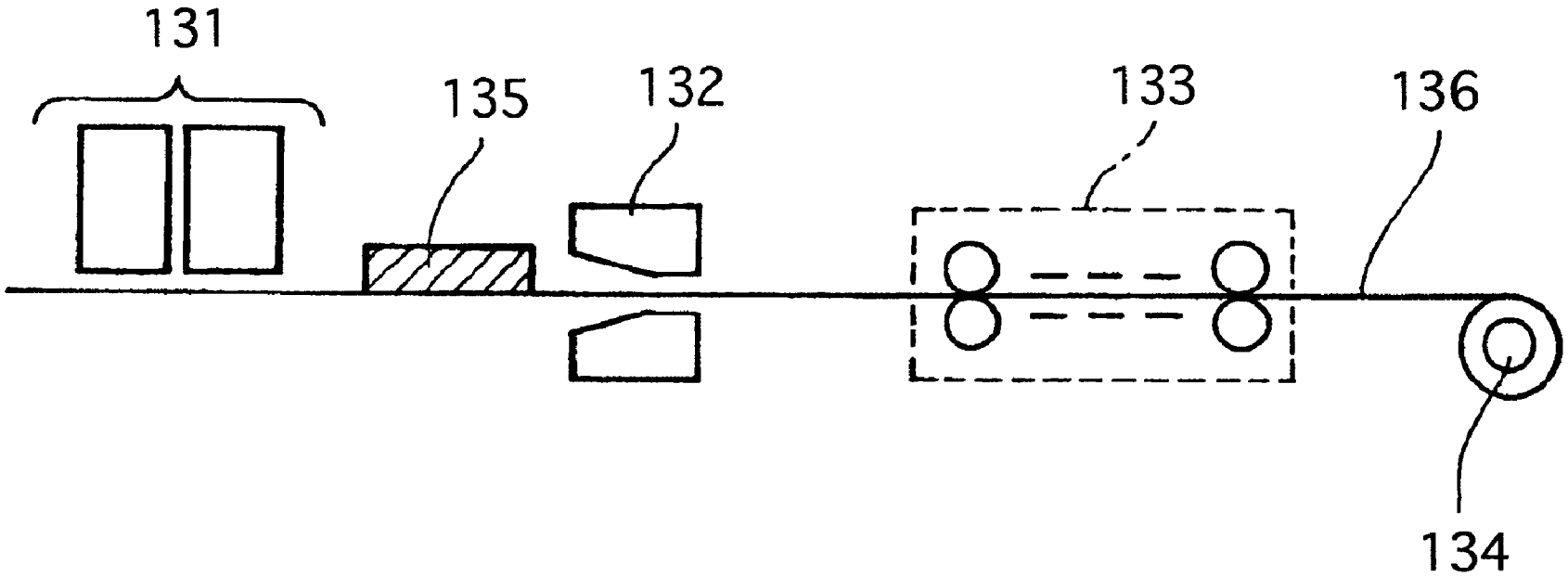
FIG. 12 shows the fourth illustrative embodiment of the hot rolled steel sheet manufacturing apparatus according to the present invention.

FIG. 12 shows an illustrative embodiment of the manufacturing process of a hot rolled steel sheet using the hot rolled steel sheet manufacturing apparatus according to the present invention. Item numbers in the figure refer to a heating furnace as 131, rough processing facilities as 132, a group of finish rolling mills as 133, and a down coiler as 134, in which the rough processing means 132 is composed only of a plate reduction press machine.

In the hot rolled steel sheet manufacturing apparatus shown in FIG. 12, a hot slab 135 heated in the heating furnace 131 is taken out and supplied to the rough processing facilities 132, and forged and processed by the plate reduction press machine, a component of the rough processing facilities 132, to reduce the thickness thereof into the thickness of a sheet bar, and the sheet bar is passed continuously to the group of finish rolling mills 133 where it is rolled to a predetermined plate thickness to produce a hot rolled steel sheet 136 that is then reeled in the down coiler 134, as a coil of steel sheet.

To maintain a satisfactory production efficiency with the apparatus according to the present invention, the rate at which the plate reduction press machine presses and the feed of the material must be controlled according to the amount to be produced by the apparatus.

The plate reduction press machine is provided with dies in which the surfaces of the dies in the upstream direction of the manufacturing line are inclined, and the surfaces of the dies continues in the downstream direction parallel to the manufacturing line, and using these dies, a slab is pressed (pressed and formed) once or two or more times. However, the structure, functions, etc. of the plate reduction press machine are not limited only to those of this example, but instead, the structure, and functions, etc. will not be specified as long as the forging facilities can reduce and process the thickness of a slab by compressing and forming the slab in the direction of the plate thickness.

In addition, as described earlier, the rough processing facilities 132 can be composed of one or two or more means of reducing and processing the plate thickness, including the plate reduction press machine, and thus, the facilities can be constituted of either one or two or more plate reduction press machines, or by a combination of one or two or more plate reduction press machines and another means of reducing and processing the plate thickness, for instance, one or two or more rough rolling mills. In the latter case, it is possible to install means of reducing and processing the plate thickness, such as rough rolling mills on the upstream and/or downstream sides of the plate reduction press machine, on the manufacturing line.

As described above, according to the hot rolled steel sheet manufacturing apparatus of the present invention, losses of heat from the hot slab can be effectively prevented during the processes of manufacturing a steel sheet, and moreover, a high quality, hot rolled steel sheet without internal defects etc. can be produced with a high production efficiency and yield.

Fifth Illustrative Embodiment

Figure 13:
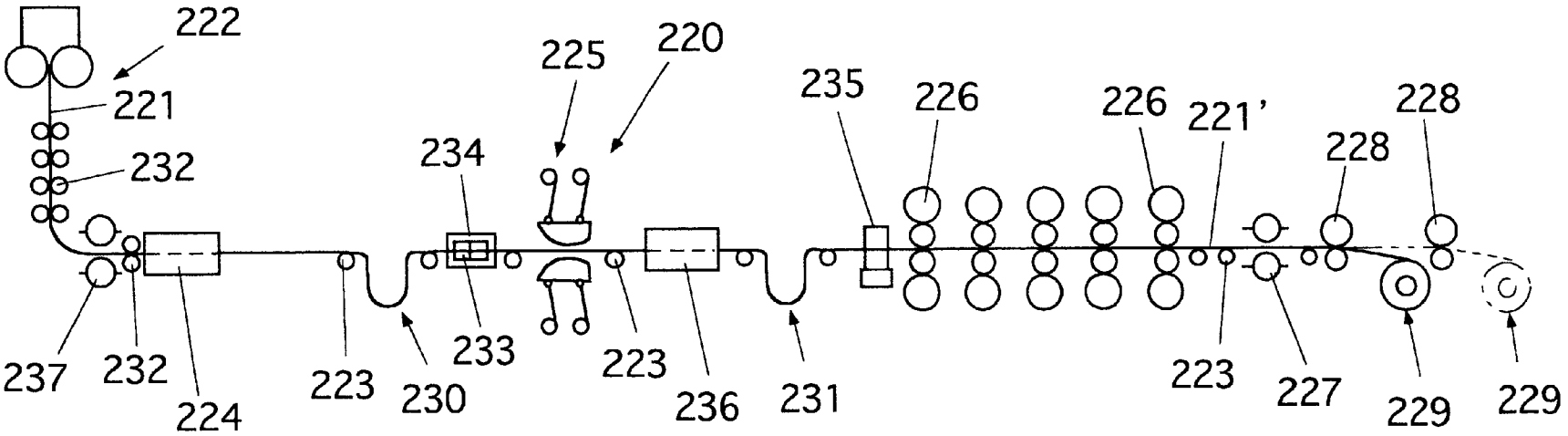
FIG. 13 shows the general configuration of the fifth illustrative embodiment of the hot rolled steel sheet manufacturing apparatus according to the present invention.

FIG. 13 is a general view of the configuration of the fifth illustrative embodiment of the hot rolled steel sheet manufacturing apparatus according to the present invention. The hot rolled steel sheet manufacturing equipment 220 of the present invention is composed of a continuous casting machine 222 (for instance, a double roll type with two cooling rolls) for continuously manufacturing a slab 221 with a thickness of 50 mm to 150 mm (so-called medium thickness) in thickness, table rollers 223 comprised of a plurality of drive rolls that convey the slab 221 along a rolling line, a slab temperature holding and heating furnace 224 for holding the temperature of and heating the slab 221 to a predetermined temperature while the slab is being conveyed on the manufacturing line, a plate reduction press machine 225 that continuously presses and highly reduces the slab 221 transferred from the slab temperature holding and heating furnace 224 while the slab is moving, to a plate thickness of about 20 mm, a plurality (5 mills in FIG. 13) of finish rolling mills 226 that continuously roll the slab 221 which is transferred from the plate reduction press machine 225 after being reduced in thickness by a large amount, into a thin sheet (for instance, a product with a thickness of 1 to 2 mm) of a rolled material 221', a shear machine (high-speed shear machine) 227 for cutting the rolled material 221', and a plurality (2 coilers in FIG. 13) of down coilers 229 that reel the rolled material 221' which is conveyed by the pinch rolls 228.

In this illustrative embodiment, the slab temperature holding and heating furnace 224 is a tunnel furnace, in which means of induction heating or gas heating, not illustrated, are provided on the ceiling and side surface of the furnace to heat and maintain the temperature of the slab, thereby the slab 221 manufactured by the continuous casting machine 222 and cooled as it is being conveyed to the pressing line is heated to a predetermined temperature quickly and easily, and the heat thereof is retained and the slab is conveyed to the downstream side, at an optimum temperature.

In FIG. 13, upstream and downstream loopers 230, 231 are installed on the manufacturing line on the upstream and downstream sides of the plate reduction press machine 225, to hold slack portions of the slab 221. The upstream looper 230 holds a slack portion of the slab 221, which allows for variations caused by differences between the transfer speed of the slab manufactured by the continuous casting machine 222 and continuously conveyed by the pinch rolls 232, and the speed of the plate reduction press machine 225 which reduces the slab by a large amount. Also in the same way, the downstream looper 231 holds a slack portion of the slab 221 which allows for variations caused by differences between the speed of the plate reduction press machine 225 and the pressing speed of the finish rolling mills 226.

In addition, a stentering press 234 is arranged in front of the plate reduction press machine 225, and is provided with a pair of stentering dies 233 which press the slab 221 in the direction of its width when the dies are moved towards and away from each other by means of a reciprocating driving device, not illustrated. Because the stentering press 234 presses the width of the slab while it is traveling like the flying press for which a patent has been applied for by the inventors of the present invention and is disclosed in the unexamined Japanese patent publication No. 165803, 1994 (Horizontally opposed type flying press and stentering press methods using the press), productivity is improved. Also, because of its capability for pressing work with a high reduction ratio, voids and air bubbles (center porosity) which would otherwise be created in the slab can be prevented. However, a conventional vertical rolling mill composed of vertical rolls can also be used in place of the stentering press machine although the amount of reduction of the width will be decreased. Consequently, the width of the slab can be corrected and controlled quickly and easily.

As shown in FIG. 13, an ordinary vertical rolling mill 235 composed of vertical rolls is arranged at the inlet of the finish rolling mills 226. The vertical rolling mill 235 prevents the production of "dog bones," so that a flat rolled material is produced.

At the inlet of the finish rolling mills 226, a tunnel furnace 236 is installed for heating and maintaining the temperature of the slab, using a means of induction heating or gas heating provided on the ceiling and/or the side surfaces, although not illustrated. Therefore, because the slab is heated and/or its temperature is maintained taking into consideration the temperature drop of the slab 221 which is expected to occur when it is retained later in the looper 231, the slab can be conveyed to the finish rolling mills 226 at an optimum temperature.

Furthermore, a shear machine 237 is installed between the continuous casting machine 222 and the tunnel furnace 224. The shear machine can quickly cut the slab 221 if the slab 221 must be stopped on the rolling line for some operational reason, although the slab 221 is normally conveyed continuously and efficiently.

Next, the method of continuously manufacturing a hot rolled steel sheet according to the present invention is described referring to FIG. 13. In FIG. 13, (1) the continuous casting machine 222 continuously manufactures a medium-thickness slab 221 of 50 mm to 150 mm, (2) next, the slab 221 is conveyed along the rolling line by the pinch rolls 232, while its temperature is maintained and it is heated to a predetermined temperature in the tunnel furnace 224, (3) then, the slab is transferred from the tunnel furnace 224 to the table rollers 223, and while a slack portion is retained in the first looper 230 to allow for variations, the width of the slab 221 is pressed to a predetermined plate width by the stentering press 234, and thereafter the thickness of the slab 221 is reduced to about 20 mm by the plate reduction press machine 225, (4) next, after the slab is conveyed out of the plate reduction press machine 225 and a slack portion is retained in the second looper 231 to allow for variations, the slab 221 the plate width of which was reduced to a predetermined value by the vertical rolling mill 235 is rolled continuously to a final thickness of 0.8 mm to 1.0 mm, i.e., to produce an extremely thin strip, by a plurality of the finish rolling mills 226, (5) and after that, the rolled material 221' is cut into predetermined lengths by the high-speed shear machine 227, conveyed by the pinch rolls 228, and alternately reeled onto a plurality of down coilers 229, thus forming the product coils.

Hence, as the plate reduction press machine 225 is used on the upstream side of the rolling line for pressing the plate thickness of the slab with a high reduction ratio, instead of a plurality of rough rolling mills, a high-quality, extremely thin steel strip can be manufactured quickly and easily, and the rolling line is also shortened. In addition, the slab is conveyed continuously and processed by the rolling mills only once, instead of processing it many times, which is often accompanied by the problem of missing a trailing end in the prior art, and moreover, rough rolling mills are no longer needed, so that productivity can be improved. The cost of the equipment can also be reduced.

According to the method of the present invention, in the case of the aforementioned line (called A line for short in the following paragraphs) alone, all of the following or a combination of any of the following methods are employed:

a. The method of manufacturing coils, in which a material is continuous from the continuous casting facilities to the coilers, and is cut into several coils before the coilers, b. the method of manufacturing coils, in which a slab with a length corresponding to several coils is cut by a cutting machine at the outlet of the continuous casting facilities, rolled continuously, and cut before the coilers, and c. the method of manufacturing coils, in which a slab for one coil is cut by the cutting machine at the outlet of continuous casting facilities, and slabs are rolled and reeled coil by coil.

Sixth Illustrative Embodiment

Figure 14:
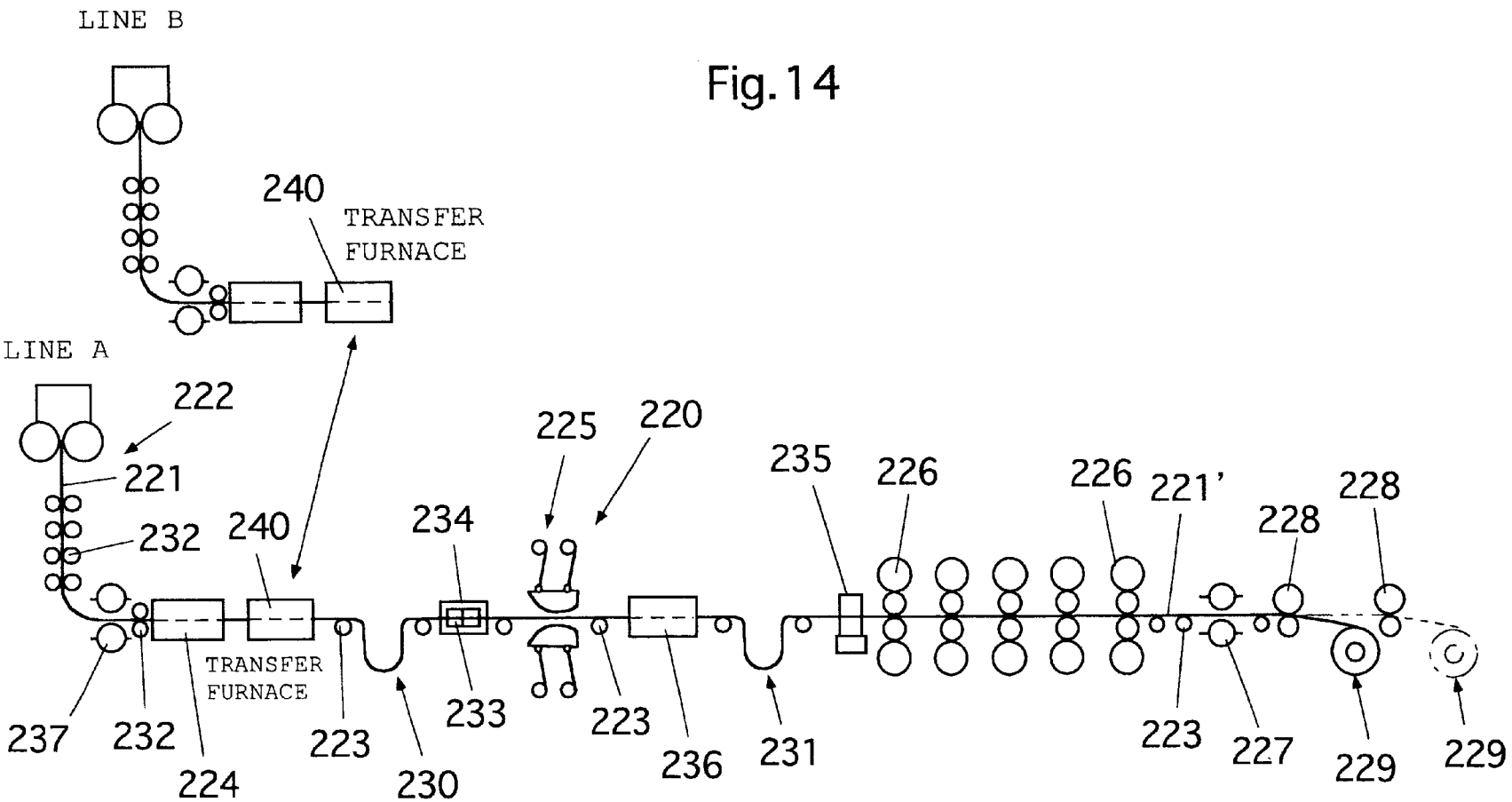
FIG. 14 shows the general configuration of the sixth illustrative embodiment of the hot rolled steel sheet manufacturing apparatus according to the present invention.

FIG. 14 is a view showing the general configuration of the sixth illustrative embodiment of the hot rolled steel sheet manufacturing apparatus according to the present invention. In FIG. 14, a B line composed of another continuous casting facility and heating furnace (a tunnel furnace or a walking beam furnace) is provided alongside the continues casting facilities and the heating furnace in the A line shown in FIG. 13. In addition, a temperature holding and heating furnace 240 is provided to transfer a slab from the B line to the A line. This temperature holding and heating furnace 240 can transfer a slab for one coil or a plurality of coils.

According to the method of the present invention as shown in FIG. 14 where there are A and B lines, the methods a, b and c as described above for the A line and the methods b and c of the B line are combined, so that slabs taken from the A and B lines can be rolled alternately.

As described above, according to the methods and apparatus for manufacturing a continuous hot rolled steel sheet of the present invention, a plate reduction press machine is used in place of rough rolling mills, and the length of the rolling line is reduced, therefore the cost of the entire facilities can be greatly reduced, and the number of times in which slabs are passed idly and the trailing ends of slabs are passed can also be reduced, hence the potential for mistakes can be eliminated, and because a slab can be conveyed to the finish rolling mills while being kept at a high temperature, the apparatus provides various advantages such as a higher yield, higher accuracy of rolled material, and the capability of manufacturing very thin, rolled material.

Seventh Illustrative Embodiment

Figure 15:
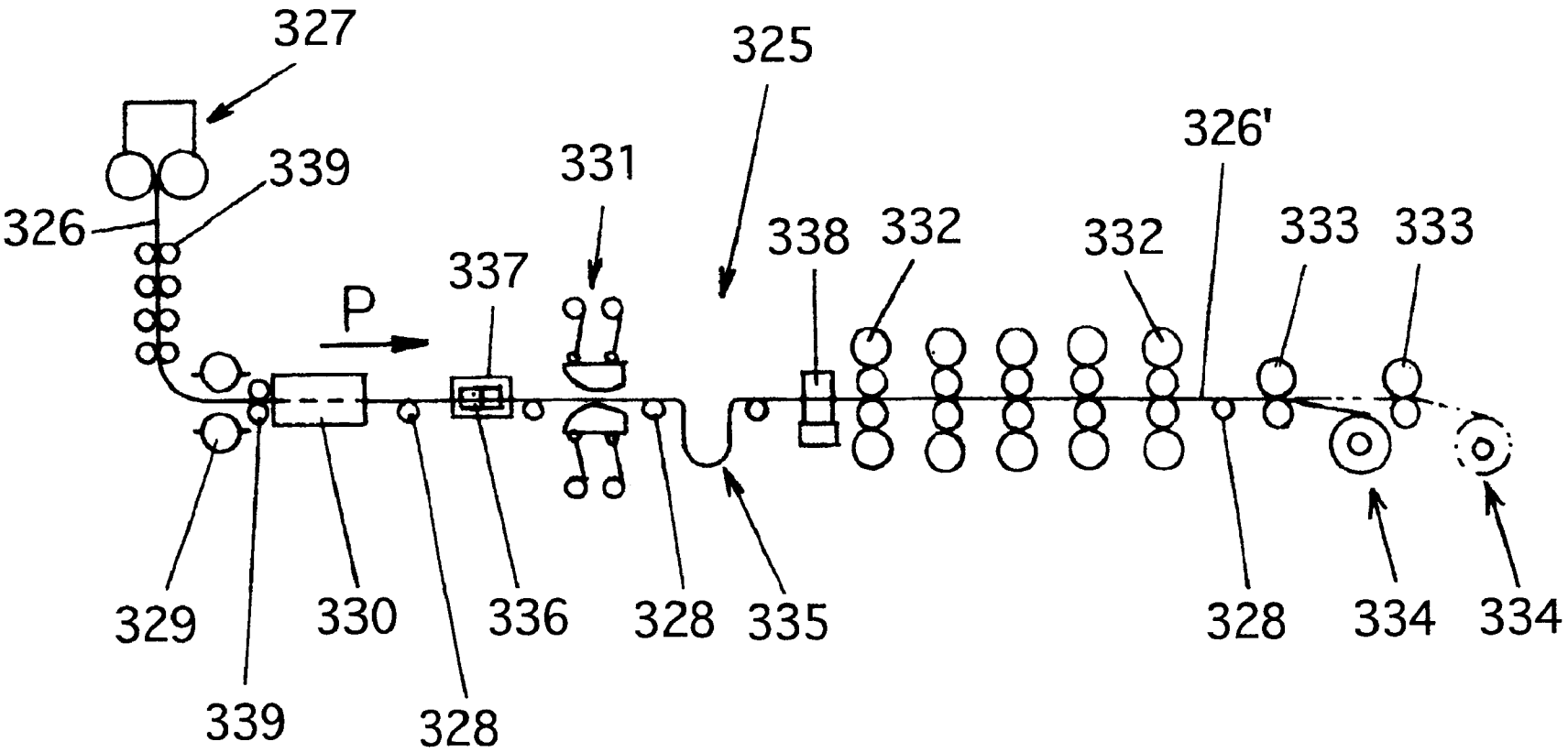
FIG. 15 shows the general configuration of the seventh illustrative embodiment of the hot rolled steel sheet manufacturing apparatus according to the present invention.

FIG. 15 is a view showing the general configuration of the seventh illustrative embodiment of the hot rolled steel sheet manufacturing apparatus according to the present invention. In FIG. 15, the hot rolled steel sheet manufacturing apparatus 325 according to the present invention is provided with a continuous casting machine 327 (for example, a double roll type provided with two cooling rolls) for continuously manufacturing a slab 326 of about 50 mm to 150 mm in plate thickness (so-called medium thickness), table rollers 328 comprised of a plurality of drive rolls that carry and transfer the slab 326 along a rolling line P, a shear machine 329 that is installed at the outlet of the continuous casting machine 327 and cuts the slab 326 into predetermined lengths corresponding to the rolled material 326' for one coil, a slab temperature holding and heating furnace 330 for holding the temperature of and heating the slab 326 as it is conveyed on the rolling line P, a plate reduction press machine 331 that continuously reduces by a large amount the thickness of the slab 326 transferred from the slab temperature holding and heating furnace 330 to a plate thickness of about 20 mm while the slab is traveling, a plurality (5 units in FIG. 15) of finish rolling mills 332 that roll the slab 326 highly pressed by and transferred from the plate reduction press machine 331 into a thin strip of rolled material 326' (for instance, a product with a thickness of 1 mm to 2 mm), and coilers 334 that reel the rolled material 326' for one coil, that has been rolled by and transferred from the finish rolling mills 332, coil by coil.

The slab temperature holding and heating furnace 330 is a tunnel furnace in this embodiment, in which a means, not illustrated, of induction heating or gas heating is installed on the ceiling or side walls of the tunnel furnace and heats and holds the temperature of the slab, that is, the slab 326 that was manufactured by the continuous casting machine 327, cut into lengths corresponding to coils by the shear machine 329, and was cooled while it was being conveyed on the rolling line P, so that it can be quickly and easily heated to a predetermined temperature, and/or its temperature is held at such a temperature, and transferred to the downstream side at an optimum temperature.

In FIG. 15, a looper 335 is installed between the plate reduction press machine 331 and the finish rolling mills 332, for retaining a slack portion of the slab 326, to allow for differences between the speed of the plate reduction press machine 331 and the rolling speed of the finish rolling mills 332.

Also a stentering press 337 is installed on the upstream side of the plate reduction press machine 331, which is provided with a pair of stentering press dies 336 that can move towards and away from each other when driven by a reciprocating device, not illustrated, placed on each side of the rolling line P, for pressing the slab 326 in the direction of the plate width. The stentering press 337 functions, for instance, like the flying press machine invented by the inventors of the present invention, for which a patent was applied for, and which was disclosed in the unexamined Japanese patent publication No. 165803, 1994 (Flying horizontally opposed press machine and stentering pressing methods using the press machine), that is, the apparatus presses the width of a slab while moving like a flying press machine, so productivity is increased. In addition, a large amount of reduction can be attained with the apparatus, therefore voids and air bubbles (center porosity) created inside the slab can be removed. An ordinary vertical rolling mill with vertical rolls can also be used instead of the stentering press machine, although the amount of stentering reduction will be smaller. As a result, the slab can be corrected and controlled in the direction of the plate width, quickly and easily.

As shown in FIG. 15, a conventional vertical rolling mill 338 comprised of vertical rolls is arranged at the inlet of the finish rolling mills 332. The vertical rolling mill 338 can prevent the occurrence of "dog bones" and a rolled material with a good shape can be manufactured.

At the outlet of the continuous casting machine 327, a shear machine 329 is installed for cutting the slab 326 into predetermined lengths each of which can be reeled as one coil of rolled material 326. According to the present invention, the slab is cut into lengths such that they can be reeled as one coil of rolled material 326' in a batch system at the outlet of the continuous casting machine 327, and then transferred. Therefore, the rolling line P can be shortened.

Next, the method of manufacturing a hot rolled steel sheet according to the present invention is described by referring to FIG. 15. The method of the present invention is divided into the following steps.

(1) First, a medium-thickness slab 326 of about 50 mm to 150 mm is manufactured continuously by the continuous casting machine 327.

(2) Next, as the second step, the shear machine 329 installed at the outlet of the continuous casting machine 327 cuts the slab 326 into predetermined lengths each of which can be reeled as one coil of rolled material 326', in a batch system.

(3) Then, the slab 326 is heated to and held at a predetermined temperature in the tunnel furnace 330, i.e. the slab temperature holding and heating furnace, while the slab 326 is being conveyed along the rolling line P by means of the pinch rolls 339.

(4) After that, the slab 326 is transferred from the tunnel furnace 330 onto the table rollers 328 and pressed by the stentering press machine 337 to a predetermined plate width, and is then pressed by a large amount by the plate reduction press machine 331 to a plate thickness of about 20 mm.

(5) Next, the slab 326 is conveyed from the plate reduction press machine 331 and a slack portion of it is retained in the looper 335 to allow for speed variations, the width of the slab is reduced by the vertical rolling mill 338, and then the slab is continuously rolled by a plurality of finish rolling mills 332 to a final thickness of 0.8 mm to 1.0 mm, to produce one coil of an extremely thin rolled material 326'.

(6) The rolled material 326' corresponding to one coil, is transferred by the pinch rolls 333, and is reeled by a plurality of down coilers 334, coil by coil.

Consequently, because the plate reduction press machine 331 that can press the slab by a large amount in the direction of the plate thickness is used on the upstream side of the rolling line P, in place of a plurality of rough rolling mills, a high-quality, very thin steel strip can be manufactured quickly and easily, and at the same time the rolling line can be shortened. In addition, a slab with a thickness of about 20 mm can be conveyed to the finish rolling mills at a high temperature, as a result of using the plate reduction press machine, and so the amount of heat used for heating the slab can be reduced, thus conserving energy. In addition, the slab can be formed and reduced easily and quickly because the slab manufactured by the continuous casting machine that has been cut into lengths each of which corresponds to one coil, can be conveyed to the plate reduction press machine at a suitable predetermined temperature because it has been heated and held at that temperature in the slab temperature holding and heating furnace. Furthermore, the length of the rolling line can be reduced due to the use of the plate reduction press machine and a batch-type slab for one coil. Also because reverse rolling is not required, and the material can be rolled in one direction, the slab has to pass through a rolling mill only once, so problems which often occur when an operation is performed a number of times such as those that often occur when the trailing end of the slab is passed through a mill, can be reduced. The cost of the equipment can also be reduced.

Eighth Illustrative Embodiment

Figure 16:
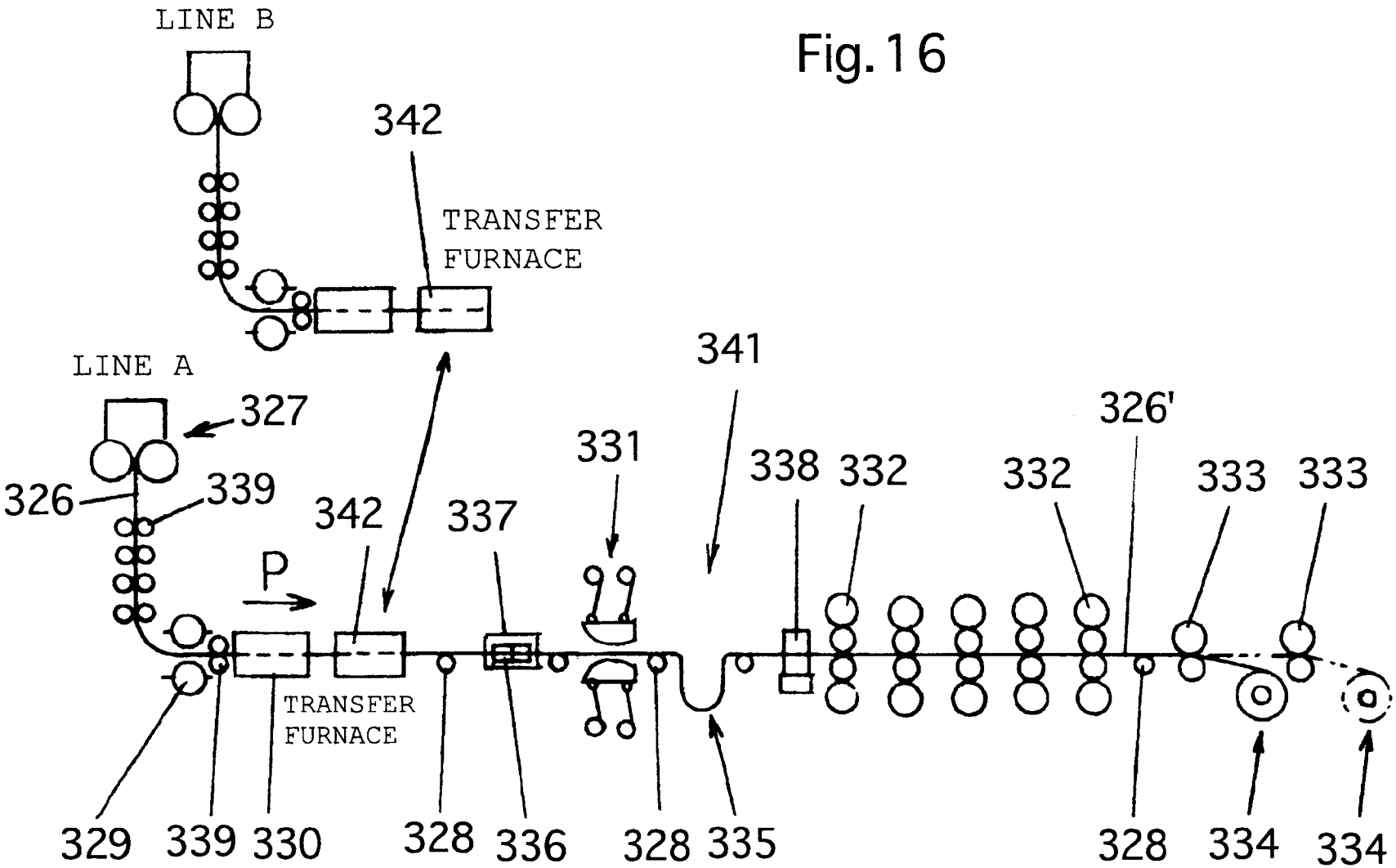
FIG. 16 shows the general configuration of the eighth illustrative embodiment of the hot rolled steel sheet manufacturing apparatus according to the present invention.

FIG. 16 is a general layout showing the eighth illustrative embodiment of the hot rolled steel sheet manufacturing apparatus according to the present invention. This hot rolled steel sheet manufacturing apparatus 341, as shown in FIG. 16, is provided with a continuous casting line from the continuous casting machine 327 to the slab temperature holding and heating furnace 330 shown in FIG. 15 (to be called A line for short), and beside the A line, a continuous casting B line composed of another line of facilities from the continuous casting machine to the slab temperature holding and heating furnace (tunnel furnace or walking beam furnace). In addition, a holding and heating furnace 342 is also provided for transferring a slab on the B line to the A line. The holding and heating furnace 342 can transfer a slab for one coil in a batch system.

According to the method of the present invention, as shown in FIG. 16, medium-thickness slabs, each of which is cut so that it can be reeled by the coiler into one coil in a batch system and output alternately from the A and B lines, can be supplied efficiently in sequence, therefore the productivity of the rolled material can be improved.

Ninth Illustrative Embodiment

Figure 17:
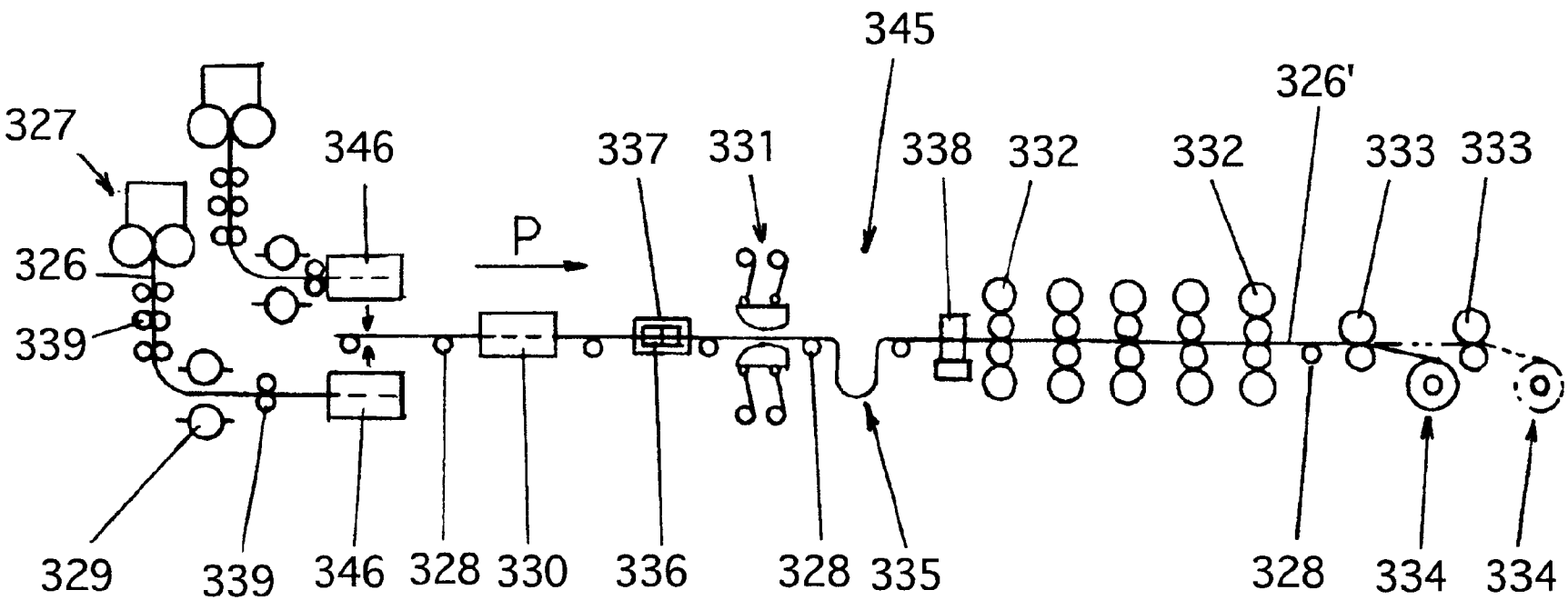
FIG. 17 shows the general configuration of the ninth illustrative embodiment of the hot rolled steel sheet manufacturing apparatus according to the present invention.

FIG. 17 shows the general configuration of the ninth illustrative embodiment based on the hot rolled steel sheet manufacturing apparatus according to the present invention. The hot rolled steel sheet manufacturing apparatus 345 is provided with a stentering press machine 337 that presses the width of a slab 326 transferred downstream from the slab holding and heating furnace 330, a plate reduction press machine 331 that continuously presses the thickness of the slab 326 by a large amount to about 20 mm while the slab is being conveyed and moving, a looper 335 that retains a slack portion of the slab, a vertical rolling mill 338 that is arranged at the inlet of the finishing mills and presses the width of the slab, a plurality of finish rolling mills 338 which continuously roll the slab into a rolled material 326' with the thickness of the finished product (0.8 mm to 1.0 mm), and a plurality of coilers 334 that reel the rolled materials each of which corresponds to one coil, and this arrangement of a series of facilities is defined as the rolling line P. On the upstream side of the aforementioned slab holding and heating furnace 330 in the rolling line P, there are a plurality of continuous casting machines 327 installed alongside of each other for manufacturing slabs with a plate thickness of about 50 mm to 150 mm, shear machines 329 installed at the outlet of each continuous casting machine 327 for cutting the slab 326 into a predetermined length that can be reeled into one coil of rolled material 326' in a batch system, a walking beam type heating furnace 346, and pinch rolls 339 that convey the cut slab 326 to the walking beam type heating furnace 346. Therefore, slabs which have been cut into lengths each of which corresponds to one coil in a batch system can be conveyed alternately onto the rolling line P from the respective walking beam type heating furnaces.

According to this method of the present invention, when a plurality of walking beam type heating furnaces shown in FIG. 17 are provided, slabs output from the walking beam type heating furnaces are transferred sequentially to the rolling line, and after being pressed in the direction of the plate thickness, each slab is rolled, and the rolled material for a coil can be reeled coil by coil, in this way a plurality of walking beam type heating furnaces can supply medium-thickness slabs in a batch system onto the rolling line, coil by coil, so that the productivity of rolling a material can be improved.

According to the hot rolled steel sheet manufacturing method and apparatus of the present invention as described above, the plate reduction press machine is used in place of a rough rolling mill, and the rolling line is made shorter, therefore the overall cost of the equipment can be greatly reduced, and because slabs cut for one coil in a batch system are used, the length of the rolling line can be further reduced, and there is a reduction in the number of operation cycles in which a slab is passed idly and the trailing end of a slab is passed, so that the occurrence of problems can be reduced, and because of the use of the plate reduction press machine, the temperature to which a slab is heated can be decreased resulting in the conservation of energy, and due to the capability of maintaining a slab at a high temperature while it is being transferred to the finish rolling mills, the yield can be improved and, at the same time, rolled material can be produced with high accuracy and an extremely thin rolled material can also be manufactured, which provides excellent practical advantages.

Tenth Illustrative Embodiment

Figure 18:
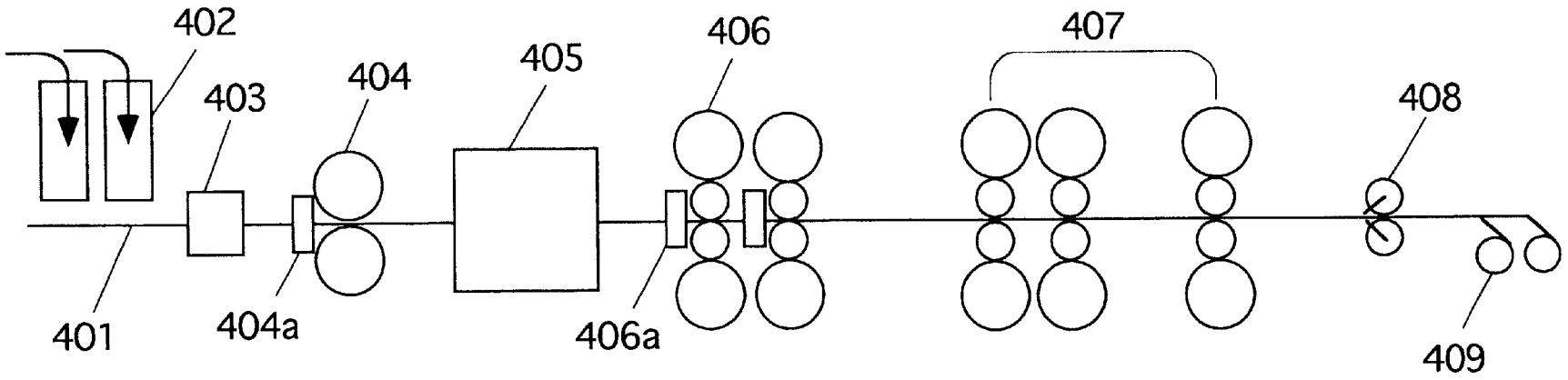
FIG. 18 shows the tenth illustrative embodiment of the hot rolled steel sheet manufacturing apparatus according to the present invention.

FIG. 18 shows the layout of the tenth illustrative embodiment of the hot rolled steel sheet manufacturing apparatus according to the present invention. A material 401 to be rolled enters the system from the left side of the figure, and flows towards the right side. Slabs which are to be rolled are classified as ordinary slabs with a maximum length of about 12 m, and long slabs continuously cast with a maximum length of about 100 m. An ordinary slab is input to a heating furnace 402 in the route shown by the arrow that turns downwards, and after being heated there, the slab enters the rolling line. At the outlet of the heating furnace 402, a stentering press machine 403 is installed which presses the slab to a preferred plate width while it is being conveyed. The stentering press machine 403 can press the lateral edges by an amount of reduction of approximately 0 mm to 300 mm , however the press machine can also press the work with a further large amount of reduction. A first roughing mill 404 is provided at the outlet of the stentering press machine 403. The first roughing mill 404 is provided with width sizing rolls 404*a* that press a slab, by about 0 mm to 50 mm on each side, with vertical rolls as it enters the inlet of the mill 404.

A plate reduction press machine 405 is installed at the outlet of the first roughing mill 404, and reduces the thickness of the slab by a large amount as the slab is being conveyed. A second roughing mill 406 is installed at the outlet of the plate reduction press machine 405. Although the figure shows a case in which there are two mills, the number of rolling mills is determined by the thickness of the slab to be rolled. At the inlet of each of the second roughing mills 406, stentering sizing rolls 406*a* are installed. The first and second roughing mills 404, 406 can also be provided with a reversing function. There are a plurality, normally 5 to 7, of finishing mills 407 arranged at the outlet of the second roughing mills 406. A flying shear machine 408 is installed at the outlet of the finishing mills 407, for cutting the rolled material 401, at the outlet of which coilers 409 are provided for reeling the rolled material 401 into coils. Two coilers 409 are installed for alternate reeling.

Figure 19:
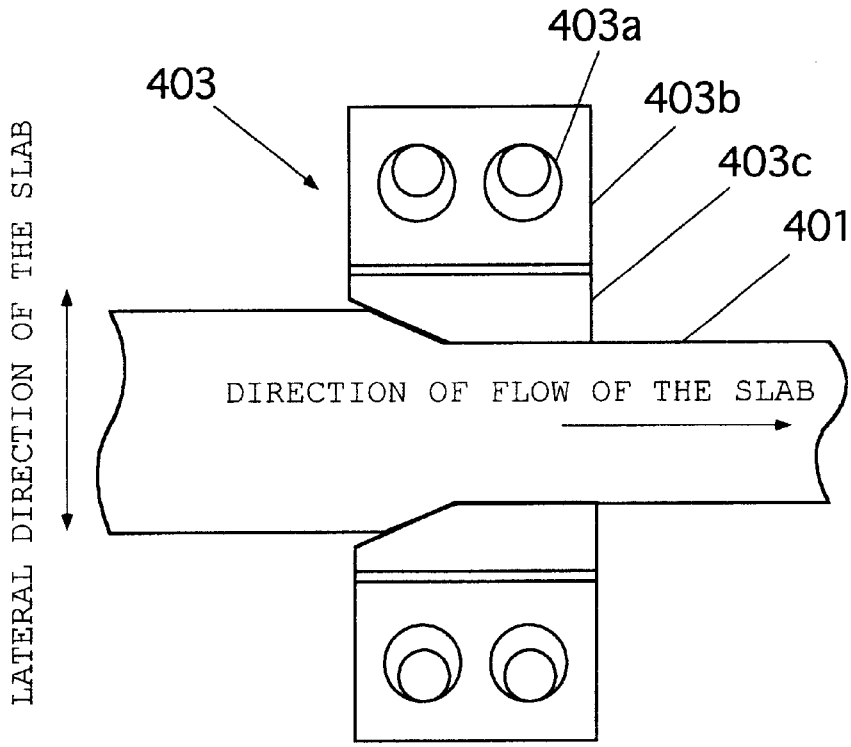
FIG. 19 shows an example of a stentering press machine.

FIG. 19 is a plan view showing an example of the stentering press machine 403. The stentering press machine 403 is provided with cranks 403*a* rotating eccentrically, heavy sliders 403*b* that are moved both in the left and right lateral directions and also forwards and backwards in the longitudinal direction of the flow of the slab, by means of this eccentricity, and dies 403*c* mounted on the sliders 403*b*. The width of the slab is reduced when the sliders 403*b* move to the left and right, however by moving the sliders in the direction of flow of the slab during pressing, the slab can be pressed continuously as it is being transferred without stopping the slab.

Figure 20:
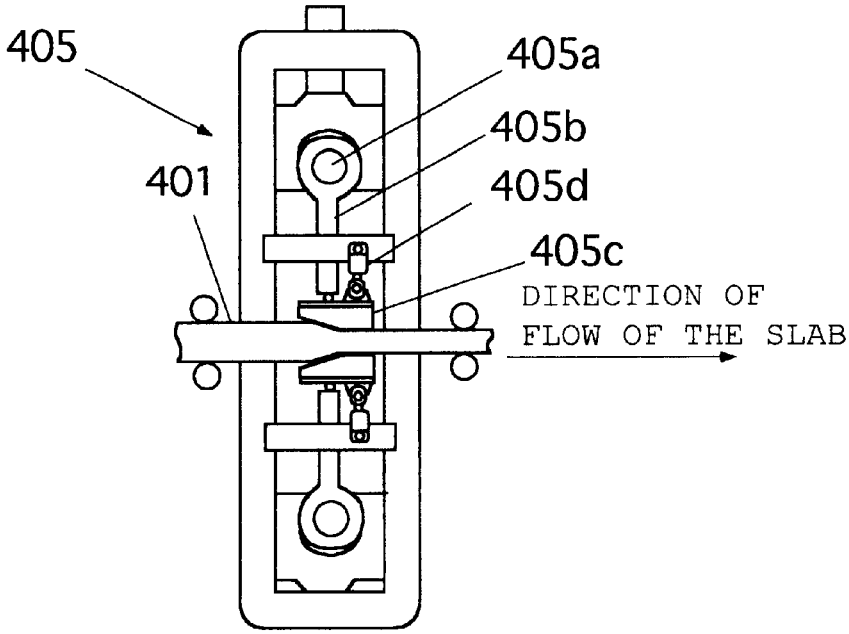
FIG. 20 shows an example of a plate reduction press apparatus.

FIG. 20 is a side view showing an example of the plate reduction press machine 405. The plate reduction press machine 406 is composed of cranks 405*a* rotating eccentrically, connecting members 405*b* that transmit this eccentric movement to the dies 405*c* which press the slab, and cylinders 405*d* for holding the dies 405*c* horizontally. The dies 405*c* press the slab by the up and down motions produced by the eccentric movements, and at the same time, the eccentric movements also move the dies in the direction of flow of the slab, so that the slab can be conveyed continuously without stopping.

Next, the operation is described. When an ordinary slab is input into the rolling line from the heating furnace 402, its thickness is reduced by the first roughing mill and then reduced by the second roughing mills 406 to a thickness of about 30 mm, and then the reduced work is rolled by the finishing mills 407 into a thin sheet, with a predetermined thickness of for instance 1.5 mm, and then the sheet is reeled by the coilers 409 into coils. Depending on the thickness of a slab, the first roughing mill 404 can be used as a reverse rolling mill. Otherwise, the plate reduction press machine 403 can also be used to replace the first roughing mill 404, so both the mill and the press machine can be used as a backup in case one of them fails.

In the case of a long slab, the slab is delivered onto the rolling line after being heated by equipment on the upstream side of the line, although not illustrated. The first roughing mill 404 and/or the second roughing mills 406 may or may not be used according to the thickness of the slab, but the plate reduction press machine 405 is used without exception. The long slab cannot be reverse rolled because of its length. After being rough rolled, the slab is finish rolled by the finishing mills 407, into a thin sheet with a predetermined thickness and then reeled by the coilers 409, and as soon as the diameter of a coil reaches a predetermined value, the thin sheet is cut by the flying shear machine 408, and the leading end of the subsequent thin sheet starts being reeled by the other coiler 409. In this way, even if the slab length is changed, a slab can be rolled accordingly and appropriately.

The above-mentioned rolling procedures relate to the case in which the plate width of the thin sheet produced is assumed to be constant and thin sheets with different thicknesses are manufactured by adjusting the plate thickness during the rough rolling process. However, by using the stentering press machine 403, it is also possible to produce thin sheets with different plate widths. The stentering press machine 403, carries out operations to reduce a slab to a predetermined width for each length of the slab corresponding to the length of one coil of thin sheet.

Figure 21A:
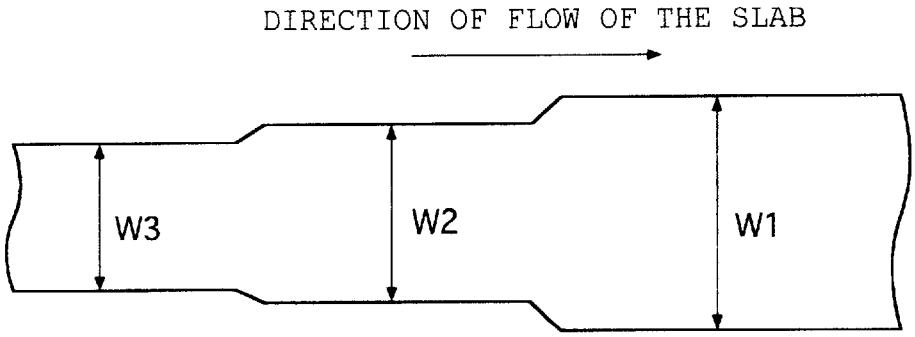
FIG. 21A is a schematic view showing a material to be pressed to produce thin sheets with different widths.
Figure 21B:
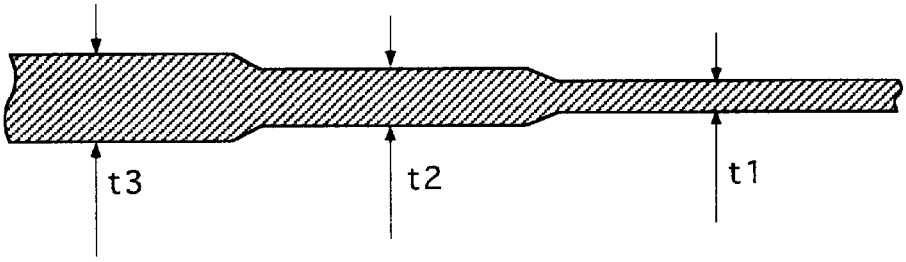
FIG. 21B is a schematic view showing a material to be pressed, to produce thin sheets with different plate thicknesses.

FIGS. 21A and 21B schematically show thin sheets of a rolled material 401 produced with different plate widths and thicknesses; a thin sheet with each width W and each thickness t is reeled into a coil, and cut at the beginning of the following thin sheet. The feature that the width and thickness can be changed during the rolling of a slab is advantageous particularly in the case of a long slab.

Obviously as described above, an ordinary length slab and a long slab can be rolled appropriately by employing a roughing mill, finishing mills, plate reduction press machine, stentering press machine, flying shear machines, and coilers in the most suitable arrangement. In addition, the plate thickness and/or width can be changed during continuous rolling, and each thin steel sheet with a predetermined thickness and width can be reeled into a coil.

Eleventh Illustrative Embodiment

Figure 22:
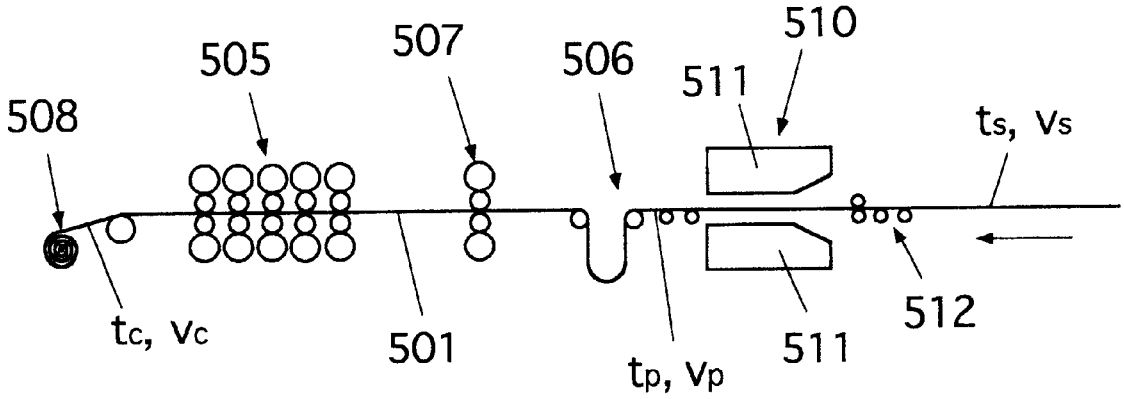
FIG. 22 shows the general configuration of the eleventh illustrative embodiment of the hot rolled steel sheet manufacturing apparatus according to the present invention.

FIG. 22 is a view showing the general configuration of the eleventh illustrative embodiment of the hot rolled steel sheet manufacturing apparatus according to the present invention. In FIG. 22, this rolling apparatus is provided with a plate reduction press machine 510 that is structured so that the dies 511 press a material 501 to be rolled while it is moving in the downstream direction, a feeding device 512 that transfers the material 501 to be rolled towards the downstream direction, rolling mills 505 installed on the downstream side of the plate reduction press machine 510 that continuously roll the material 501 to be rolled, and a looper device 506 that is installed between the plate reduction press machine 510 and the rolling mill 505 and retains a slack portion of the material 501 to be rolled, produced therebetween.

In this illustrative embodiment, the rolling mills 505 represent a plurality of finish rolling mills arranged in tandem, and in addition, a rough rolling mill 507 is provided between the looper device 506 and the rolling mills 505. However, this rough rolling mill 507 is not always necessary, and can be omitted from the configuration.

In addition, a coiler 508 is installed on the downstream side of the rolling mills 505, and can reel a thin steel sheet rolled by the finish rolling mills 505, into a coil.

Obviously from FIG. 22, this rolling apparatus is arranged so that a slab of material continuously supplied from a continuous casting machine etc. can be rolled down to a thin sheet continuously without cutting the material during the rolling process. Therefore, the relationship ts×Vs=tp×vp=tc×vc (Equation 1) must be satisfied, where ts and vs mean the plate thickness and feeding speed, respectively before being pressed with a large reduction by the plate reduction press machine 510, tp and vp are the same parameters after being pressed with a large reduction by the same machine, and tc and vc are the plate thickness and feeding speed of the thin steel sheet when it is reeled by the coiler 508, because the mass flows of the material before and after being rolled must be equal.

With the rolling apparatus shown in FIG. 22 according to the present invention, the mean feeding speed vs at the inlet of the plate reduction press machine 510 is fixed so that vs=tc×vc/ts because the speed vs must be consistent with the mass flow of the material being rolled on the downstream side of the rolling mills (see Equation 1). With this apparatus, in addition, the feeding speed v0 of the feeding device 512 during the time when the material is not being pressed set such that the mean feeding speed per pressing cycle agrees with the aforementioned speed vs.

With a configuration such as that described above, the maximum amount of the slack portion of the material 501 to be rolled, produced between the plate reduction press machine 510 and the rolling mills 505 (and 507), becomes only the amount due to the difference in the feeding speeds during one cycle of pressing, so the looper device 506 can be made small.

Figure 23:
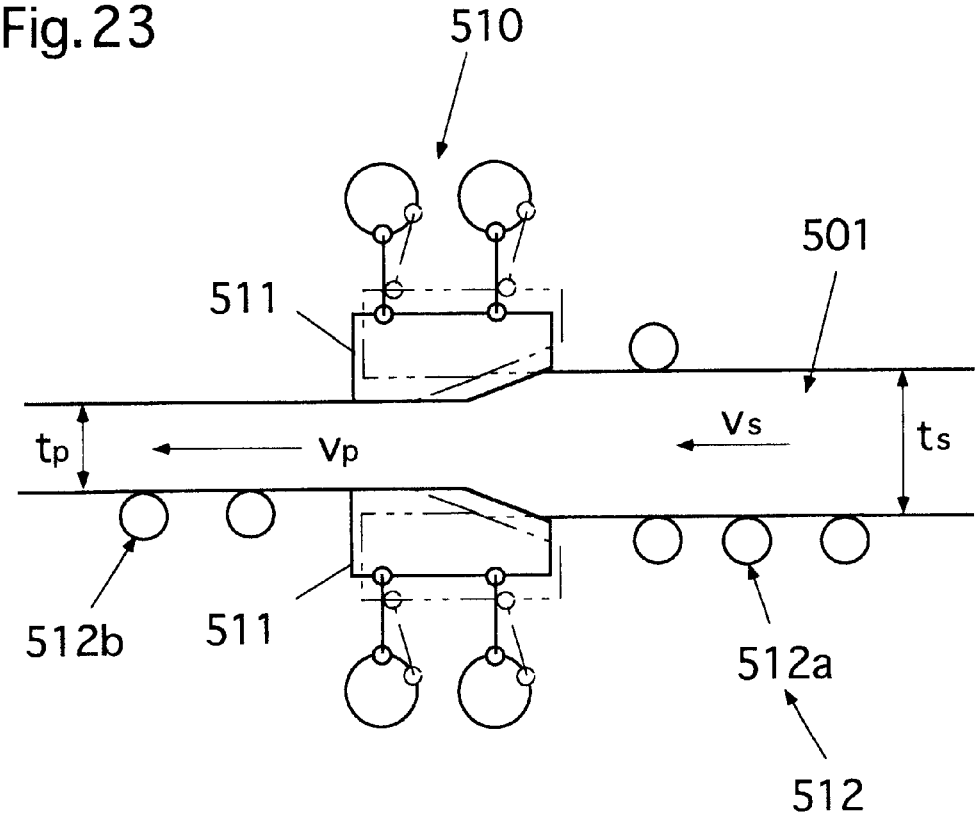
FIG. 23 shows the configuration of the plate reduction press apparatus constituting the hot rolled steel sheet manufacturing apparatus according to the present invention.

FIG. 23 shows the configuration of a reduction press machine that is a constituent of the hot rolled steel sheet manufacturing apparatus according to the present invention. As shown in FIG. 23, the reduction press machine is provided with a plate reduction press machine 510 that is structured so that the material 501 to be rolled is pressed by the dies 511 while being moved in the downstream direction, and feeding devices 512 that move the material 501 to be rolled towards the downstream direction, and when the dies 511 of the plate reduction press machine 510 are separated from the material 501 to be rolled, the feeding devices 512 move the material 501 to be rolled in the downstream direction.

The feeding devices 512 are composed of, in this embodiment, conveyer rollers 512*a*, 512*b* installed on the upstream and downstream sides of the plate reduction press machine 510, in which the rollers of the conveyor rollers 512*a*, 512*b* are driven and the material 501 to be rolled can be moved at a preferred speed towards the downstream direction. However, it is not necessary that both conveyor rollers 512*a*, 512*b* should always be driven, and either the ones on the upstream or downstream side can be made driving rollers, while the conveyor rollers on the other side are configured as free rollers.

Figure 24A:
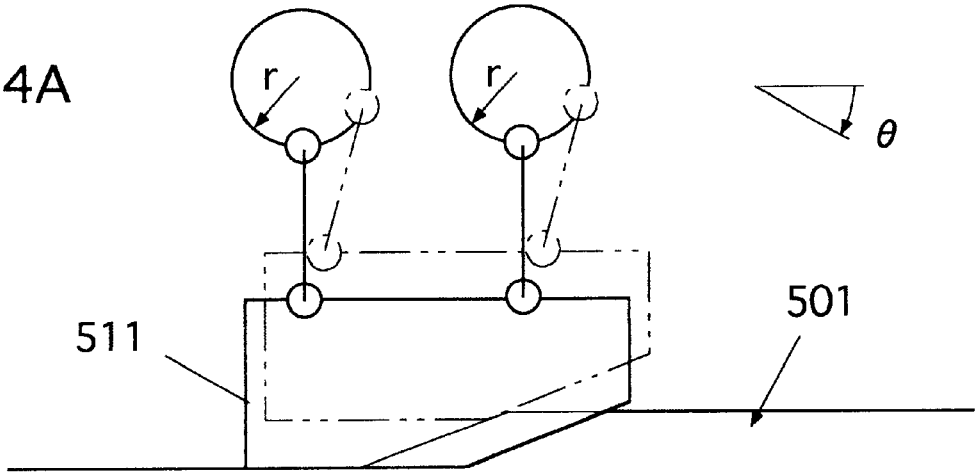
FIG. 24A is an enlarged view of part of the plate reduction press apparatus.
Figure 24B:
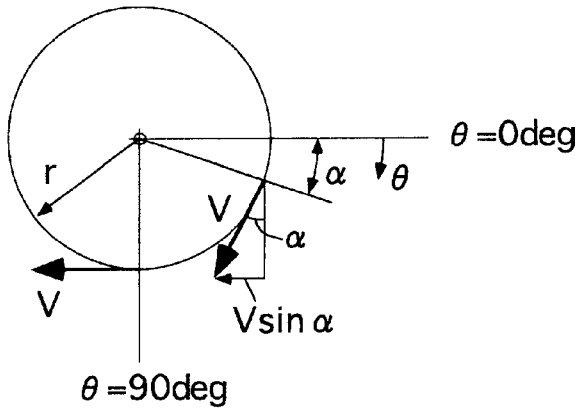
FIG. 24B illustrates the operation of the dies.
Figure 24C:
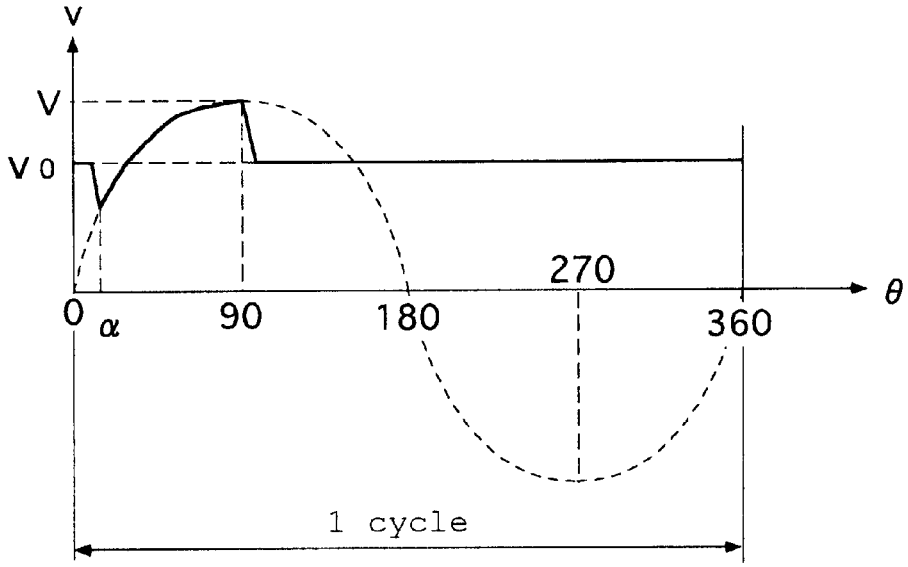
FIG. 24C is a graph showing the speed at which a feeding device feeds the material to be pressed on the upstream side.

FIGS. 24A to 24C describe the operation of the reduction press machine. In these figures, FIG. 24A is a enlarged view of part of the plate reduction press machine 510, FIG. 24B describes the operation of the die 511, and FIG. 24C is a chart of the speed at which the material 501 to be rolled is to be fed on the upstream side, by the feeding device 512.

In FIG. 24A, the plate reduction press machine 510 in this embodiment is provided with an eccentric pressing mechanism that moves the die 511 in a circular path with a radius r. This pressing mechanism can be composed of, for instance, a crank mechanism or an eccentric cam.

By means of this pressing mechanism, as shown in FIG. 24B, the die 511 contacts the material 501 to be rolled when the angle of rotation , as measured from a horizontal direction on the upstream side towards the material to be rolled, is a positive angle , and moves while pressing the material until=90°, and reaches a maximum speed V when=90°, according to this configuration. The maximum speed V is given by V=2 rf . . . (Equation 2) where f (in cycles/sec) is the frequency of the pressing mechanism (speed at which the cycle is repeated).

Therefore, as shown by the solid lines in FIG. 24*c*, the speed v for feeding the material 501 to be rolled is determined by the pressing mechanism during the period from=to 90° when the die 511 is pressing the material 501 to be rolled, that is, v=Vsin . . . (Equation 3). During this time, the feeding device 512 also drives the material 501 to be rolled in the downstream direction at the speed shown by Equation 3.

According to the present invention as described above, the material to be rolled is fed by the feeding device 512 at a substantially constant speed v0 during the time that the die 511 of the plate reduction press machine 510 is not in contact with the material 501 to be rolled (in other words, during a non-pressing period). This constant speed v0 can be varied, and the feeding speed v0 when the die is not pressing is set so that the mean feeding speed per pressing cycle agrees with the aforementioned mean speed. That is, as shown by the solid line in FIG. 24*c*, during the pressing cycle, the speed v of the material to be rolled at the inlet of the press is as shown by the sine curve while the die 511 is pressing the material 501 to be rolled, and while the die 511 is not in contact with the material 501 to be rolled on the other hand, the speed v becomes substantially constant, i.e. v0, however the mean speed per cycle is made to be the same as the mean feeding speed vs at the inlet, as determined by the mass flow.

In addition, it is also possible for the feeding device to move the material to be rolled in the downstream direction when the die of the plate reduction press machine is either pressing the material to be rolled or not in contact therewith.

Because the feeding device 512 also feeds the material 501 to be rolled at the speed v=Vsin while the die 511 is pressing, due to the above-mentioned configuration, the material to be rolled can be prevented from slipping relative to the feeding device (for instance, conveyor rollers), so that energy losses due to slipping or the occurrence of slipping flaws can be avoided. In addition, the material to be rolled can also be fed substantially at a constant speed v0 during the non-pressing period, and this speed is variable, therefore the material to be rolled can be continuously moved substantially in synchronism with downstream equipment such as finish rolling facilities, by adjusting the feeding speed, without the need to finely adjust the frequency of the pressing cycles.

The aforementioned configuration of the present invention (1) can press work simultaneously in synchronism with other mills, (2) can be designed to be compact without making the press machine excessively large, (3) can keep vibration levels low and provide stable operation, and (4) can prolong the life of a press machine and reduce the number of problems.

Therefore, the hot rolled steel sheet manufacturing apparatus according to the present invention provides many excellent advantages such as that there is no need to finely adjust the frequency of the pressing cycles, and the capability of continuously moving the material to be rolled substantially in synchronism with downstream equipment such as finish rolling facilities.

Twelfth Illustrative Embodiment

Figure 25:
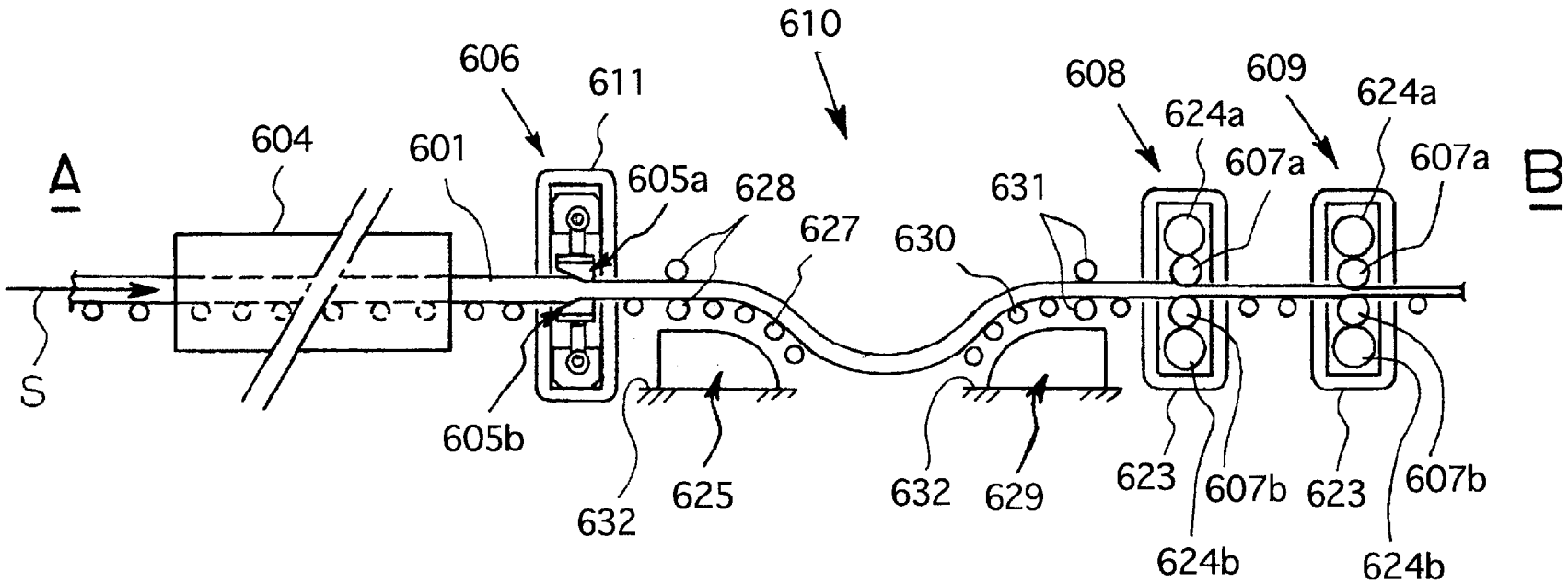
FIG. 25 is a general layout view showing the twelfth illustrative embodiment of the hot rolled steel sheet manufacturing apparatus according to the present invention.

FIG. 25 shows the twelfth illustrative embodiment of the hot rolled steel sheet manufacturing apparatus of the present invention; in this hot rolled steel sheet manufacturing apparatus, a tunnel furnace 604 is installed at a predetermined location on the upstream A side of a transfer line, for heating a material to be formed, and on the downstream B side of the aforementioned tunnel furnace 604 on the transfer line, a plate reduction press machine 606 is installed and provided with a pair of upper and lower dies 605*a*, 605*b* that are opposite each other above and below the transfer line S and that can press the material 601 to be formed in the direction of the plate thickness, and on the downstream B side of the above-mentioned plate reduction press machine 606 on the transfer line, there are two rough rolling mills 608, 609 each provided with a pair of upper and lower work rolls 607A, 607B that are opposite each other above and below the transfer line S and can press the material 601 to be formed in the direction of the plate thickness, arranged in series with each other on the transfer line S, and a looper mechanism 610 is installed between the above-mentioned plate reduction press machine 606 and the rough rolling mill 608 on the upstream A side of the transfer line, for retaining a slack portion of the material 601 in a downward deflection.

The material 601 to be formed is placed in the tunnel furnace 604, after being supplied from the upstream A side of the transfer line, and the furnace heats and holds the temperature of the aforementioned material 601 to be formed.

Figure 26:
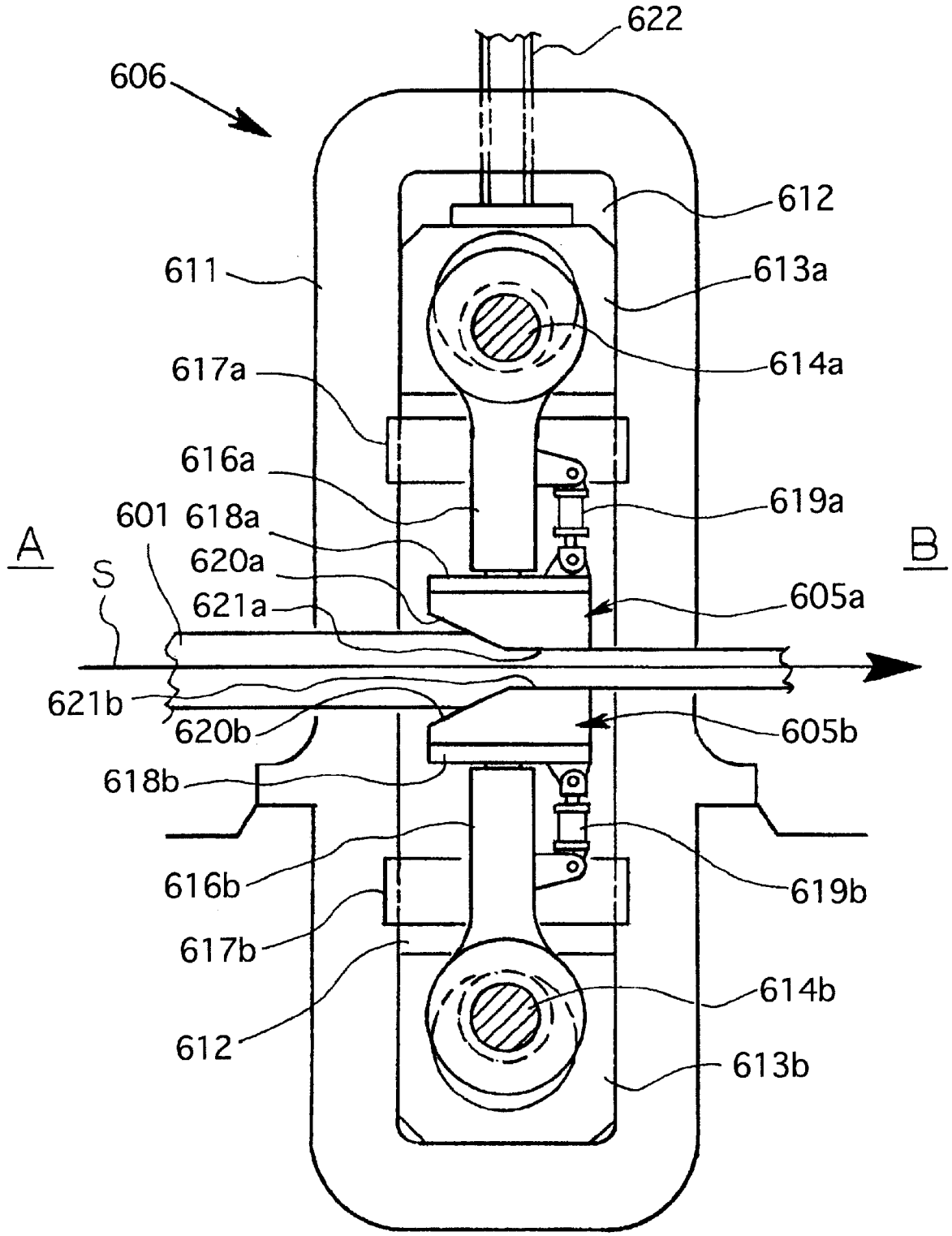
FIG. 26 is a side view of a plate reduction press apparatus corresponding to the one shown in FIG. 25.

The plate reduction press machine 606 is, as shown in FIG. 26, provided with a housing 611 erected at a predetermined location on the transfer line S through which a material 601 to be formed is able to pass, an upper shaft box 613*a* and a lower shaft box 613*b* that are engaged with a window portion 612 of the housing 611, opposite each other above and below the transfer line S, upper and lower crank shafts 614*a*, 614*b* that extend substantially horizontally in the direction orthogonal to the transfer line S and the non-eccentric portions thereof are supported by the upper shaft box 613*a* and the lower shaft box 613*b*, respectively, through bearings (not illustrated), rods 616*a*, 616*b* that are connected to the eccentric portions of the above-mentioned crank shafts 614*a*, 614*b* through bearings and extend upwards and downwards, respectively, rod support boxes 617*a*, 617*b* that are connected to intermediate points in the upward and downward directions of the aforementioned rods 616*a*, 616*b* through spherical bearings (not illustrated) and are engaged with the window portion 612 of the housing 611, and can slide upwards and downwards, die holders 618*a*, 618*b* connected to the tips of the rods 616*a*, 616*b* through ball joints (not illustrated), dies 605*a*, 605*b* fixed on the above-mentioned die holders 618*a*, 618*b*, and hydraulic cylinders 619*a*, 619*b* of which the cylinder portions are connected to intermediate points on the rods 616*a*, 616*b* in the up and down direction and of which the tips of the piston rods are connected to the die holders 618*a*, 618*b*.

The crank shafts 614*a* 614*b* are connected to output shafts (not illustrated) of motors via universal joints and speed reduction gears, and when the motors are operated, the upper and lower dies 605*a*, 605*b* move towards and away from each other on the upper and lower sides of the transfer line S.

Each die 605*a* or 605*b* is provided with a flat forming surface 620*a* or 620*b* that gradually slopes towards the transfer line S from the upstream A side to the downstream B side of the transfer line, and flat forming surfaces 621*a* and 621*b* that continue from the aforementioned forming surface 620*a* and 620*b* and face each other in a direction parallel to the transfer line S.

Also, the width of the dies 612*a* and 612*b* is set according to the plate width of the material 601 to be formed (about 2,000 mm or more)

A position adjusting screw 622 is provided at the top of the housing 611, for moving the upper shaft box 613*a* towards and away from the transfer line S, so that by rotating the above-mentioned position adjusting screw 622 about its axis, the die 605*a* can be moved up and down through the crank shaft 614*a*, rod 616*a*, and die holder 618*a*.

Each of the rough rolling mills 608, 609 is provided with a housing 623 erected on both sides of the transfer line S in the lateral direction, a pair of work rolls 607*a*, 607*b* that engage with the above-mentioned housing 623 through bearings (not illustrated) and face each other on the upper and lower sides of the transfer line S, and backup rolls 624*a*, 624*b* that contact the work rolls 607*a*, 607*b*, respectively, on the sides farther from the transfer line, and by rotating the work roll. 607*a* above the transfer line S in the counter-clockwise direction and the lower work roll 607 clockwise, the material 601 to be formed is gripped between both work rolls 607*a*, 607*b*, and at the same time, the bearings that support the journals of the upper backup roll 624*a* are pressed towards the transfer line S by a means of pressing (not illustrated) such as a screw jack, provided in the housing 623, thereby the material 601 to be formed that has been inserted between both work rolls 607*a*, 607*b* is pressed and formed in the direction of the plate thickness.

Figure 27:
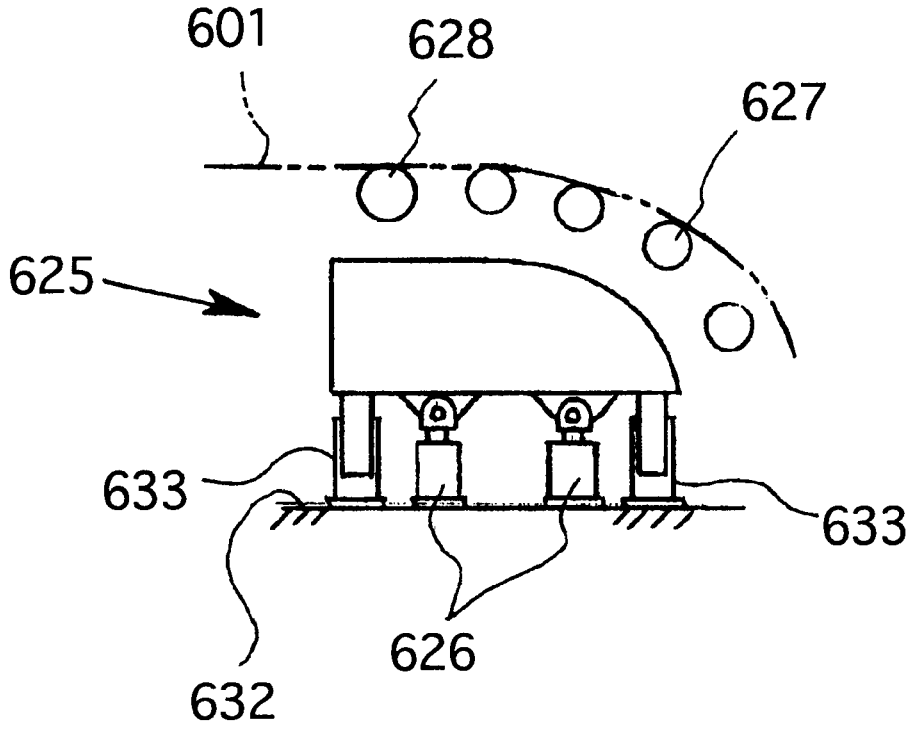
FIG. 27 is a side view of an upstream table corresponding to the one shown in FIG. 25.

The looper mechanism 610 is, as shown in FIGS. 25 and 27, composed of an upstream table 625 installed in the proximity of the plate reduction press machine 606 in the downstream B direction of the transfer line, hydraulic cylinders 626 that raise and lower the aforementioned upstream table 625, a plurality of upstream rollers 627 provided on top of the above-mentioned upstream table 625 so that the rollers can contact the lower surface of the material 601 to be formed and the locations of the supports of each roller gradually descend in the downstream B direction of the transfer line, upstream pinch rolls 628 that are provided in the vicinity of the aforementioned upstream table 625 in the upstream A direction of the transfer line and can grip the material 601 to be formed in the direction of the plate thickness, a downstream table 629 arranged near the upstream rolling mill 608, in the upstream A direction of the transfer line, a plurality of downstream rollers 630 that can come in contact with the lower surface of the material 601 to be formed and the locations of the supports of each roller gradually become higher in the downstream B direction of the transfer line, and downstream pinch rolls 631 that are installed near the above-mentioned downstream table 629, in the downstream B direction of the transfer line and can grip and transfer the material 601 to be formed in the direction of the plate thickness.

The upstream table 625 is installed in the vicinity of the plate reduction press machine 606 in the downstream B direction of the transfer line, and is provided with an upper surface that gradually slopes downwards in the downstream B direction of the transfer line, and is capable of being raised and lowered along a plurality of guide members. 633 arranged at predetermined locations on the floor surface 632.

The cylinder portions of the hydraulic cylinders 626 are supported on the floor surface 632 near the above-mentioned guide members 633 through bearings, and are arranged so that the tips of the piston rods support the lower surface of the upstream table 625 through bearings, and the upstream table 625 is moved up and down by applying hydraulic pressure appropriately to the hydraulic chambers on the rod and head sides of the aforementioned hydraulic cylinders 626.

The upstream rollers 627 are mounted on the upper surface of the above-mentioned upstream table 625, and arranged in such a manner that the parts of the rollers that contact the bottom surface of the material 601 to be formed and support the material gradually slope downwards in the downstream B direction of the transfer line.

The downstream table 629 is installed in the vicinity of the rough rolling mill 608 on the transfer line, and provided with an upper surface that gradually slopes upwards in the downstream B direction of the transfer line, and is installed and fixed at a predetermined location on the floor surface 632.

The downstream rollers 630 are mounted on the upper surface of the aforementioned downstream table 629, and arranged so that the parts of the rollers that contact the bottom surface of the material 601 to be formed and support the material gradually slope upwards in the downstream B direction of the transfer line.

Next, the operation of the hot rolled steel sheet manufacturing apparatus shown in FIG. 25 is described as follows.

When a long material 601 to be formed is to be pressed and formed in the direction of the plate thickness, the position adjusting screw 622 is rotated about its axis to adjust the position of the upper shaft box 613*a* of the plate reduction press machine 606 appropriately so that the spacing between the dies 605*a*, 605*b* of the plate reduction press machine 606 is set according to the plate thickness of the material 601 to be pressed and formed.

In addition, hydraulic pressure is applied in an appropriate manner to the rod side hydraulic chambers and the head side hydraulic chambers of the hydraulic cylinders 626 that support the upstream table 625, and the upstream table 625 is moved up or down, thereby the position of the upstream table 625 in the vertical direction is adjusted so that the upstream pinch rolls 628 provided on the upstream table 625 are located in a vertical position such that the leading end portion of the material 601 when it leaves the plate reduction press machine 606 after being subjected to the first step of plate reduction, can be gripped by the rolls.

Furthermore, a means of pressing (not illustrated) such as a screw jack, provided in the housing 623 of each of the rough rolling mills 608, 609 is actuated to move the bearings that support the journals of the upper backup roll 624*a*, towards the transfer line S, thus the spacing between the upper and lower work rolls 607*a*, 607*b* of the rough rolling mill 608 is set according to the plate thickness of the material 601 after it has been reduced in the first step of reducing the plate thickness by the plate reduction press machine 606, or the plate thickness required after the rough rolling mill 608 has reduced the plate thickness, and the spacing between the upper and lower work rolls 607*a*, 607*b* of the rough rolling mill 609 is set depending on the plate thickness of the material 601 after the second step of plate reduction, or the plate thickness required after the plate thickness has been reduced by the rough rolling mill 609.

Thereafter, the motor (not illustrated) of the plate press machine 606 is operated to rotate the crank shaft 614*a* above the transfer line S counterclockwise and the crank shaft 614*b* below the transfer line S clockwise.

As a result, when the crank shafts 614*a*, 614*b* of the plate reduction press machine 606 rotate, the displacements of the eccentric portions are transmitted to the die holders 618*a*, 618*b* through the rods 616*a*, 616*b* so that the dies 605*a*, 605*b* move towards and away from each other on the upper and lower sides of the transfer line S. addition, the rough rolling mills 608, 609 are operated so that the work rolls 607*a* of the aforementioned. rolling mills 608, 609 above the transfer line, rotate counterclockwise and the work rolls 607*b* below the transfer line S, rotate clockwise, thus the leading end portion of the material 601 after being reduced through the first plate reduction step, can be gripped between the upper and lower work rolls 607*a*, 607*b* of the rough rolling mills 608, 609 as it moves in the downstream direction of the transfer line.

Then, the material 601 to be reduced and formed in the direction of the plate thickness is transferred and supplied from the upstream A side of the transfer line and transferred into the tunnel furnace 604 where the material is heated and softened, and the leading end portion of the aforementioned material 601 to be formed in the downstream B direction of the transfer line, is inserted between the dies 605*a*, 605*b* of the plate reduction press machine 606, and moved in the downstream B direction of the transfer line, thereby the first plate thickness reduction step is carried out for reducing and forming the material 601 to be formed in the direction of the plate thickness by means of the dies 605*a*, 605*b* as they move towards the transfer line S.

The leading portion of the material 601 after being reduced in the first plate reduction step by the plate reduction press machine 606, is gripped by the upstream pinch rolls 628 of the looper mechanism 610 as it moves in the downstream B direction of the transfer line and sent onto the upstream table 625, and the lower surface thereof is supported by the upstream rollers 627.

As the thickness of the material 601 to be formed is progressively reduced by the plate reduction press machine 606, the leading end portion of the above-mentioned material 601 to be formed, travels towards the downstream table 629 as it moves in the downstream B direction of the transfer line.

At this time, rollers, not illustrated, for supporting the material to be formed are positioned substantially horizontally between the upstream table 625 and the downstream table 269 of the looper mechanism 610, and support the above-mentioned material 601 to be formed and guide the leading end portion of the material 601 towards the downstream table 629 as it moves in the downstream B direction of the transfer line.

The leading end portion of the material 601, as it moves in the downstream B direction of the transfer line, passes over the downstream table, and is sandwiched between and gripped by the downstream pinch rolls 631, and fed in between the upper and lower work rolls 607, 607*b* of the rough rolling mill 608 on the upstream A side of the transfer line.

As soon as the leading end portion of the material 601 to be formed is caught by the downstream pinch rolls 631, the aforementioned rolls, not illustrated, which support the material to be formed are retracted from the space between the upstream table 625 and the downstream table 629 in the looper mechanism 610, to a position where they will not interfere with the material 601 to be formed when a slack portion has been created.

The downstream pinch rolls 631, which grip the leading end portion of the material 601 to be formed as it moves in the downstream B direction of the transfer line, are controlled at first so that they rotate at a lower speed than the plate thickness reducing and forming speed of the plate reduction press machine 606 for the material 601 to be formed, so that a slack portion of the material 601 to be formed is produced as the material moves between the upstream table 625 and the downstream table 629 of the looper mechanism, and after a predetermined amount of the slack portion of the material has been produced, the downstream pinch rolls are controlled to rotate in synchronism with the work rolls 607*a*, 607*b* of the rough rolling mill 608.

The leading end portion of the material 601 to be formed, after being supplied to and fed between the upper and lower work rolls 607*a*, 607*b* of the rough rolling mill 608 by the downstream pinch rolls 631, is gripped between the work roll 607*a* above the transfer line S, which is rotating counterclockwise and the lower work roll 607*b* below the transfer line S which is rotating clockwise, that have been set to a predetermined spacing by a means of pressing (not illustrated) such as a screw jack installed in the housing 623, and is reduced and formed in the direction of the plate thickness by the aforementioned means of pressing that presses the work roll 607*a* downwards through the upper backup roll 624*a*.

Then, as the material 601 to be formed travels in the downstream B direction of the transfer line, the portions of the material 601 to be formed, the plate thickness of which has been reduced in the first step, which are a continuation of the portion of the material which has been reduced in the second step of reducing the plate thickness by the aforementioned rough rolling mill 608, are in turn inserted between both work rolls 607*a*, 607*b* of the rough rolling mill 608, and the plate thickness of the portions of the material 601 to be formed is reduced in the second step.

After the leading end portion of the material 601 to be formed has gone through the second step of reducing the plate thickness in the rough rolling mill 608 on the upstream A side of the transfer line, the leading end portion is supplied to and fed between the upper and lower work rolls 607*a*, 607*b* of the rough rolling mill 609 on the downstream B side of the transfer line, and the leading end portion is caught between the upper and lower work rolls 607*a*, 607*b* rotating counterclockwise and clockwise, respectively, above and below the transfer line, of which the spacing has been predetermined by a means (not illustrated) of pressing such as a screw jack provided in the housing 623, and pressed and formed in the direction of the plate thickness by the aforementioned means of pressing that depresses the work roll 607*a* downwards through the upper backup roll 624*a*.

After that, as the material 601 to be formed is transferred in the downstream B direction of the transfer line, the portions of the material 601 to be formed, the plate thickness of which has been reduced in the second step of reducing the plate thickness, which follow after the portion whose plate thickness has already been completely reduced in the third step of reducing the plate thickness by the rough rolling mill 609, are passed in turn between both work rolls 607*a*, 607*b* of the rough rolling mill 609, and subjected to the third step of reducing the plate thickness for the material 601 to be formed.

As described above, with the hot rolled steel sheet manufacturing apparatus shown in FIG. 25, a portion of the material 601 to be formed but not yet reduced or formed, is processed in the first step of reducing the plate thickness using the dies 605*a*, 605*b* of the plate reduction press machine 606, and then the portion of the material 601 to be formed, after being reduced and formed in the first step, is reduced and formed in the direction of the plate thickness by the work rolls 607*a*, 607*b* of the rough rolling mill 608 on the upstream A side of the transfer line, in the second step of reducing the plate thickness, and then the portion whose plate thickness has been completely reduced in the second step, is subjected to the third step of reducing the plate thickness using the work rolls 607*a*, 607*b* of the rough rolling mill 609 on the downstream B side of the transfer line, therefore, the apparatus according to the present invention can efficiently reduce the thickness of and form the material 601 in the direction of the plate thickness.

In addition, because a looper mechanism 610 is provided and retains a predetermined slack portion of the material 601 to be formed between the plate reduction press machine 606 and the rough rolling mill 608, as the material is traveling therebetween, differences between the operating speeds of the plate reduction press machine 606 and the rough rolling mill 608 when they reduce the plate thickness of the material can be compensated for.

Thirteenth Illustrative Embodiment

Figure 28:
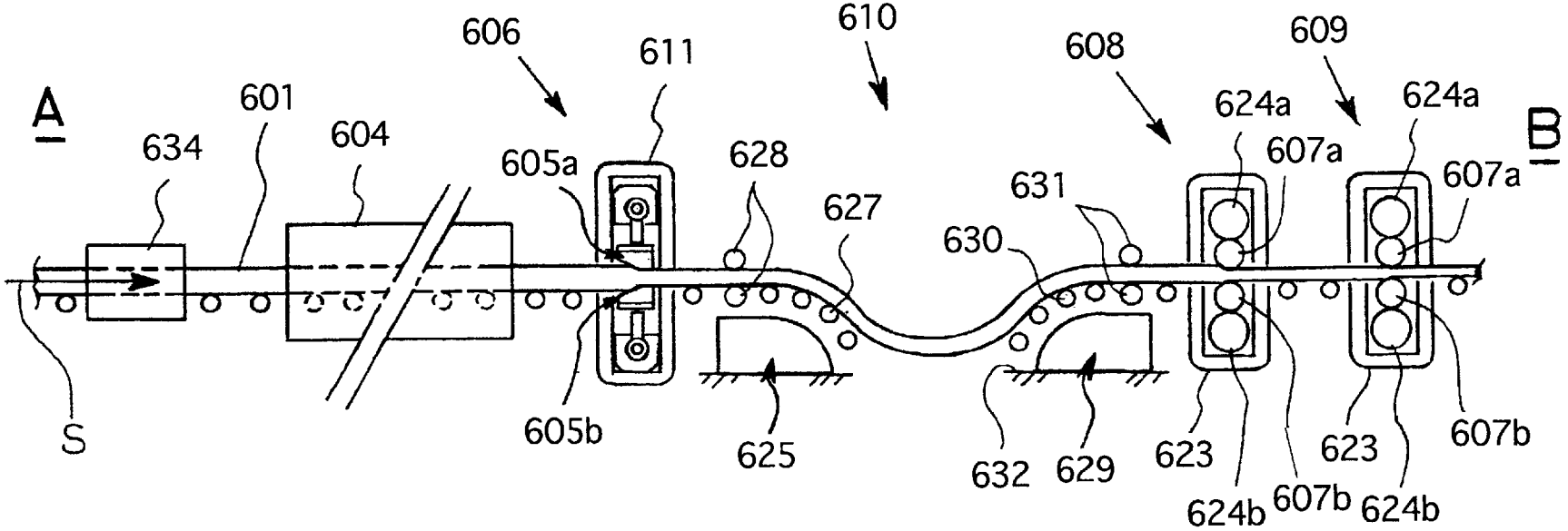
FIG. 28 is a schematic view showing the thirteenth illustrative embodiment of the hot rolled steel sheet manufacturing apparatus according to the present invention.

FIG. 28 shows the thirteenth illustrative embodiment of the hot rolled steel sheet manufacturing apparatus according to the present invention, and in the figure, item numbers refer to the same components as in FIG. 25.

In this configuration of the plate reduction press apparatus, a stentering press machine 634 is also provided on the upstream A side of the tunnel furnace 604, in addition to the configuration of the hot rolled steel sheet manufacturing apparatus shown in FIG. 25.

Figure 29:
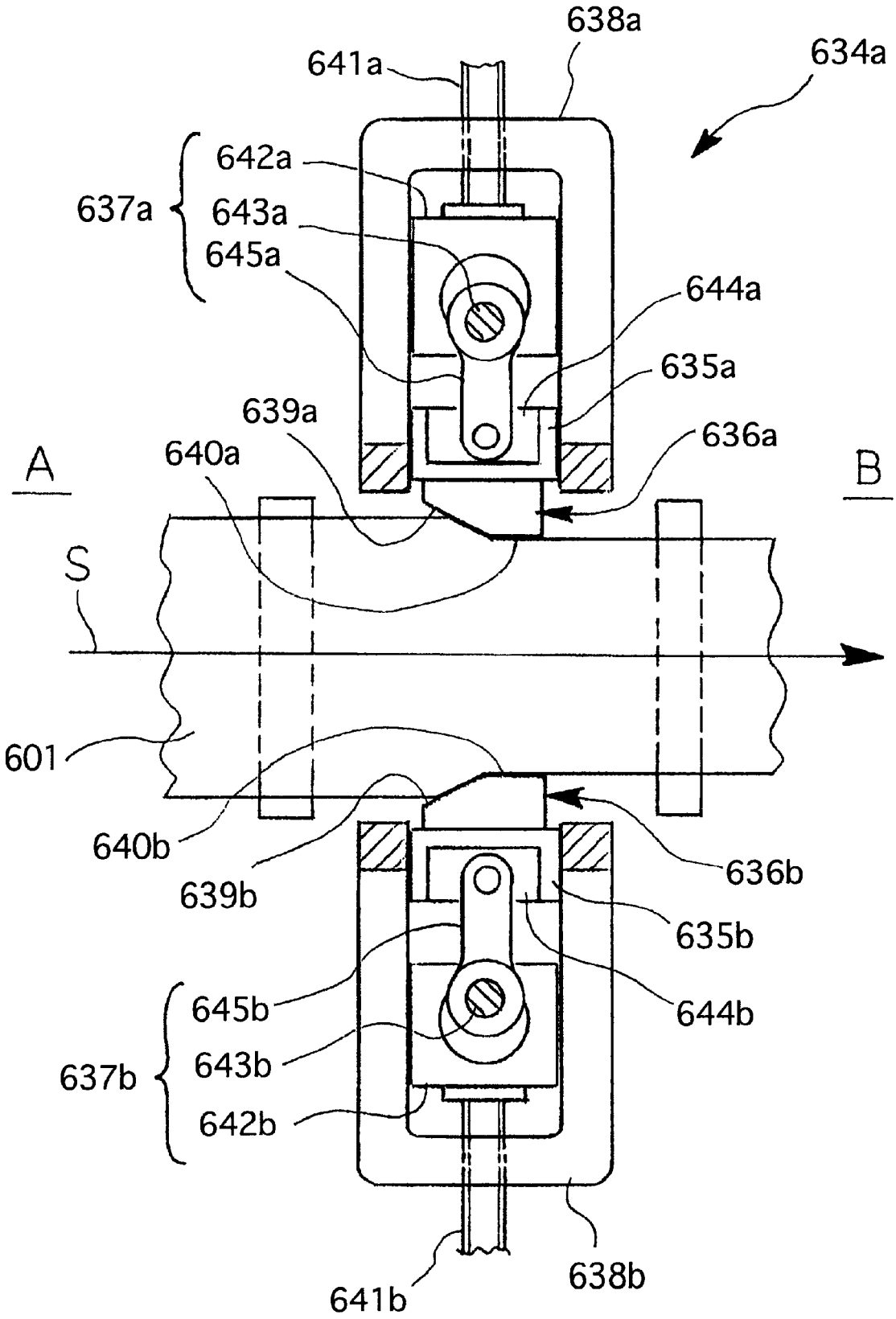
FIG. 29 is a plan view of a stentering press machine corresponding to the one shown in FIG. 28.

The stentering press machine 634 is, as shown in FIG. 29, composed of a pair of die holders 635*a*, 635*b* that can move towards and away from each other on opposite sides of the transfer line S, opposite each other in the direction of the plate width on the right and left sides of the transfer line S, dies 636*a*, 636*b* mounted opposite each other on the aforementioned die holders 635*a*, 635*b* on opposite sides of the transfer line S, and reciprocating mechanisms 637*a*, 637*b* for moving the dies are installed on the sides farther from the transfer line than the above-mentioned die holders 635*a*, 635*b*.

The die holders 635*a*, 635*b* can move horizontally in a direction substantially orthogonal to the transfer line S, along the guide members 638*a*, 638*b* provided on the sides of the transfer line S.

The dies 636*a*, 636*b* are provided with flat forming surfaces 639*a*, 639*b* gradually sloping from the upstream A side to the downstream B side in the direction of transfer of the transfer line S, and forming surfaces 640*a*, 640*b* continuing from the aforementioned forming surfaces 630*a*, 630*b*, respectively, opposite each other and parallel to the transfer line S, in which the positions of the forming surfaces. 639*a*, 639*b*, 640*a*, and 640*b* are set according to the plate width of a material 601 to be formed.

Reciprocating mechanisms 637*a*, 637*b* for moving the dies are installed on the sides farther from the transfer line than the above-mentioned die holders 635*a*, 635*b*, and are provided with shaft boxes 642*a*, 642*b* that can move freely along guide members 638*a*, 638*b* and are moved towards and away from each other and with respect to the transfer line S by means of screw jacks (devices for setting the amount of reduction) 641*a*, 641*b*, crank shafts 643*a*, 643*b* that are supported by the aforementioned shaft boxes 642*a*, 642*b* and extend perpendicularly, and rods 645*a*, 645*b* the big ends of which are connected to the eccentric portions of the crank shafts 643*a*, 643*b* and the tips of which are attached to brackets 644*a*, 644*b* installed on the die holders 635*a*, 635*b*.

The crank shafts 643*a*, 643*b* are rotated by motors (not illustrated) through synchronous mechanisms such as gear boxes, so that when the motors are operated, the displacements of the eccentric portions of the crank shafts 643*a*, 643*b* are transmitted to the left and right dies 636*a*, 636*b* through the rods 645*a*, 645*b* and the die holders 635*a*, 635*b*, so that the above-mentioned dies 636*a*, 636*b* move towards and away from the transfer line S in synchronism with each other.

When the screw jacks 641*a*, 641*b* are actuated, the spacing between the left and right shaft boxes 642*a*, 642*b* is changed, and accordingly, the spacing between the dies 636*a*, 636*b*, that is, the amount of reduction of the material 601 to be formed is adjusted.

It is preferable that side guides should be installed on the upstream A and downstream B sides of the stentering press machine 634 in the transfer direction, so that the edges of the material 601 to be reduced and formed can be properly guided into the space between the left and right dies 636*a*, 636*b*, and the edges of the material 601 after being pressed and formed by the aforementioned dies 636*a*, 636*b*, can travel smoothly along the transfer line S in the downstream B direction.

The operation of the hot rolled steel sheet manufacturing apparatus shown in FIG. 28 is described below.

When a long material 601 to be formed is to be reduced and formed in the direction of the plate thickness, the screw jacks 641*a*, 641*b* of the reciprocating mechanisms 637*a*, 637*b* for moving the dies of the stentering press 634, are used to change the spacing between the left and right shaft boxes 642*a*, 642*b* of the reciprocating mechanisms 637*a*, 637*b* for moving the dies, thereby adjusting the spacing between the left and right dies 636*a*, 636*b* which are connected through the rods 645*a*, 645*b* and the crank shafts 643*a*, 643*b* to the above-mentioned shaft boxes 642*a*, 642*b* through bearings, and the amount of reduction in the lateral direction of the material 601 to be formed is set, while also the spacing between dies of the plate reduction press machine 606, the vertical position of the upstream table 625, and the spacing between the work rolls 607*a*, 607*b* of each of the rough rolling mills 608, 609 are set in the same way as for the hot rolled steel sheet manufacturing apparatus shown in FIG. 25.

Next, the motors, not illustrated, of the stentering press machine 634 are operated and the crank shafts 643*a*, 643*b* are rotated through synchronous mechanisms such as gear boxes, thereby the left and right dies 636*a*, 636*b* are moved towards and away from the transfer line S, at the same time as the plate thickness reduction press machine 606 and the rough rolling mills 608, 609 are operated.

After that, the leading end portion of the material 601 to be formed on the transfer line is passed from the upstream A side of the transfer line into the space between the dies 636*a*, 636*b* of the stentering press machine 634, and is moved in the downstream B direction of the transfer line, then the width of the material 601 to be formed is reduced and formed in the lateral direction by the dies 636*a*, 636*b* of the stentering press machine 634, as they move towards the transfer line S, and as the material 601 to be formed travels towards the downstream B side of the transfer line, unreduced portions of the material 601 to be formed, following after the portion of the material, the width of which has already been reduced by the stentering press machine 634, are inserted in sequence between the dies 636*a*, 636*b* of the stentering press machine 634, thereby the entire length of the material 601 to be formed is processed to reduce the width thereof.

Thereafter, portions of the material 601 to be formed, the width of which has been reduced completely by the stentering press machine 634, are sequentially supplied and fed into. the tunnel furnace 604 in which the portions of the material 601 to be formed are heated and softened, and then the leading end portion of the material 601, heated and softened by the tunnel furnace 604, is inserted between the dies 605*a*, 605*b* of the plate reduction press machine 606 and the thickness thereof is reduced and formed in the direction of the plate thickness as the first step of reducing the plate thickness, as with the hot rolled steel sheet manufacturing apparatus shown in FIG. 25, and then the leading end portion of the material 601 is inserted between the work rolls 607*a*, 607*b* of the rough rolling mill 608 where the plate thickness thereof is reduced in the second step of reducing the plate thickness, and next it is inserted between the work rolls 607*a*, 607*b* of the rough rolling mill 609 and processed in the third step of reducing the plate thickness.

In the hot rolled steel sheet manufacturing apparatus shown in FIG. 28, as described above, the pair of dies 636*a*, 636*b* of the stentering press machine 634, which can come in contact with the edge portions of the material 601 to be formed in the direction of the plate width with a sufficiently long length of contact, are moved towards and away from each other, and the width of the material 601 to be formed is reduced and formed in the direction of the plate width, so the side edge portions of the material 601 to be formed never become deformed, and the material 601 to be formed is shaped evenly in the whole direction of the plate width, so that the shape of the cross section of the material 601 to be formed in the lateral direction can be prevented from developing so-called dog bones and have a plane shape free from fish tails.

As with the hot rolled steel sheet manufacturing apparatus shown in FIG. 25, an unreduced portion of the material 601 to be formed is processed in the first step of reducing the plate thickness by the plate reduction press machine 606 for pressing and forming, the portion of the material., which has been completely reduced and formed in the first step is subjected to the second step of reducing the plate thickness in which the plate thickness of the material is pressed and formed by the rough rolling mill 608 on the upstream A side of the transfer line, and then the portion of the material 601 after the plate thickness has been reduced in the second step, is further rolled and formed in the direction of the plate thickness by the rough rolling mill 609 on the downstream B side of the transfer line, in the third step of reducing the plate thickness, therefore the material 601 to be formed can be efficiently reduced and formed in the direction of the plate thickness.

Moreover, due to the looper mechanism 610 which holds a predetermined slack portion of the material 610 to be formed as it travels between the plate reduction press machine 606 and the rough rolling mill 608, differences in the operating speeds of the plate reduction press machine 606 and the rough rolling mill 608, when the machine and the mill are pressing the thickness of the material 601 to be formed, can be compensated for.

Fourteenth Illustrative Embodiment

Figure 30:
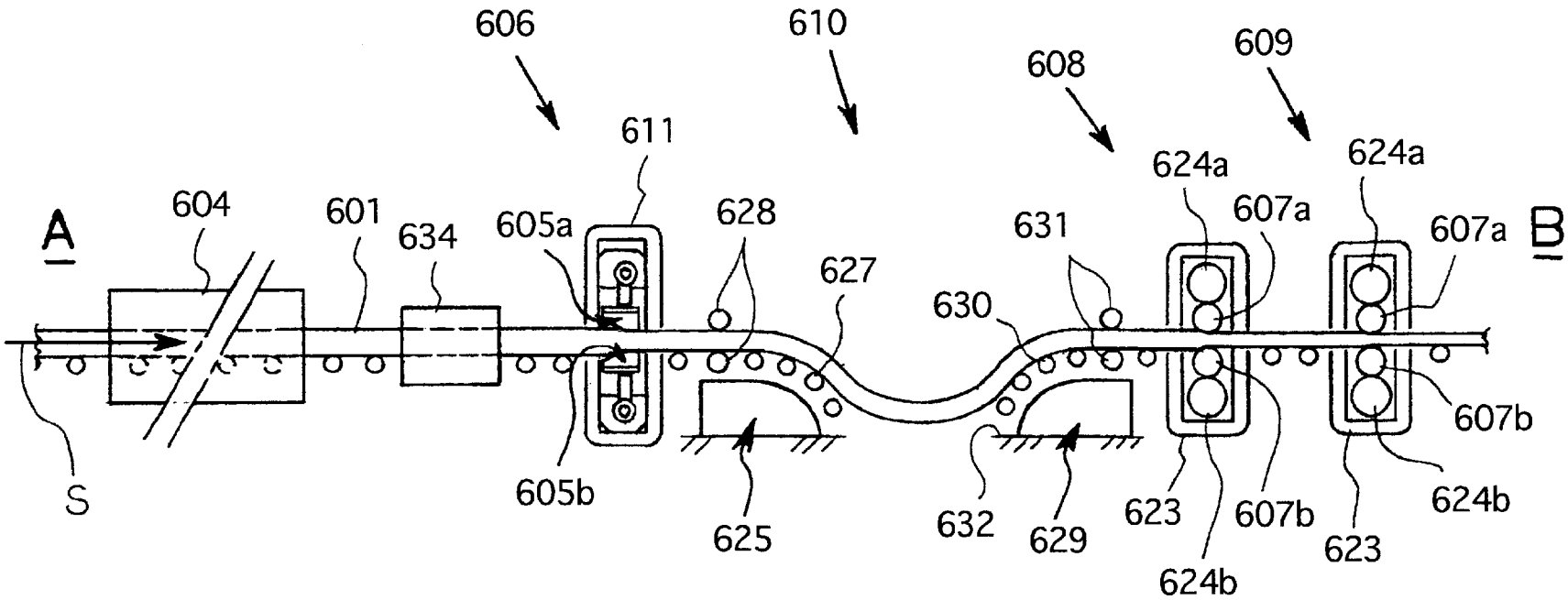
FIG. 30 is a schematic view showing the fourteenth illustrative embodiment of the hot rolled steel sheet manufacturing apparatus according to the present invention.

FIG. 30 shows the fourteenth illustrative embodiment of the hot rolled steel manufacturing apparatus according to the present invention, and in the figure, the same item numbers are used to refer to the same objects as in FIGS. 25 through 28.

In this hot rolled steel sheet manufacturing apparatus, in addition to the configuration of the plate reduction press equipment shown in FIG. 25, the stentering press machine 634 shown in FIG. 29 is installed on the downstream B side of the tunnel furnace 604 on the transfer line.

When a long material 601 to be formed is to be pressed and formed in the direction of the plate thickness using the hot rolled steel sheet manufacturing apparatus shown in FIG. 30, the spacing between the left and right dies 636*a*, 636*b* of the stentering press machine 634 is adjusted and the amount of reduction in the lateral direction of the material 601 to be formed is set in the same way as for the hot rolled steel sheet manufacturing apparatus shown in FIG. 29, and after completing the setting of the space between the dies of the plate reduction press machine 606, the vertical position of the upstream table 625 of the looper mechanism, and the spacing between the work rolls 607*a*, 607*b* of each of the rolling mills 608, 609, the stentering press machine 634 and the plate reduction press machine 606 are put into operation, and the rough rolling mills 608, 609 are also operated.

After that, the material 601 to be pressed and formed in the direction of the plate thickness is fed from the upstream A side of the transfer line into the tunnel furnace 604 where the material is heated and softened, and the leading end portion of the aforementioned material 601 to be formed moves in the downstream B direction of the transfer line, into the space between the dies 636*a*, 636*b* of the stentering press machine 634, and as it moves towards the downstream B side of the transfer line, the material 601 to be formed is pressed and formed in the direction of the plate width by the dies 636*a*, 636*b* of the stentering press machine 634 when the dies move towards the transfer line S, and as the material 601 to be formed then travels towards the downstream B side of the transfer line, the plate width of the entire length of the material 601 to be formed is reduced, and subsequently, portions of the material 601 to be formed, of which the plate width has been pressed completely by the stentering press machine 634, are inserted in sequence between the dies 605*a*, 605*b* of the plate reduction press machine 606 and pressed and formed in the direction of the plate thickness in the first step of reducing the plate thickness, and then the material is inserted between the work rolls 607*a*, 607*b* of the rough rolling mill 608 and the work rolls 607*a*, 607*b* of the rough rolling mill 609, where the second and third steps of reducing the plate thickness are carried out, in the same way as in the hot rolled steel sheet manufacturing apparatus shown in FIG. 29.

With the hot rolled steel sheet manufacturing apparatus shown in FIG. 30, as described above, the lateral cross section of the material 601 to be formed can be prevented from becoming a dog bone shape and will be free from fish tails in the plan view, so that the material 601 to be formed can be efficiently reduced and formed in the direction of the plate thickness, as in the case of the hot rolled steel sheet manufacturing apparatus shown in FIG. 29.

In addition, by means of the looper mechanism 610, differences in the operating speeds of the plate reduction press machine 606 and the rough rolling mill 608 can be compensated for when the material 601 to be formed is pressed and rolled to reduce the plate thickness in the first and second steps, respectively.

Fifteenth Illustrative Embodiment

Figure 31:
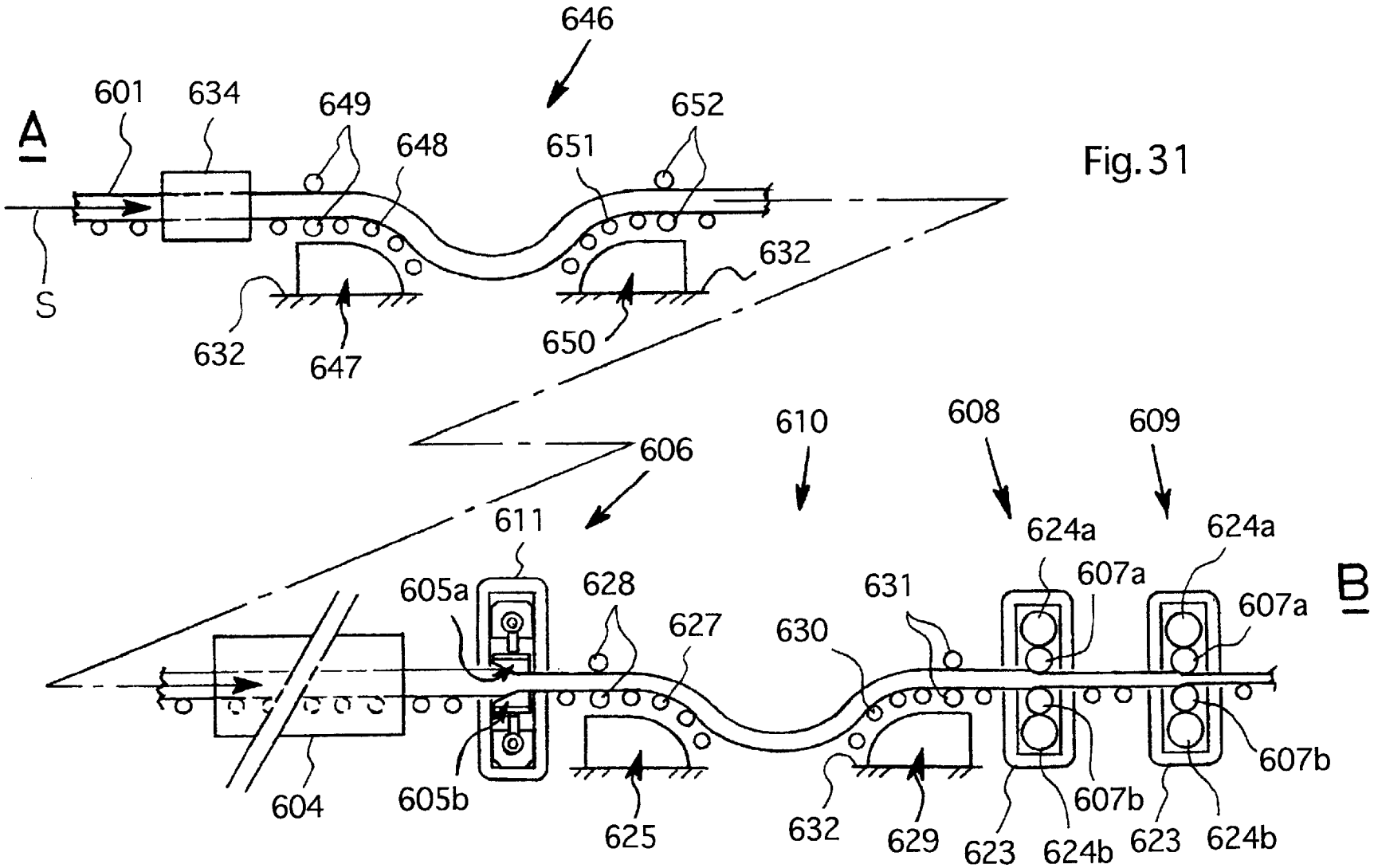
FIG. 31 is a schematic view showing the fifteenth illustrative embodiment of the hot rolled steel sheet manufacturing apparatus according to the present invention.

FIG. 31 shows the fifteenth illustrative embodiment of the hot rolled steel sheet manufacturing apparatus according to the present invention, and in the figure, the same item numbers are used to refer to the same components as in FIGS. 25 to 28.

In this hot rolled steel sheet manufacturing apparatus, in addition to the configuration of the hot rolled steel sheet manufacturing apparatus shown in FIG. 29, another looper mechanism 646 is provided between the stentering press machine 634 and the tunnel furnace 604 on the upstream A side of the transfer line.

The looper mechanism 646 is composed of an upstream table 647 arranged in the vicinity of the stentering press machine 634 on the transfer line, a plurality of upstream rollers 646 mounted on the aforementioned upstream table 647 in a manner such that the rollers can contact the bottom surface of the material 601 to be formed and the positions of the supports for the rollers become gradually lower in the downstream B direction of the transfer line, upstream pinch rolls 649 provided in the vicinity of the above-mentioned upstream table 646 on the transfer line and can grip and feed the material 601 to be formed in the direction of the plate thickness, a downstream table 650 installed in the vicinity of the tunnel furnace 604 on the upstream A side of the transfer line, downstream rollers 651 provided on the aforementioned downstream table 650 so that the rolls can contact the bottom surface of the material 601 to be formed and the positions of the supports for the rollers become gradually higher in the downstream B direction of the transfer line, and downstream pinch rolls 652 provided in the vicinity of the above-mentioned downstream table 650 on the downstream B side of the transfer line and can grip and feed the material 601 to be formed in the direction of the plate thickness.

The upstream table 647 is installed near the stentering press machine 634 on the downstream B side of the transfer line, and is provided with an upper surface shaped so that it gradually slopes downwards in the downstream B direction of the transfer line, and arranged and fixed at a predetermined location on the floor surface 632.

The upstream rollers 648 are mounted on the upper surface of the above-mentioned upstream table 647, and arranged such that the locations in which the rollers come in contact with and support the lower surface of the material 601 to be formed gradually slope downwards in the downstream B direction of the transfer line.

The downstream table 650 is provided in the vicinity of the tunnel furnace 604 on the upstream A side of the transfer line, and is provided with an upper surface shaped so that it gradually slopes upwards in the downstream B direction of the transfer line, and arranged and fixed at a predetermined location on the floor surface 632.

The downstream rollers 641 are mounted on the upper surface of the aforementioned downstream table 650, and arranged such that the locations in which the rollers contact the lower surface of the material 601 to be formed gradually slope upwards in the downstream B direction of the transfer line.

When a long material 601 to be formed is to be pressed and formed in the direction of the plate thickness using the hot rolled steel sheet manufacturing apparatus shown in FIG. 31, in the same way as with the hot rolled steel sheet manufacturing apparatus shown in FIG. 29, after the spacing between the left and right dies 636*a*, 636*b* of the stentering press machine 634, the spacing between the dies 605*a*, 605*b* of the plate reduction press machine 606, the vertical position of the upstream table 625 of the looper mechanism 610, and the spacing between the work rolls 607*a*, 607*b* of the rough rolling mills 608, 609 have been set, then the stentering press machine 634 and the plate reduction press machine 606 and the rough rolling mills 608, 609 are put into operation.

Thereafter, the leading end portion of the material 601 to be reduced and formed is inserted between the dies 636*a*, 636*b* of the stentering press machine 634, and moved in the downstream B direction of the transfer line, then the material 601 to be formed is pressed and formed in the direction of the plate width by the dies 636*a*, 636*b* of the stentering press machine 634 when the dies move towards the transfer line S, and as the material 601 to be formed then travels towards the downstream B side of the transfer line, the width of the entire length of the material 601 to be formed is reduced, and after that, the portion of the material 601 to be formed, the width of which has been pressed completely by the stentering press machine 634 is continuously fed into the tunnel furnace 604 through the other looper mechanism 646.

At this time, the looper mechanism 646 and the downstream pinch rolls 652 on the downstream side of the aforementioned looper mechanism 646 work substantially in the same way as the above mentioned looper mechanism 610 and the downstream pinch rolls 631 of the looper mechanism 610.

The leading end portion of the material 601 to be formed after being heated and softened by the tunnel furnace 604, is inserted between the dies 605*a*, 605*b* of the plate reduction press machine 606 through the looper mechanism 610 and is pressed and formed in the direction of the plate thickness, in the first step of reducing the plate thickness, and then the leading end portion is inserted between the work rolls 607*a*, 607*b* of the rough rolling mill 608, and the work rolls 607*a*, 607*b* of the rough rolling mill 609, in which the second and third steps of reducing the plate thickness are carried out, in the same way as in the hot rolled steel sheet manufacturing apparatus shown in FIG. 29.

As described above, using the hot rolled steel sheet manufacturing apparatus shown in FIG. 31, as in the case of the apparatus shown in FIG. 28, the cross section and the plan view of the material 601 to be formed can be prevented from becoming a dog bone shape and a fish tail shape, respectively.

Moreover, the hot rolled steel sheet manufacturing apparatus shown in FIG. 31 can efficiently press and form the material 601 to be formed in the direction of the plate thickness, and differences in the operating speeds of the plate reduction press machine 606 and the rough rolling mill 608 can be compensated for by the looper mechanism 610 when the press machine and the mill press and roll the plate thickness in the first and second steps of reducing the plate thickness, respectively.

In addition, the other looper mechanism 646 can also adjust for differences in the operating speeds of the stentering press machine 636 and the plate reduction press machine 606 when the machines press the plate width and the plate thickness of the material 601 to be formed, respectively.

Sixteenth Illustrative Embodiment

Figure 32:
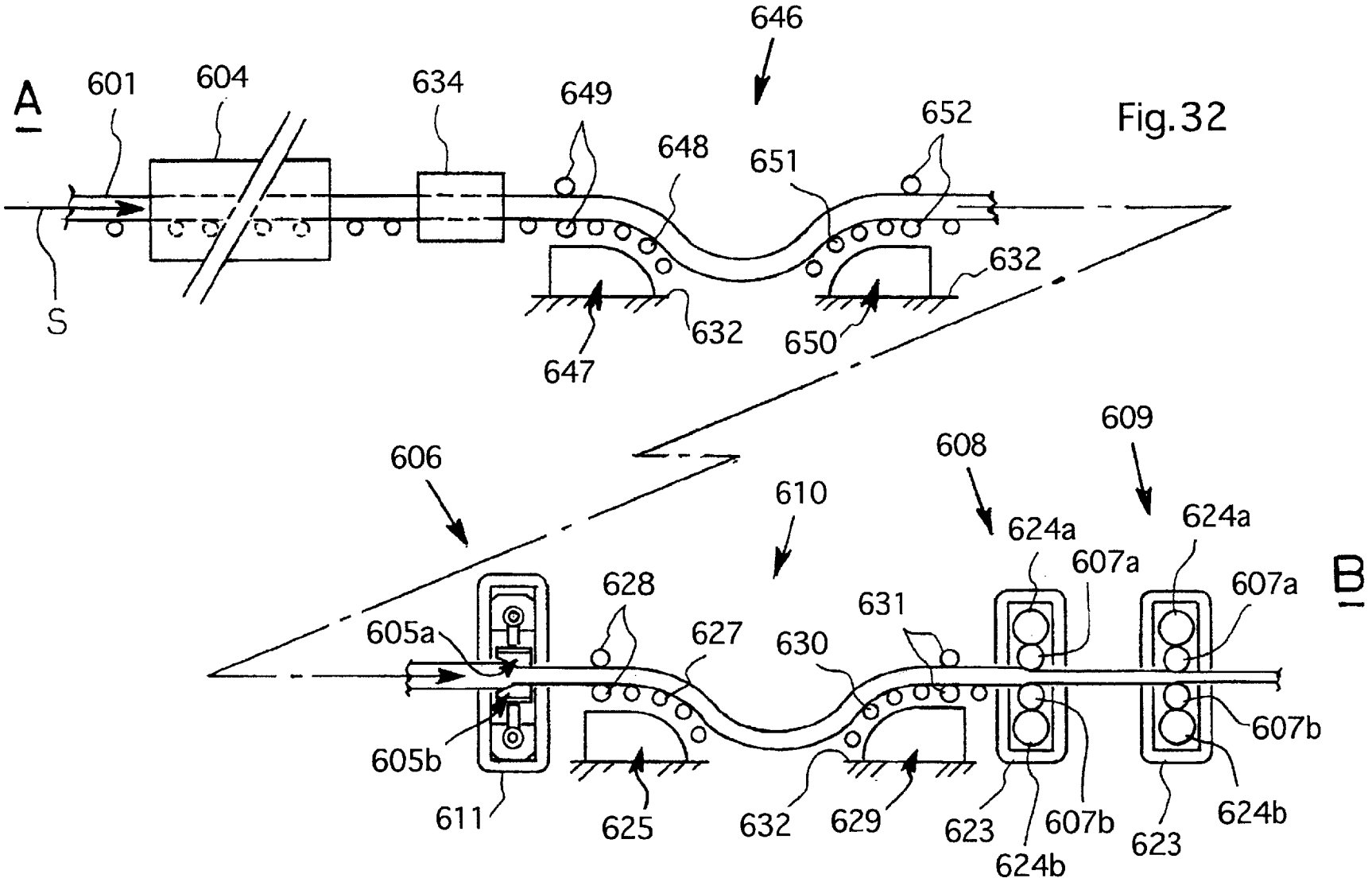
FIG. 32 is a schematic view showing the sixteenth illustrative embodiment of the hot rolled steel sheet manufacturing apparatus according to the present invention.

FIG. 32 shows the sixteenth illustrative embodiment of the hot rolled steel sheet manufacturing apparatus according to the present invention, and in the figure, the same item numbers are used to refer to the same components as in FIGS. 25 through 30.

In this configuration of the hot rolled steel sheet manufacturing apparatus, in addition to the components of the hot rolled steel sheet manufacturing apparatus shown in FIG. 30, another looper mechanism 646 is installed between the stentering press machine 634 installed on the downstream B side of the tunnel furnace 604 on the transfer line and the plate reduction press machine 606.

When a long material 601 to be formed is to be pressed and formed in the direction of the plate thickness with the hot rolled steel sheet manufacturing apparatus shown in FIG. 32, as in the case of the hot rolled steel sheet manufacturing apparatus shown in FIG. 30, after the spacing between the left and right dies 636*a*, 636*b* of the stentering press machine 634, the spacing between the dies 605*a*, 605*b* of the plate reduction press machine 606, the vertical position of the upstream table 625 of the looper mechanism 610, and the spacing between the work rolls 607*a*, 607*b* of the rough rolling mills 608, 609 have been set, then the stentering press machine 634 and the plate reduction press machine 606 and the rough rolling mills 608, 609 are put into operation.

Thereafter, the material 601 to be reduced and formed is fed from the upstream A side of the transfer line into the tunnel furnace 604 where the material is heated and softened, the leading end portion of the material 601 to be formed, after being heated and softened in the tunnel furnace 604, is inserted between the dies 636*a*, 636*b* of the stentering press machine 634 and moved towards the downstream B side of the transfer line, thus the material 601 to be formed is pressed and formed in the direction of the plate width by the dies 636*a*, 636*b* of the stentering press machine 636 when the dies move towards the transfer line S, and as the material 601 to be formed travels in the downstream B direction of the transfer line, the plate width of the entire length of the material 601 to be formed is reduced.

Next, the portions of the material 601 to be formed, of which the plate width has been pressed completely by the stentering press machine 634, are moved in sequence into the plate reduction press machine 606 through the other looper mechanism 646, then the first step of reducing the plate thickness is carried out and the plate thickness of the portion is reduced and formed by the dies 605*a*, 605*b* of the plate reduction press machine 606, and the leading end portion thereof is inserted between the work rolls 607*a*, 607*b* of the rough rolling mill 608 after pressing through the looper mechanism 610, and the second step of reducing the plate thickness is carried out, and then the third step of reducing the plate thickness is performed by means of the work rolls 607*a*, 607*b* of the rough rolling mill 609, using the same procedures as those of the hot rolled steel sheet manufacturing apparatus shown in FIG. 30.

Thus, with the hot rolled steel sheet manufacturing apparatus shown in FIG. 32, the lateral cross section and the shape in plan view of the material 601 to be formed can be prevented from becoming a dog bone shape and fish tail shape, respectively, as in the case of the hot rolled steel sheet manufacturing apparatus shown in FIG. 30.

In addition, the material 601 to be formed can be efficiently pressed and formed in the direction of the plate thickness, and by using the looper mechanism 610, differences in the operating speeds of the plate reduction press machine 606 and the rough rolling mill 608 can be compensated for when they press the material in the first and second steps of reducing the plate thickness, respectively Furthermore, the other looper mechanism 646 can adjust for differences in the operating speeds of the stentering press machine 634 and the plate reduction press machine 606 when the former reduces the plate width of the material 601 to be formed and the latter presses the plate thickness thereof in the first step.

Therefore, according to the hot rolled steel sheet manufacturing methods and apparatus of the present invention, the following excellent effects can be achieved.

(1) In the hot rolled steel sheet manufacturing methods specified in the thirty-fourth through the thirty-seventh preferred embodiments of the present invention, a material to be formed can be reduced and formed efficiently in the direction of the plate thickness, because an unreduced, unformed portion of the material, heated to a predetermined temperature, is reduced and formed using upper and lower dies in the direction of the plate thickness, and then the reduced and formed portion of the aforementioned material to be formed is further reduced and formed by a plurality of upper and lower work rolls in the direction of the plate thickness.

(2) In the hot rolled steel sheet manufacturing methods described in the thirty-fourth through the thirty-sixth preferred embodiments according to the present invention, differences in the operating speeds of the dies for reducing and forming the plate thickness and the work rolls for reducing the plate thickness of a material to be formed can be compensated for because a slack portion of the material to be formed is provided by an appropriate downward deflection between the dies for reducing and forming the plate thickness and the work rolls located in the close vicinity of the above-mentioned dies, when both the dies and the rolls are reducing the plate thickness of the material.

(3) In the hot rolled steel sheet manufacturing method according to the thirty-seventh preferred embodiment of the represent invention, differences in the operating speeds of the dies for reducing and forming the plate width and the other dies for reducing and forming the plate thickness of a material to be formed, can be compensated for by a slack portion of the material to be formed provided by an appropriate downward deflection between the dies for reducing and forming the plate width and the other dies for reducing and forming the plate thickness, when both of the dies are reducing the plate width and the plate thickness, respectively, of the material to be formed.

(4) In any of the hot rolled steel sheet manufacturing apparatus described in preferred embodiments thirty-eight through forty-two according to the present invention, a material to be formed can be efficiently reduced and formed in the direction of the plate thickness, because the plate thickness of the material to be formed, heated by the tunnel furnace, is pressed sequentially by the dies of a plate reduction press machine and the work rolls of a plurality of rough rolling mills.

(5) In any of the hot rolled steel sheet manufacturing apparatus according to preferred embodiments thirty-eight through forty-two of the present invention, differences in the operating speeds of the plate reduction press machine and the rough rolling mill, are compensated for by means of the looper mechanism provided between the plate reduction press machine and the upstream rough rolling mill on the transfer line, in which a slack portion of the material to be formed is provided in a downward deflection, when both the press machine and the rolling mill are reducing the plate thickness of the material to be formed.

(6). In the hot rolled steel sheet manufacturing apparatus according to the forty-first preferred embodiment of the present invention, another looper mechanism is installed between the stentering press machine and the tunnel furnace, or between the tunnel furnace and the plate reduction press machine, in which differences in the operating speeds of the stentering press machine and the plate reduction press machine can be compensated for by providing a slack portion of the material to be formed in a downward deflection when the machines are pressing the plate width and the plate thickness, respectively, of the material to be formed.

(7) In the hot rolled steel sheet manufacturing apparatus according to the forty-second preferred embodiment of present invention, differences in the operating speeds of the stentering press machine and the plate reduction press machine can be compensated for by the other looper mechanism installed between the stentering press machine and the plate reduction press machine, in which a slack portion of the material to be formed is retained in a downward deflection when the machines are reducing the plate width and the plate thickness, respectively, of the material to be formed.

Seventeenth Illustrative Embodiment

Figure 33:
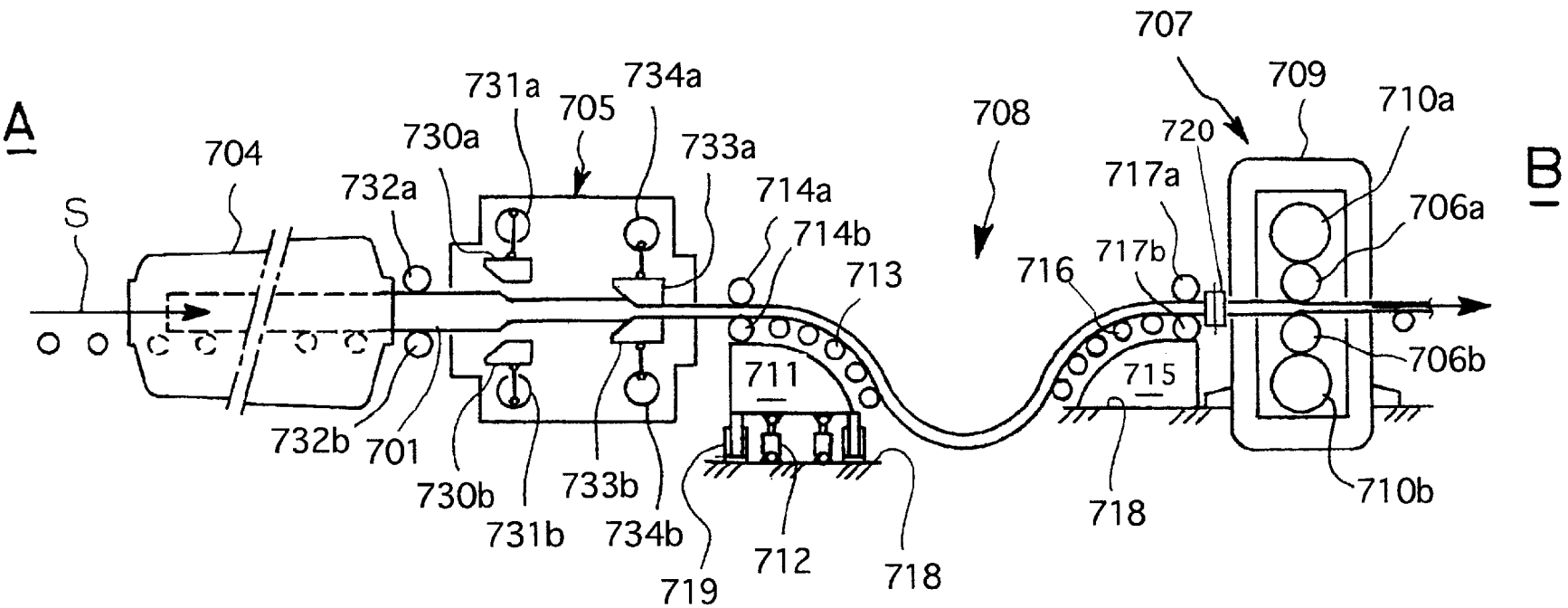
FIG. 33 is a schematic view showing the seventeenth illustrative embodiment of the hot rolled steel sheet manufacturing apparatus according to the present invention.

FIG. 33 shows the seventeenth illustrative embodiment of the hot rolled steel sheet manufacturing apparatus according to the present invention; a temperature holding and heating furnace 704 is arranged at a predetermined location on the upstream A side of the transfer line for heating a material to be formed, and a plate reduction press machine 705 is installed on the downstream B side of the aforementioned holding and heating furnace 704 on the transfer line, and is provided with upstream dies 730*a*, 730*b* and downstream dies 733*a*, 733*b* arranged in series in the direction of the transfer line, opposite each other above and below the transfer line S and capable of pressing the material 701 to be formed in the direction of the plate thickness, and on the downstream B side of the above-mentioned plate reduction press machine 705 on the transfer line, is installed a rough rolling mill 707 provided with work rolls 706*a*, 706*b* that face each other above and below the transfer line S and can press the material 701 to be formed in the direction of the plate thickness, and a looper mechanism 708 in which a slack portion of the material 701 to be formed is retained in a downward deflection is installed between the aforementioned plate reduction press machine 705 and the rough rolling mill 707.

The holding and heating furnace 704 is configured so that the material 701 to be formed which is inserted from the upstream A side of the transfer line into the holding and heating furnace 704 and travels at a speed of 3 to 15 m/minute can be held at a hot processing temperature (about 600 to 750° C.).

The plate reduction press machine 705 is provided with a first-pressing mechanism 731*a* that moves the upstream die 730*a* located above the transfer line S towards and away from a material 701 to be formed, a second pressing mechanism 731*b* that moves the upstream die 730*b* located below the transfer line S towards and away from the material 701 to be formed, a third pressing mechanism 734*a* that moves the downstream die 733*a* located above the transfer line S towards and away from the material 701 to be formed, and a fourth pressing mechanism 734*b* that moves the downstream die 733*b* located below the transfer line S towards and away from the material 701 to be formed.

These pressing mechanisms 731*a*, 731*b*, 734*a*, and 734*b* are composed of crank shafts extending substantially horizontally in the direction orthogonal to the transfer line S, rods that transmit the displacements of the eccentric portions of the above-mentioned crank shafts to the dies 730*a*, 730*b*, 733*a*, 733*b*, etc.

The crank shafts of the pressing mechanisms 731*a*, 731*b*, 734*a*, and 734*b* are constructed so that the positions thereof can be adjusted upwards and downwards.

In addition, pinch rolls 732*a*, 732*b* that can grip and hold the material 701 to be formed in the direction of the plate thickness are provided on the upstream A side of the plate reduction press machine 705 on the transfer line.

With this plate reduction press machine 705, when the upstream dies 730*a*, 730*b* approach the material 701 to be formed in synchronism with each other, the downstream dies 733*a*, 733*b* move away from the material 701 to be formed in synchronism with each other, and when the downstream dies 733*a*, 733*b* approach the material 701 to be formed in synchronism, the upstream dies 730*a*, 730*b* move away from the material 701 to be formed in synchronism, according to the configuration of the drive system provided for the pressing mechanisms 731*a*, 731*b*, 734*a*, and 734*b*.

Hence, the upstream dies 730*a*, 730*b* and the downstream dies 733*a*, 733*b* alternately reduce and form the material 701 to be formed, and consequently, the pressing load applied to each of the dies 730*a*, 730*b*, 733*a*, and 733*b* can be reduced.

The rough rolling mill 707 is composed of a pair of work rolls 706*a*, 706*b*, backup rolls 710*a*, 710*b*, housing 709, etc.

Other items of equipment installed on the downstream B side of the rough rolling mill 707 on the transfer line are downstream equipment such as an intermediate coiler, joining device and finish rolling mills.

The looper mechanism 708 is provided with an upstream table 711 installed near the plate reduction press machine 705 on the downstream B side of the transfer line, hydraulic cylinders 712 that raise and lower the above-mentioned upstream table 711, a plurality of upstream rollers 713 mounted on the aforementioned upstream table 711 so that the rollers can contact the bottom surface of the material 701 to be formed and the locations at which they support the material gradually slope downwards in the downstream B direction of the transfer line, upstream pinch rolls 714*a*, 714*b* provided in the vicinity of the above-mentioned upstream table 711 on the upstream A side of the transfer line that can grip the material 701 to be formed in the direction of the plate thickness and move it, a downstream table 715 arranged near the rough rolling mill 707 on the upstream A side of the transfer line, a plurality of downstream rollers 716 installed on the above-mentioned downstream table 715 such that the rollers can contact the bottom surface of the material 701 to be formed and the locations at which they support the material gradually slope upwards in the downstream B direction of the transfer line, and downstream pinch rolls 717*a*, 717*b* provided near the aforementioned downstream table 715 on the downstream B side of the transfer line to grip the material 701 to be formed in the direction of the plate thickness and move it.

The upstream table 711 is provided with an upper surface that is shaped so that it gradually slopes downwards in the downstream B direction of the transfer line, and can be moved up and down along a plurality of guide members 719 installed at predetermined locations on the floor surface 718.

The cylinder portions of the hydraulic cylinders 712 are supported on the floor surface 718 near the above-mentioned guide members 719 through bearings, and are arranged so that the tips of the piston rods support the lower surface of the upstream table 711 through bearings, and by applying hydraulic pressure to the rod side hydraulic chambers and the head side hydraulic chambers of the hydraulic cylinders 712 as appropriate, the upstream table.711 is moved up and down.

The downstream table 715 is provided with an upper surface that is shaped so that it gradually slopes upwards in the downstream B direction of the transfer line, and is fixed on the floor surface 718.

In addition, a pair of edger rolls 720 are installed between the aforementioned downstream pinch rolls 717*a*, 717*b* and the rough rolling mill 707, so that the edger rolls face each other in the lateral direction on opposite sides of the transfer line S and can press the lateral edges of the material 701 to be formed by means of an actuator (not illustrated).

The operation of the hot rolled steel sheet manufacturing apparatus shown in FIG. 33 is described below.

When a long material 701 to be formed is to be reduced and formed in the direction of the plate thickness, the spacing between the upstream dies 730*a*, 730*b* and the spacing between the downstream dies 733*a*, 733*b* of the plate reduction press machine 705 are set according to the plate thickness of the material 701 to be reduced and formed by adjusting the vertical positions of the crank shafts of the pressing mechanisms 731*a*, 731*b*, 734*a*, and 734*b* of the plate reduction press machine 705.

In addition, the upstream table 711 is raised and lowered by applying hydraulic pressures as appropriate to the rod side and head side hydraulic chambers of the hydraulic cylinders 712 that support the upstream table 711, thereby the vertical position of the upstream table 711 is set in such a manner that the vertical position of the upstream pinch rolls 714 provided on the upstream table 711 is suitable for the pinch rolls to grip the end portion of the material 701 whose plate thickness has been reduced and which is fed out of the plate reduction press machine 705, in the downstream B direction of the transfer line.

Furthermore, the spacing between both work rolls 706*a*, 706*b* of the rough rolling mill 707 is set according to the plate thickness of the material 701 after it has been reduced by and fed out of the plate reduction press machine 705, and the amount of reduction of the plate thickness by the rough rolling mill 707.

Next, the material 701 to be formed, which has been maintained in the holding and heating furnace 704 at a hot processing temperature, is reduced and formed by the upstream dies 730*a*, 730*b* and the downstream dies 733*a*, 733*b* of the plate reduction press machine 705.

In this process, because the upstream dies 730*a*, 730*b* and the downstream dies 733*a*, 733*b* reduce and form the material 701 to be formed alternately, the pressing loads which have to be applied to each of the dies 730*a*, 730*b*, 733*a*, and 733*b*, to reduce the plate thickness of the material 701 to be formed, can be made smaller.

The portion of the material 701 to be formed, whose plate thickness has been reduced by the plate reduction press machine 705, is reduced and formed by the work rolls 706*a*, 706*b* of the rough rolling mill 707 after pressing through the upstream pinch rolls 714*a*, 714*b* and the downstream pinch rolls 717*a*, 717*b* of the looper mechanism 708.

When the plate thickness is reduced by the plate reduction press machine 705, a mass flow phenomenon occurs resulting in the material being extended and forced forwards in the downstream B direction of the transfer line, then the lower surface of the portion of the material 701 to be formed located between the plate reduction press machine 705 and the rough rolling mill 707 is supported by the upstream rollers 713 arranged along the upper surface of the upstream table 711 and the downstream rollers 716 arranged along the upper surface of the downstream table 715, therefore the portion of the material 701 to be formed which is forced forwards, is retained between the plate reduction press machine 705 and the rough rolling mill 707.

In addition, the upstream table 711 is raised and lowered by the hydraulic cylinders 712, thereby the vertical positions of the upstream pinch rolls 714*a*, 714*b* and the upstream rollers 713 are adjusted, so that the material 701 to be formed, when it leaves the plate reduction press machine 705, can be prevented from bending upwards or downwards.

In the hot rolled steel sheet manufacturing apparatus shown in FIG. 33 as described above, an unreduced and unformed portion of the material 701 to be formed is reduced and formed in the direction of the plate thickness by the upstream dies 730*a*, 730*b* of the plate reduction press machine 705, and then the portion of the aforementioned material 701 to be formed, which has been reduced in the direction of the plate thickness, is further reduced and formed by the downstream dies 733*a*, 733*b* of the plate reduction press machine 705 in the direction of the plate thickness, and then the portion of the material 701 to be formed, whose plate thickness has finished being reduced by the plate reduction press machine 705, is pressed and formed by the work rolls 706*a*, 706*b* of the rough rolling mill 707, so the material 701 to be formed can be efficiently reduced and formed in the direction of the plate thickness.

According to the hot rolled steel sheet manufacturing methods and apparatus of the present invention as described above, the following preferred advantages can be offered.

(1) According to the hot rolled steel sheet manufacturing method according to the forty-third preferred embodiment of the present invention, an unreduced portion of a material to be formed is pressed in the direction of the plate thickness alternately by a plurality of dies arranged in the direction of the transfer line, so the pressing load applied to each die can be reduced.

(2) According to the hot rolled steel sheet manufacturing method according to the forty-third preferred embodiment of the present invention, the material to be formed, the plate thickness of which has been reduced by a plurality of dies, is further pressed by work rolls in the direction of the plate thickness, so that the material to be formed can be efficiently reduced and formed in the direction of the plate thickness.

(3) Using the hot rolled steel sheet manufacturing method according to the forty-third preferred embodiment of the present invention, an appropriate slack portion of the material to be formed, after being pressed and formed by dies, is deflected downwards between the dies and the work rolls located farther downstream on the transfer line, therefore the portion of the material to be formed, which is forced forwards when pressed by the dies, can be absorbed.

(4) In any of the hot rolled steel sheet manufacturing apparatus according to the forty-fourth or the forty-fifth preferred embodiments of the present invention, the material to be formed, after being heated by the holding and heating furnace, is pressed alternately in the direction of the plate thickness by a plurality of dies arranged along the transfer line in the plate reduction press machine, thereby the pressing load which has to be applied to each die can be reduced.

(5) According to the hot rolled steel sheet manufacturing apparatus according to the forty-fourth or the forty-fifth preferred embodiments of the present invention, the material to be formed, the plate thickness of which has been reduced by the plate reduction press machine, is further pressed and formed in the direction of the plate thickness by the rough rolling mill, so that the material to be formed can be efficiently reduced and formed in the direction of the plate thickness.

(6). In the hot rolled steel sheet manufacturing apparatus according to either the forty-fourth or the forty-fifth preferred embodiments of the present invention, a slack portion of the material to be formed, whose plate thickness has been reduced by the plate reduction press machine, is deflected downwards by the looper mechanism located between the plate reduction press machine and the rough rolling mill, so the portion of the material to be formed, which is forced forwards when being pressed by the plate reduction press machine can be absorbed.

(7) According to the hot rolled steel sheet manufacturing apparatus according to the forty-fifth preferred embodiment of the present invention, the upstream rollers and the upstream pinch rolls are raised and lowered together with the upstream table, consequently the material to be formed, when fed out of the plate reduction press machine can be prevented from being bent upwards or downwards.

Eighteenth Illustrative Embodiment

Figure 34:
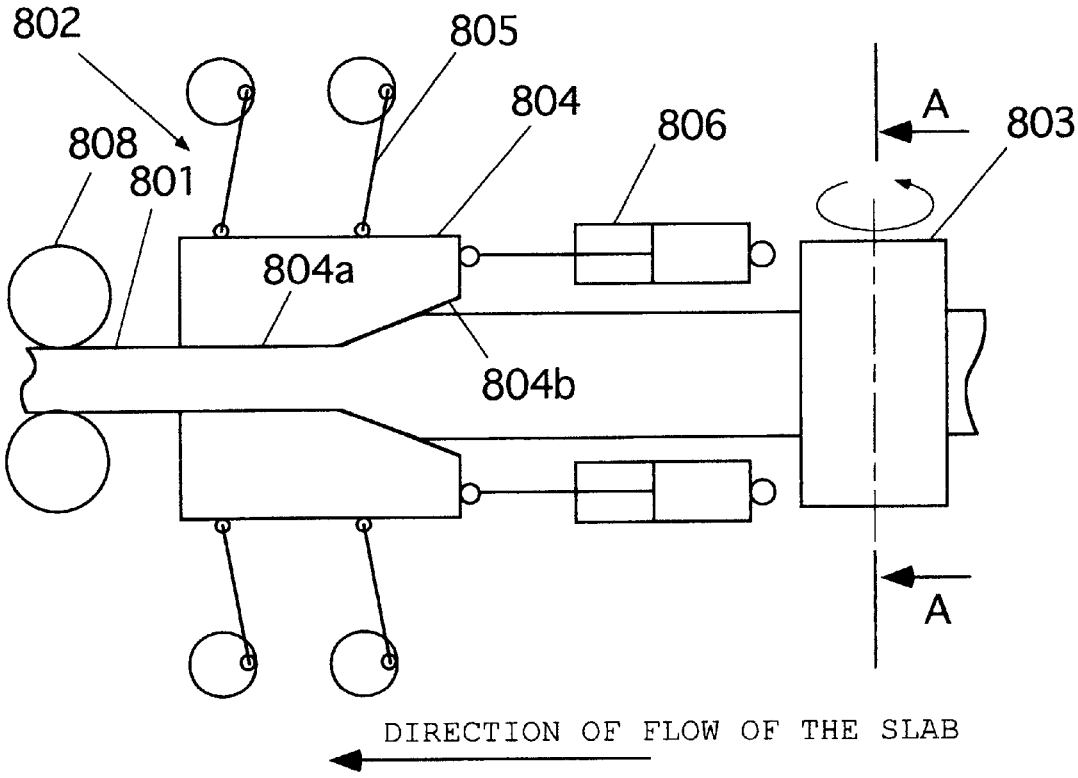
FIG. 34 shows the configuration of the eighteenth illustrative embodiment of the hot rolled steel sheet manufacturing apparatus according to the present invention.
Figure 35:
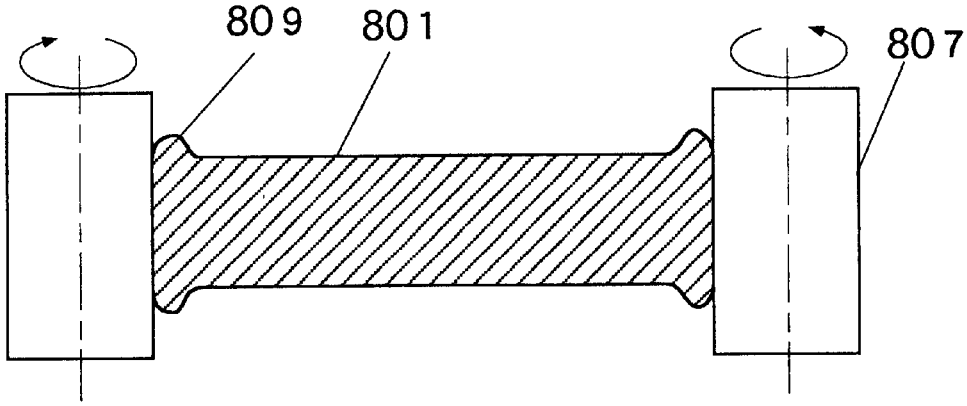
FIG. 35 is a sectional view along the line A—A in FIG. 34.

FIG. 34 shows the configuration of the hot rolled steel sheet manufacturing apparatus of the eighteenth illustrative embodiment according to the present invention, and FIG. 35 is a sectional view along the line A—A in FIG. 34. The rough pressing apparatus is composed of a high-reduction press machine 802 that is arranged along the direction of flow of a slab 801 and highly reduces the thickness thereof, for instance, by an amount of reduction of 50 mm or more, and an edger 803 installed at the inlet of the press machine. The high-reduction press machine 802 is provided with dies 804 with parallel surfaces 804*a* which are parallel to the upper and lower surfaces of the slab 802, and sloping surfaces 804*b* inclined towards the inlet of the dies, pressing mechanisms 805 that periodically press the dies 804 in the upward and downward direction, and reciprocating mechanisms 806 for moving the dies 804 and the pressing mechanisms 805 backwards and forwards in the direction of flow of the slab 801. Although crank mechanisms are shown as typical pressing mechanisms 805, other mechanisms such as hydraulic cylinders can also be used. In addition, the hydraulic cylinders shown schematically as the reciprocating mechanisms can be replaced by other mechanisms, e.g. crank mechanisms. The edger 803 is composed of a pair of cylindrical rolls 807 that rotate while pressing the slab 801 in the lateral direction. The cylindrical rolls are rotated by driving devices not illustrated, as shown by the arrows so as to press the slab 801 laterally while also feeding the slab in the direction of flow of the slab. The pinch rolls 808 transfer the slab 801 in its direction of flow.

Next, the operation is described below. During the time when the dies 804 are not pressing, the dies 804 are moved away from the slab 801, the slab 801 is conveyed in the direction of flow of the slab at a predetermined speed by the pinch rolls 808, and the cylindrical rolls 807 of the edger 803 rotate according to the speed at which the slab 801 is being fed and conveyed. During pressing, the dies 804 are moved by the reciprocating mechanisms 806 at the speed at which the slab 801 is being conveyed, thus the slab 801 is transferred at the same time as it is being pressed. A volume of material, corresponding to the amount by which the slab has been pressed and thinned, flows in the forward direction of the flow of the slab, in the reverse direction thereto, and laterally, and of the speeds of these flows of slab material, the speed in which the slab flows in the reverse direction to the direction of transferring the slab is called the backward speed. The cylindrical rolls 807 feed the slab 801 at the slab transfer speed minus the backward speed.

Because both edges of the slab 801 are pressed by the cylindrical rolls 807 in the direction of the plate width, the width of the slab can be adjusted to a predetermined dimension. In addition, although the built up portions 809 are produced at both edges of the slab 801 as shown in FIG. 35, these build-ups are different from the swollen portions 822 described in FIG. 9, in that voids etc. produced inside the material are compressed during pressing and prevented from causing cracks (called the forging effect), therefore no cracks or flaws are created. As there are sloping surfaces 804 at the inlet of the dies 804, slipping between the slab 801 and the dies 804 could sometimes occur during pressing, however, such slipping is prevented by the action of the edger 803 which feeds the slab. In addition, this feeding action can feed the slab 801 into the high-reduction press machine 802.

Nineteenth Illustrative Embodiment

Figure 36:
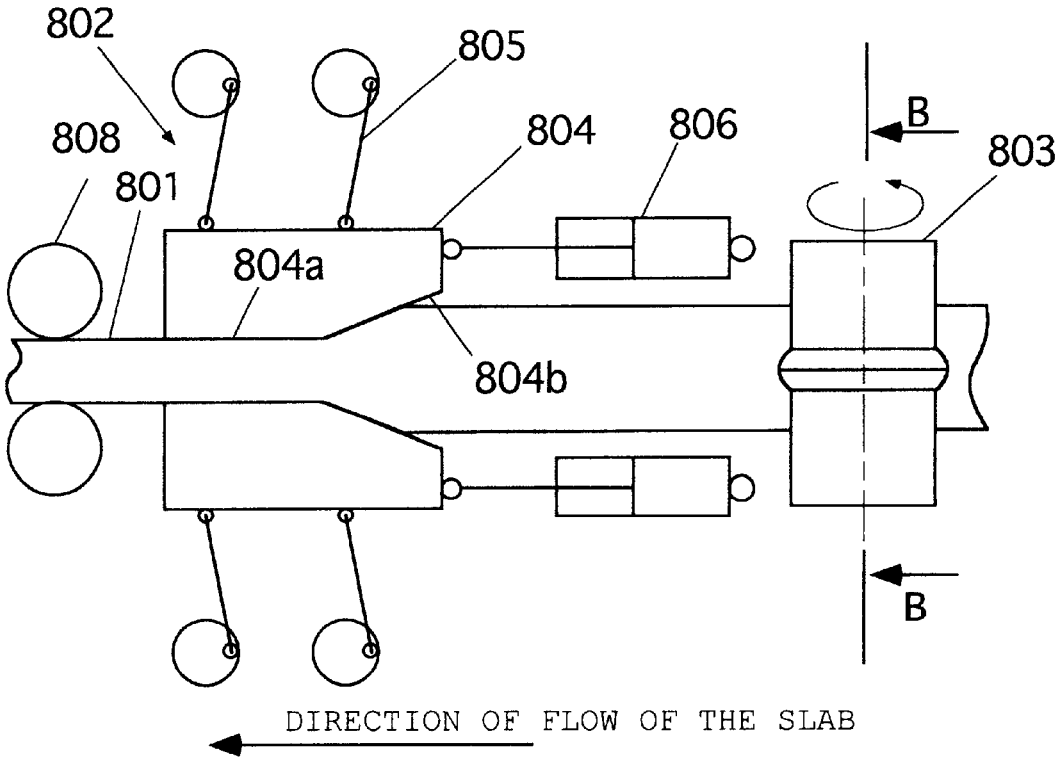
FIG. 36 shows the configuration of the nineteenth illustrative embodiment of the hot rolled steel sheet manufacturing apparatus according to the present invention.
Figure 37:
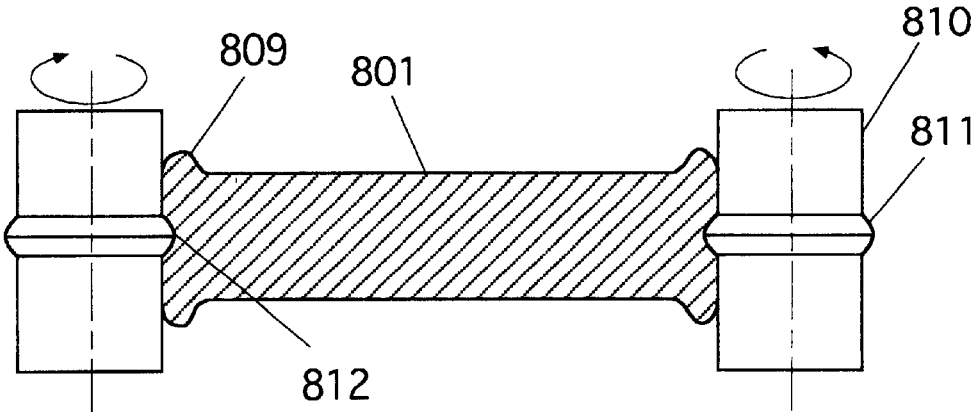
FIG. 37 is a sectional view along the line B—B in FIG. 36.

Next, the nineteenth illustrative embodiment is described below. FIG. 36 shows the configuration of the nineteenth embodiment, and FIG. 37 is a sectional view along the line B—B in FIG. 36. This illustrative embodiment has the same configuration as that of the eighteenth illustrative embodiment, except that the cylindrical rolls 810 have triangular-shaped circumferential protrusions 811 on the center portions of the cylindrical rolls 807 as shown in FIG. 34. These protrusions 811 produce the recesses 812 in the shape of the surfaces of both edges of the slab 801, and material flows into the recesses 812 when the build-ups 809 are pressed by the high-reduction press machine 802, so that preferred results can be obtained from the pressing operation.

Twentieth Illustrative Embodiment

Figure 38:
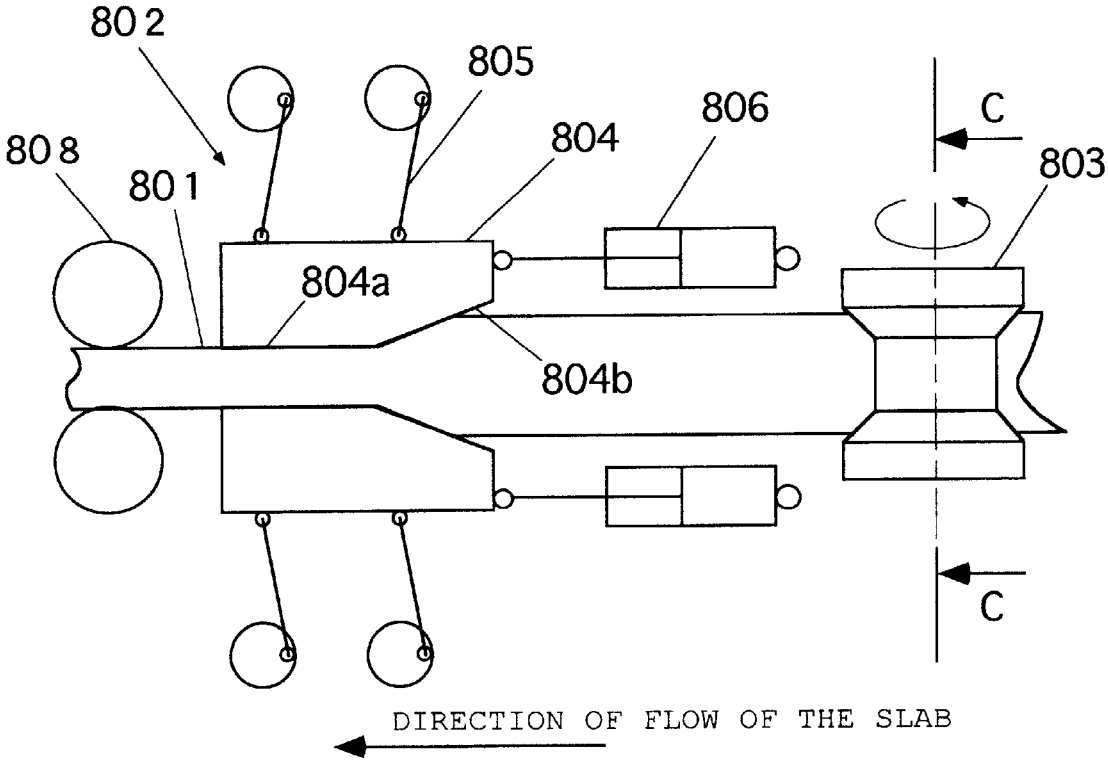
FIG. 38 shows the configuration of the twentieth illustrative embodiment of the hot rolled steel sheet manufacturing apparatus according to the present invention.
Figure 39:
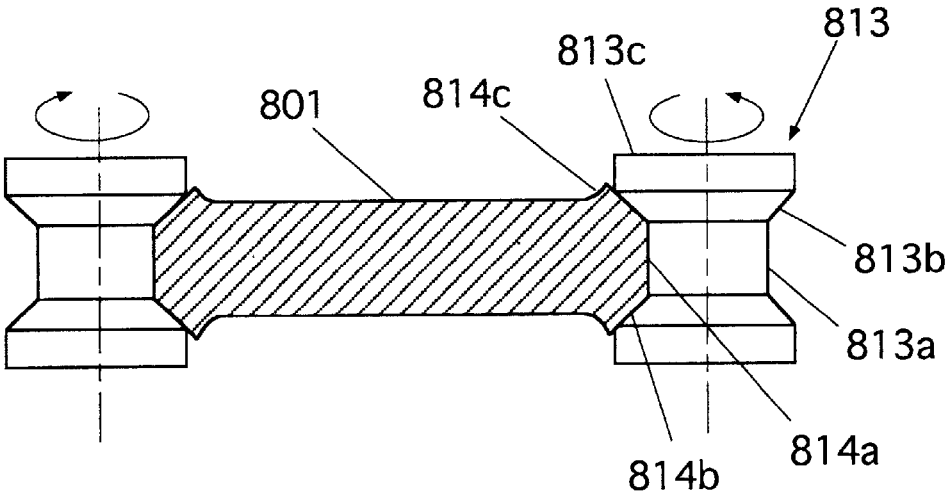
FIG. 39 is a sectional view along the line C—C in FIG. 38.

Next, the twentieth illustrative embodiment is described in the following paragraphs. FIG. 38 shows a configuration of the twentieth embodiment, and FIG. 39 is a sectional view along the line C—C in FIG. 38. The configuration of this embodiment is the same as that of the eighteenth embodiment, except that bobbin-shaped rolls 813 are used in place of the cylindrical rolls 807 in FIG. 34. Each bobbin-shaped roll 813 is composed of a central cylindrical portion 813*a*, tapering portions 813*b* connected to both ends of the central cylindrical portion 813*a* and sloping outwards, and outer cylindrical portions 813*c* connected to the outer peripheries of the tapering portions 813*b*. The surfaces of both edges of the slab 801 are formed into vertical surfaces 814*a* by the central cylindrical portions 813*a*, and shaped into inclined surfaces 814*b* by the tapering portions 813 therefore the build-ups 814*c* are less than those of the eighteenth and nineteenth embodiments. The occurrence of cracks can be prevented by these inclined surfaces 814*b*.

Twenty-first Illustrative Embodiment

Figure 40:
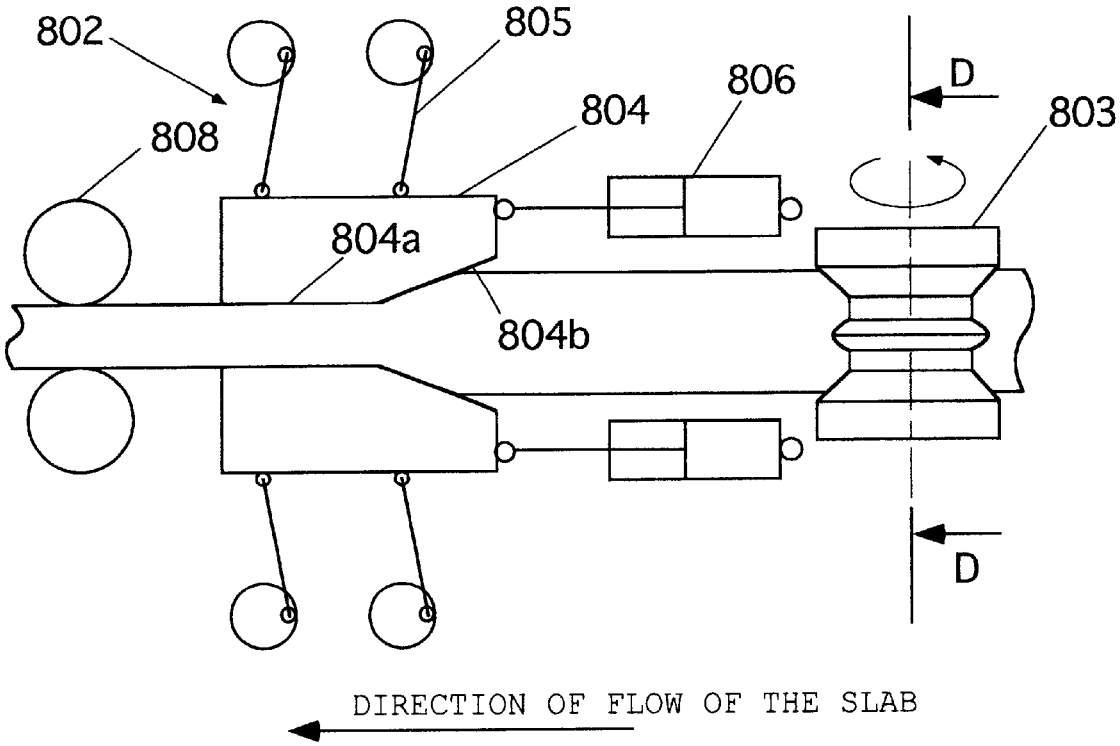
FIG. 40 shows the configuration of the twenty-first illustrative embodiment of the hot rolled steel sheet manufacturing apparatus according to the present invention.
Figure 41:
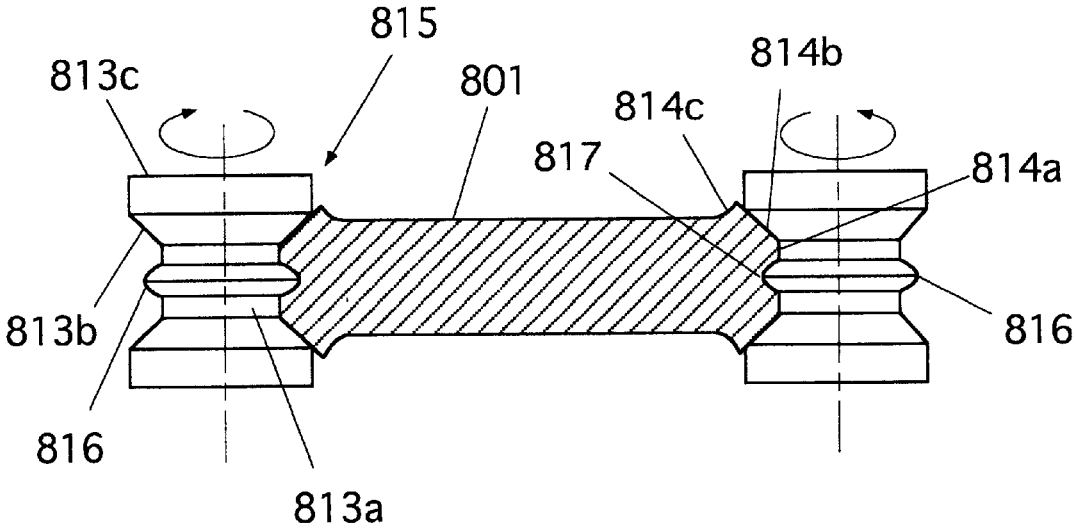
FIG. 41 is a sectional view along the line D—D in FIG. 40.

Next, the twenty-first illustrative embodiment is described. FIG. 40 shows the configuration of the twenty-first illustrative embodiment, and FIG. 41 is a sectional view along the line D—D shown in FIG. 40. This illustrative embodiment is the same as that of the twentieth illustrative embodiment except that the bobbin-shaped rolls 815 have protrusions 816 with a triangular cross section on the peripheries of the central cylindrical portions 813*a* of the bobbin-shaped rolls 813 shown in FIG. 38. These protrusions 816 produce recesses 817 in the surfaces of both lateral edges of slab 801, therefore when the build-ups 814*c* are pressed by the high-reduction press machine 802, part of the material flows into these recesses 817, and in consequence, the pressing operation achieves a preferred result.

The descriptions for the above seventeenth to twenty-first illustrative embodiments relate to the case in which the high-reduction press machine 802 is installed downstream of the edger 803, however a high-reduction mill can also be used in place of the high-reduction press machine 802 with the same effect. A high-reduction mill means a mill that can press work by more than 50 mm in one mill.

Obviously from the explanations given above, the present invention provides the following advantages by stalling an edger at the inlet of a high-reduction press machine or a high-reduction mill.

(1) Compared to the case in which a single high-reduction press machine or high-reduction mill is used, racks at the edges can be prevented completely.

(2) The width of a slab can be adjusted.

(3) A slab can be pushed into a press machine or mill.

(4) Slipping between a press die or mill roll can be prevented.

Twenty-second Illustrative Embodiment

Figure 42A:
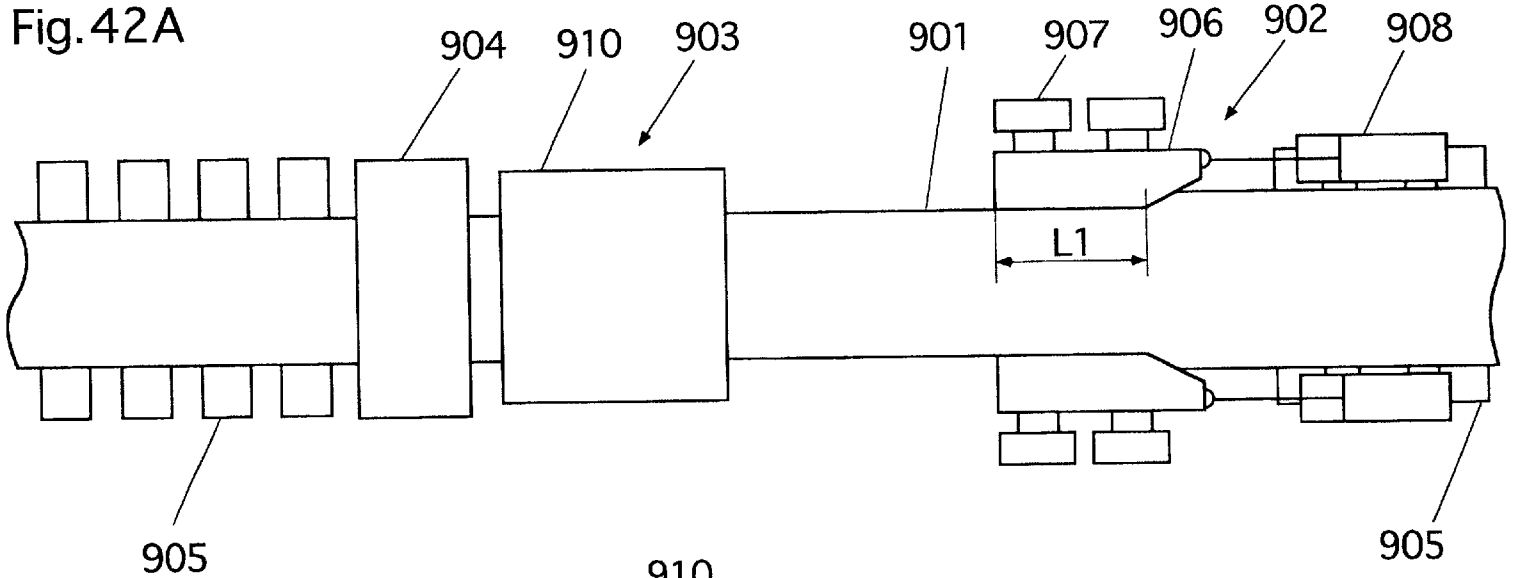
FIG. 42A is a plan view of the twenty-second illustrative embodiment of the hot rolled steel sheet manufacturing apparatus according to the present invention.
Figure 42B:
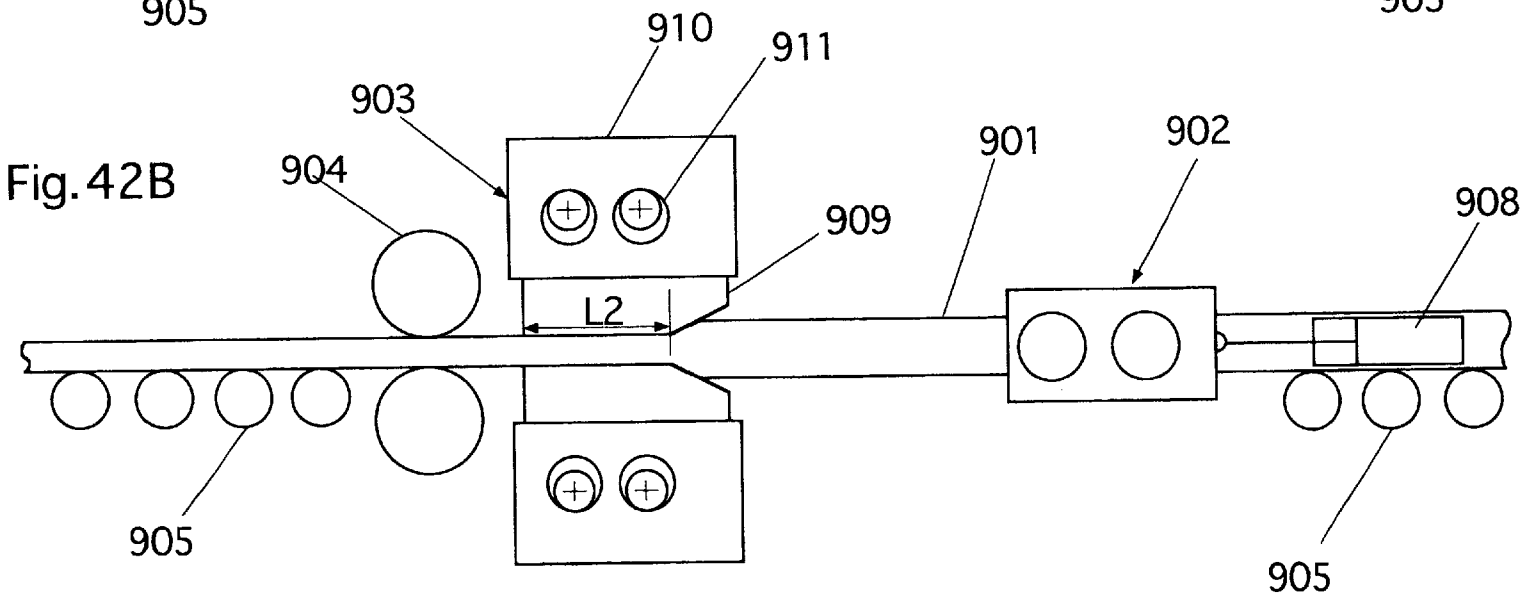
FIG. 42B is a side view of FIG. 42A.

FIG. 42 shows the configuration of the twenty-second illustrative embodiment of the hot rolled steel sheet manufacturing apparatus according to the present invention. (A) and (B) show a plan view and a side view, respectively. Starting from the upstream end, a stentering press machine 902 and a thickness press machine 903 are arranged along the length of a slab 901. Pinch rolls 904 are provided at the outlet of the thickness press machine 903, and control the transfer speed of the slab 901. A transfer table 905 is arranged on the upstream side of the stentering press machine 902 and together with the pinch rolls 904 in the downstream direction, is used to transfer the slab 901.

The stentering press machine 902 is composed of stentering press dies 906, stentering press cylinders 907 that press the stentering press dies 906 in the lateral direction of the slab 901, and stentering press transfer cylinders 908 for transferring the stentering press dies 906 and the stentering press cylinders 907 in the direction of flow of the slab, and these components 906, 907 and 908 are provided on both sides of the slab 901. The thickness press machine 903 is comprised of press dies 909 and sliders 910 that press these press dies 909 in the direction of the thickness of the slab 901, and these components 909 and 910 are installed above and below the slab 901. Each slider 910 has a large mass and is moved up and down and backwards and forwards (direction of flow of the slab) by the cranks 911.

Figure 43:
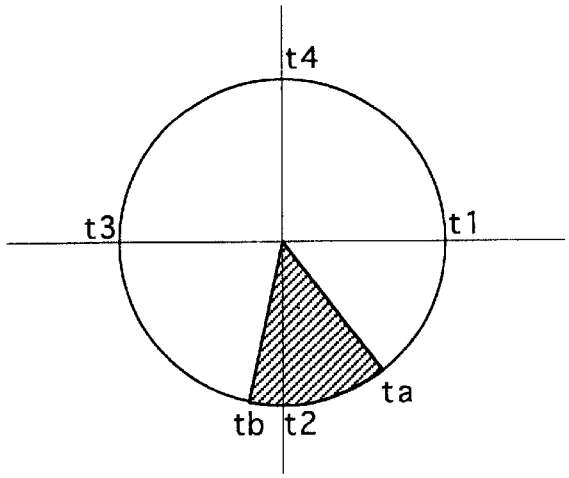
FIG. 43 is a diagram showing the operation of one cycle of a stentering press apparatus.
Figure 44:
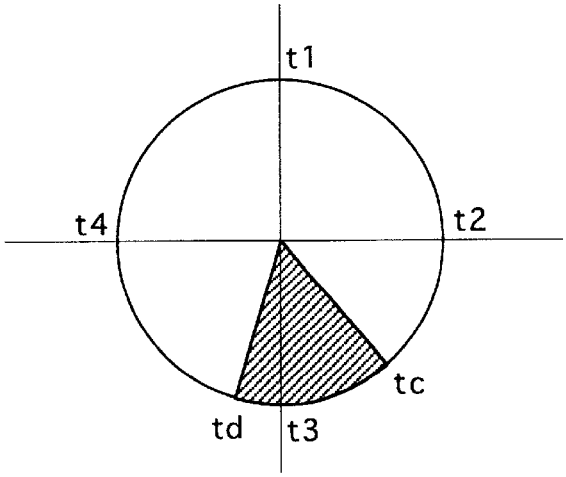
FIG. 44 is a diagram showing the operation of one cycle of a plate reduction press apparatus.
Figure 45:
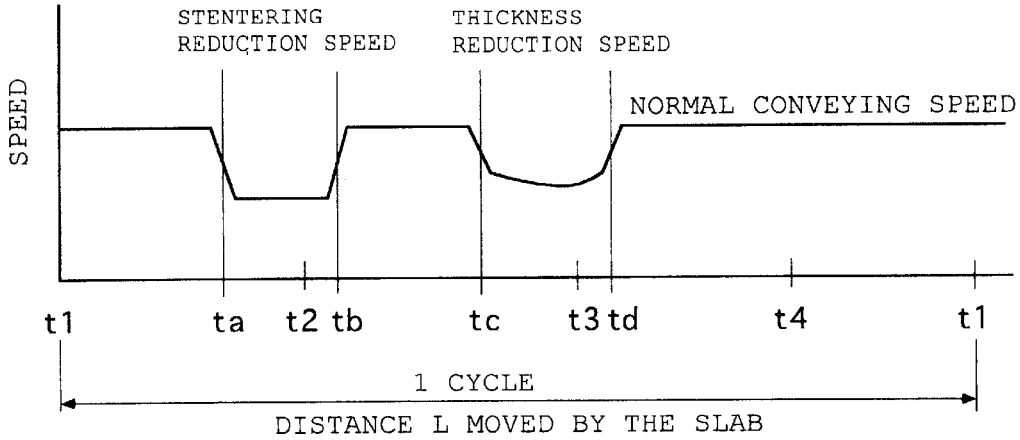
FIG. 45 shows the speeds at which a slab moves in a cycle.

Next, the operation is described. FIG. 43 shows the period during which the stentering press machine 902 is pressing during an operation cycle, and FIG. 44 shows the period during which the thickness press machine 903 is pressing during one cycle of operation. FIG. 45 shows the speed at which the slab 901 is transferred during one cycle. In FIG. 43, the period t1-t2-t3-t4-t1 constitutes one cycle of operation, and the period ta-tb which includes t2 indicates the period in which stentering is performed. In FIG. 44, the period of t1-t2-t3-t4-t1 constitutes one cycle of operation, and the time during which the thickness is being pressed is the period tc-td which includes t3. obviously, the period for stentering pressing is different from the period for pressing the thickness.

In FIG. 45, the speed at which the slab is conveyed during the period of stentering pressing is adjusted to match the speed of the stentering press transfer cylinders 908 which are operated at an appropriate speed for stentering pressing. Also, the speed at which the slab is conveyed during the pressing period is adjusted to match the speed of the slider 910 in the backward and forward direction. Otherwise, the slab is conveyed at an ordinary transfer speed which is determined to suit the downstream apparatus. These speeds are controlled by the pinch rolls 904. The distance L in which the slab 901 moves during one cycle of operation is not longer than either the length L1 of the stentering press die 906 in the direction of flow of the slab or the length L2 of the thickness press die 909 in the same direction, consequently a portion of the slab, that has been pressed for stentering or thickness reduction, is slightly superimposed by the portion to be pressed in the next cycle. Consequently, stentering pressing and thickness pressing can be accomplished without fail.

Figure 46:
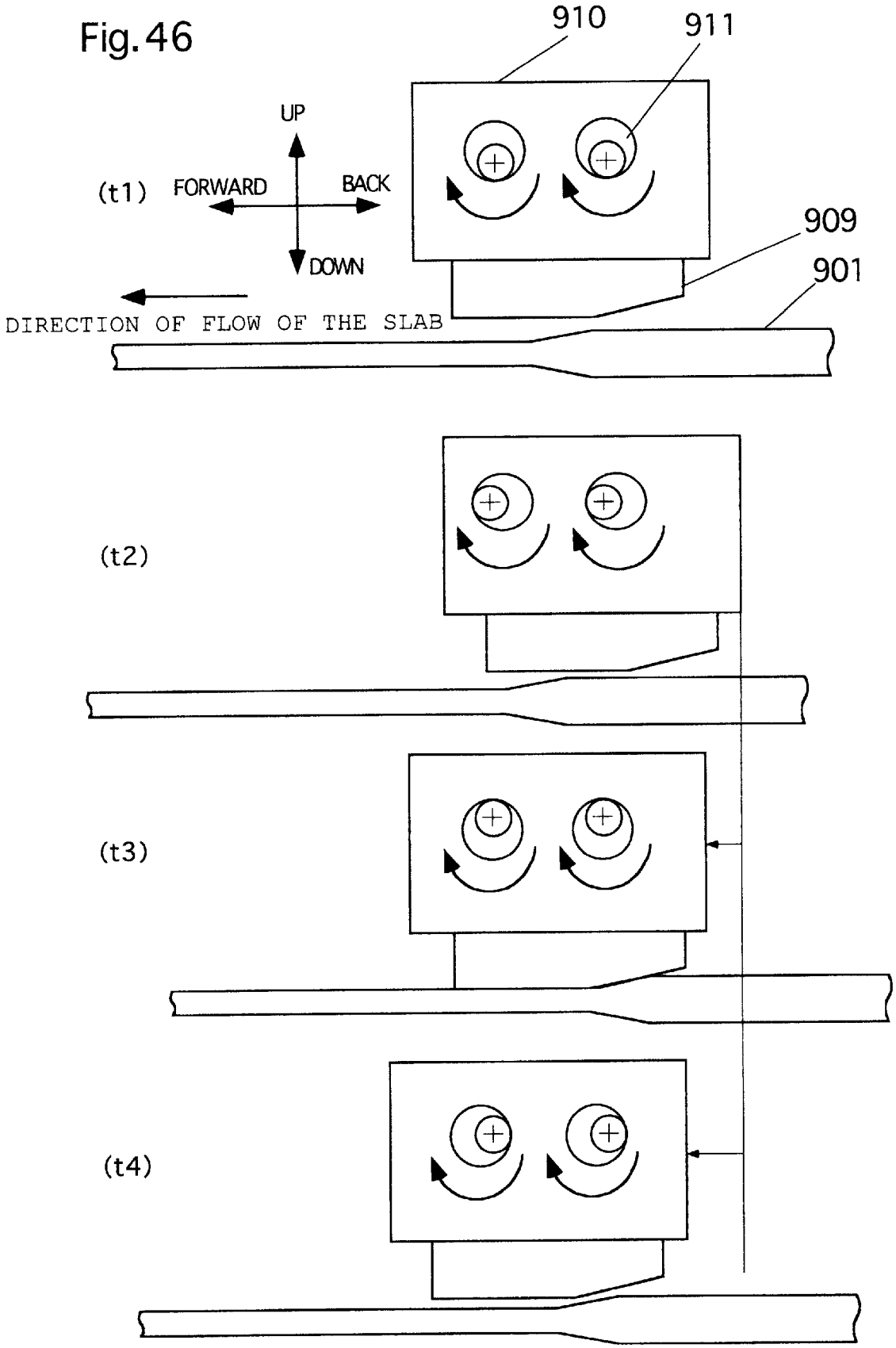
FIG. 46 illustrates the operation of a slider and the movement of a slab.

FIG. 46 is a view used to illustrate the upward and downward and backward and forward movements of the sliders 910 and the movement of the slab 901 in the thickness press machine 903. (t1)–(t4) correspond to t1–t4 in FIG. 44. The slab 901 is taken as the reference point for upward and downward movements and the position ti is regarded as the reference point for backward and forward movements in the following description. t1 is the point in the up and down direction farthest from the slab 901, and is the center position in the backward and forward direction. t2 is the intermediate position in the up and down direction from the slab 901, and in the backward and forward direction, it is in the most backwards position from the center position (upstream side in the direction of flow of the slab). t3 is a position in which the slab 901 is being pressed, in the up and down direction, and the die 909 has returned to the center position in the backward and forward direction. t4 is an intermediate position away from the slab 901 in the up and down direction, and in the backward and forward direction, it is at a point farthest from the center position in the forward direction (downstream in the direction of flow of the slab). Considering the backward and forward movements of the sliders 910, the forward movement begins at t2, and it becomes fastest at t3, the direction of movement changes at t4 and the sliders 910 then move backwards. As the thickness is pressed during a period that includes t3, the speed of the sliders 910 is greatest while the thickness is being pressed. The slab 901 is conveyed by the pinch rolls 904 at a speed that is adjusted to match the speed of the sliders 910 when the thickness is being pressed, and as soon as pressing is completed and the dies 909 of the thickness press move away from the slab 901, the slab is conveyed at an ordinary transfer speed as shown in FIG. 45.

As can be understood from the description above, according to the present invention, the pressing periods of the stentering press machine and the thickness press machine are offset from each other, to prevent the operation of one machine adversely affecting the operation of the other machine. In addition, as the slab is conveyed at a speed suitable for stentering pressing when the slab is being pressed by the stentering press, and also during thickness pressing, the slab is transferred at a speed most appropriate for pressing the thickness, the slab can be pressed under optimum conditions and can be conveyed continuously. In addition, because the distance L in which the slab is transferred during one cycle of operation is not longer than either the pressing length L1 of the stentering press dies or the pressing length L2 of the dies of the thickness press during an operating cycle, portions of the slab pressed in each successive cycle are slightly superimposed on each other.

The present invention has been described in detail above according to a number of the illustrative embodiments and described generally with respect to the preferred embodiments, however it is understood that the scope of rights included in the present invention will not be limited only to these illustrative and preferred embodiments. On the contrary, the scope of rights according to the present invention include all modifications, corrections or the like covered by the attached claims.

What is claimed is:

1. A hot rolled steel sheet manufacturing apparatus, comprising:

continuous casting facilities for continuously casting a hot slab;

rough processing facilities for processing the hot slab cast by the continuous casting facilities and forming the slab into a sheet bar, wherein the rough processing facilities are disposed downstream of the continuous casting facilities;

a group of finish rolling mills for rolling the sheet bar manufactured by the rough processing facilities and forming the sheet bar into a hot rolled steel sheet, wherein the group of finish rolling mills are disposed downstream of the rough processing facilities;

a coiler for reeling the hot rolled steel sheet, wherein said coiler is disposed downstream of the group of finish rolling mills; and cutting means for cutting the hot rolled steel sheet while it is moving between the group of finish rolling mills and the coiler;

wherein said rough processing facilities comprise forging means for thickness reducing and processing.

2. The hot rolled steel sheet manufacturing apparatus of claim 1, wherein said forging means forge and process the hot slab with a forging reduction ratio of at least 30% or more in each pass of reduction and forming.

3. The hot rolled steel sheet manufacturing apparatus of claim 1, wherein said rough processing facilities are located more closely to said group of finish rolling mills than a middle point between an outlet of the continuous casting facilities and an inlet of said group of finish rolling mills.

4. The hot rolled steel sheet manufacturing apparatus of claim 3, further comprising a heating furnace for supplying said rough processing facilities with a reheated slab.

5. The hot rolled steel sheet manufacturing apparatus of claim 1, further comprising a heating furnace for supplying said rough processing facilities with a reheated slab.

6. The hot rolled steel sheet manufacturing apparatus according to any one of claims 1–5, further comprising means for heating and holding the temperature of and/or heating a material to be processed, wherein said heating and holding means are disposed at one or more locations selected from the group consisting of a location inside said continuous casting facilities, a location between said continuous casting facilities and said rough processing facilities, a location inside said rough processing facilities, and a location between said rough processing facilities and said group of finish rolling mills.

7. A method of manufacturing a hot rolled steel sheet using the hot rolled steel sheet manufacturing apparatus specified in claim 6, comprising the steps of:

casting a long, hot rolled slab with a thickness of 100 mm or more and a length corresponding to a length of a plurality of coils of hot rolled steel sheets using said continuous casting facilities;

forging and processing the long, hot rolled slab into a sheet bar by supplying the slab to said rough processing facilities, wherein the slab is reduced and processed at least by a means of pressing with a large reduction ratio; and, continuously:

rolling the sheet bar into a hot rolled steel sheet with a predetermined thickness by said group of finish rolling mills;

reeling the hot rolled steel sheet onto said coiler; and cutting the hot rolled steel sheet when required, while the steel sheet is moving, to manufacture a hot rolled steel sheet with a predetermined length of coil.

8. The method of manufacturing a hot rolled steel sheet according to claim 7, further comprising:

cutting th e hot slab at an outlet side of the continuous casting facilities into long slabs, wherein a length of each of the long slabs corresponds to a length of a plurality of coils of hot rolled steel sheets, and wherein the long slabs are supplied to said rough processing facilities.

9. A method of manufacturing a hot rolled steel sheet using the hot rolled steel sheet manufacturing apparatus according to any one of claims 1–5, comprising:

casting a long, hot rolled slab with a thickness of 100 mm or more and a length corresponding to a length of a plurality of coils of hot rolled steel sheets using said continuous casting facilities;

forging and processing the long, hot rolled slab into a sheet bar by supplying the slab to said rough processing facilities, wherein the slab is reduced and processed at least by a means of pressing with a large reduction ratio; and, continuously:

rolling the sheet bar into a hot rolled steel sheet with a predetermined thickness by said group of finish rolling mills;

reeling the hot rolled steel sheet onto said coiler; and cutting the hot rolled steel sheet, when required, while the steel sheet is moving, to manufacture a hot rolled steel sheet with a predetermined length of coil.

10. The method of manufacturing a hot rolled steel sheet according to claim 9, further comprising:

cutting the hot slab at an outlet side of the continuous casting facilities into long slabs, wherein a length of each of the long slabs corresponds to a length of a plurality of coils of the hot rolled steel sheets, and wherein the long slabs are supplied to said rough processing facilities.

11. A method of manufacturing a hot rolled steel sheet using the hot rolled steel sheet manufacturing apparatus according to claim 6, comprising:

casting a long, hot rolled slab by said continuous casting facilities;

reheating the long, hot rolled slab by said heat furnace for supplying a reheated slab with a normal length to said rough processing facilities, during a period from a time when said rough processing facilities complete the reduction and processing of the long, hot rolled slab supplied from said continuous casting facilities to a time when a next long, hot rolled slab is supplied from said continuous casting facilities;

reducing and processing the reheated slab by said rough processing facilities into a sheet bar; and rolling the sheet bar by said group of finish rolling mills into a hot rolled steel sheet.

12. A method of manufacturing a hot rolled steel sheet using the hot rolled steel sheet manufacturing apparatus specified in any one of claims 4–5, comprising:

casting a long, hot rolled slab by said continuous casting facilities;

reheating the long, hot rolled slab by said heat furnace for supplying a reheated slab with a normal length to said rough processing facilities, during a period from the time when said rough processing facilities complete the reduction and processing of the long, hot rolled slab supplied from said continuous casting facilities to a time when a next long, hot rolled slab is supplied from said continuous casting facilities;

reducing and processing the reheated slab by said rough processing facilities into a sheet bar; and rolling the sheet bar by said group of finish rolling mills into a hot rolled steel sheet.

13. A hot rolled steel sheet manufacturing apparatus, comprising:

continuous casting facilities for continuously casting a hot slab;

rough processing facilities for processing the hot slab cast by the continuous casting facilities and forming the slab into a sheet bar, wherein the rough processing facilities are disposed downstream of the continuous casting facilities and the rough processing facilities include a plate reduction press machine constructed to forge the slab to reduce thickness and to process the slab to eliminate internal defects, wherein a forging reduction ratio for the press machine is at least 30% or more in each pass of reduction and forming of the slab;

a group of finish rolling mills for rolling the sheet bar manufactured by the rough processing facilities and forming the sheet bar into a hot rolled steel sheet, wherein the group of finish rolling mills are disposed downstream of the rough processing facilities;

a coiler for reeling the hot rolled steel sheet, wherein the coiler is disposed downstream of the group of finish rolling mills; and a flying shear machine for cutting the hot rolled steel sheet while the sheet is moving between the group of finish rolling mills and the coiler.

14. A method of manufacturing a hot rolled steel sheet using the hot rolled steel sheet manufacturing apparatus according to claim 13, comprising:

casting a long slab using the continuous casting facilities;

forging and processing the long slab into a sheet bar using the plate reduction press machine;

rolling the sheet bar into a hot rolled steel sheet using the group of finish rolling mills; and reeling the steel sheet into the coiler, wherein the steel sheet is cut by the flying shear machine when a predetermined length of the steel sheet has been reeled.

15. A hot rolled steel sheet manufacturing apparatus, comprising:

continuous casting facilities for continuously casting a hot slab;

a means for cutting the slab into long slabs with predetermined length disposed at an outlet of said continuous casting facilities;

a heat furnace for heating the long slabs disposed alongside a main line of said apparatus;

rough processing facilities for processing the hot slab cast by the continuous casting facilities and forming the slab into a sheet bar, wherein the rough processing facilities are disposed downstream of the continuous casting facilities;

a group of finish rolling mills for rolling the sheet bar manufactured by the rough processing facilities and forming the sheet bar into a hot rolled steel sheet, wherein the group of finish rolling mills are disposed downstream of the rough processing facilities and the rough processing facilities include a plate reduction press machine constructed to forge the slab to reduce thickness and to process the slab to eliminate internal defects, wherein a forging reduction ratio for the press machine is at least 30% or more in each pass of reduction and forming of the slab;

a coiler for reeling the hot rolled steel sheet, wherein the coiler is disposed downstream of the group of finish rolling mills; and a flying shear machine for cutting the hot rolled steel sheet while the sheet is moving between the group of finish rolling mills and the coiler.

16. A method of manufacturing a hot rolled steel sheet using the hot rolled steel sheet manufacturing apparatus according to claim 15, comprising:

casting a long slab using said continuous casting facilities;

cutting the slab into long slabs with predetermined lengths using said slab cutting means;

heating the long slabs using said heat furnace, wherein a reheated slab is transferred from said heat furnace to said rough processing facilities after a preceding long slab has been completely processed by said rough processing facilities;

forging and processing the long slab into a sheet bar using said plate reduction press machine;

rolling the sheet bar into a hot rolled steel sheet using said group of finish rolling mills; and reeling the steel sheet into said coiler, wherein the steel sheet is cut by said flying shear machine when a predetermined length of the steel sheet has been reeled.

17. A hot rolled steel sheet manufacturing apparatus, comprising:

continuous casting facilities for continuously casting a hot slab;

a means for cutting the slab into long slabs with predetermined length disposed at an outlet of the continuous casting facilities;

a heat furnace for heating the long slabs disposed alongside of a main line of the apparatus;

rough processing facilities for processing the hot slab cast by the continuous casting facilities and forming the slab into a sheet bar, wherein the rough processing facilities are disposed downstream of the continuous casting facilities and the rough processing facilities include a plate reduction press machine constructed to forge the slab to reduce thickness and to process the slab to eliminate internal defects, wherein a forging reduction ratio for the press machine is at least 30% or more in each pass of reduction and forming of the slab;

a group of finish rolling mills for rolling the sheet bar manufactured by the rough processing facilities and forming the sheet bar into a hot rolled steel sheet, wherein the group of finish rolling mills are disposed downstream of the rough processing facilities;

a coiler for reeling the hot rolled steel sheet, wherein the coiler is disposed downstream of the group of finish rolling mills;

a flying shear machine for cutting the hot rolled steel sheet while the sheet is moving between the group of finish rolling mills and the coiler;

heat retaining facilities for preventing a drop of temperature of a material to be processed; and heating facilities for heating a material to be processed in the apparatus.

18. The hot rolled steel sheet manufacturing apparatus of claim 17, wherein the rough processing facilities comprise a plate reduction press machine on an upstream side and a rough rolling mill on a downstream side.

19. The hot rolled steel sheet manufacturing apparatus of claim 17, wherein one or more of said heat retaining facilities are disposed at a location selected from the group consisting of a location inside said continuous casting facilities close to an outlet, a location at a point between said continuous casting facilities and said rough processing facilities, a location at a point between said plate reduction press machine and said rough rolling mill in said rough processing facilities, and a location at a point between said rough processing facilities and said group of finish rolling mills; and wherein said heating facilities are disposed at a point between said finish rolling mills and said heat retaining facilities are disposed between the rough processing facilities and the group of finish rolling mills.

20. The hot rolled steel sheet manufacturing apparatus according to claim 17, wherein said heating facilities comprise a solenoid-type induction heating device.

21. The hot rolled steel sheet manufacturing apparatus according to claim 17, wherein said heat retaining facilities comprise heat retaining covers lined with a lining selected from the group consisting of ceramic fibers, metal foils and equivalent linings, and, said heat retaining facilities optionally comprise means for heating disposed inside said heat retaining facilities.

22. A hot rolled steel sheet manufacturing apparatus, comprising:

a continuous casting machine for manufacturing a slab with a thickness of 50 mm to 150 mm;

a slab temperature holding and heating furnace for holding the temperature of and heating the slab to a predetermined temperature while the slab is being transferred;

a plate reduction press machine for pressing the slab by a large reduction ratio into a pressed plate with a predetermined thickness, wherein the large reduction ratio is at least 30% or more in each pass of reduction and forming;

a plurality of finish rolling mills for continuously rolling the pressed plate into a thin sheet;

a shear machine for cutting the thin sheet that has been pressed into predetermined lengths; and a coiler for reeling the thin sheet that has been cut.

23. The hot rolled steel sheet manufacturing apparatus according to claim 22, further comprising:

loopers for holding slack portions of the slab, wherein said loopers are disposed at upstream and downstream sides of said plate reduction press machine;

wherein said slab temperature holding and heating furnace is selected from the group consisting of a tunnel furnace and a double walking beam furnace.

24. The hot rolled steel sheet manufacturing apparatus according to claim 22, further comprising:

an element selected from the group consisting of a stentering press machine and a vertical rolling mill, for pressing the slab in a lateral direction, disposed at an inlet of said plate reduction press machine; and a vertical rolling mill for pressing the slab in the lateral direction, optionally disposed at an inlet of said finish rolling mills.

25. The hot rolled steel sheet manufacturing apparatus according to claim 22, further comprising:

a shear machine disposed between the continuous casting machine and the tunnel furnace for cutting the slab when required.

26. The hot rolled steel sheet manufacturing apparatus according to claim 22, further comprising:

a tunnel furnace disposed at an inlet of said finish rolling mills for heating the slab and maintaining the slab at a predetermined temperature.

27. A method of manufacturing a hot rolled steel sheet, comprising:

casting a slab with a thickness of 50 to 150 mm by a continuous casting machine;

heating and maintaining the slab at a predetermined temperature while the slab is being conveyed on a press line by a slab temperature holding and heating furnace;

reducing the slab into a pressed plate with a predetermined thickness by a plate reduction press machine, wherein the plate reduction machine operates with a forging reduction ratio that is at least 30% or more in each pass of reducing the slab;

rolling the pressed plate continuously into a steel sheet with a predetermined thickness by a plurality of finish rolling mills;

cutting the steel sheet into predetermined lengths by a shear machine; and reeling the cut steel sheet onto a coiler.

28. A hot rolled steel sheet manufacturing apparatus, comprising:

a line A comprising an apparatus according to any one of claim 22 through 26, a line B comprising a second continuous casting machine and a second heating furnace; and a second slab temperature holding and heating furnace for transferring a slab from the line B to the line A;

wherein said second slab temperature holding and heating furnace transfers slabs with a length of a coil or a plurality of coils; and wherein said second heating furnace is selected from the group consisting of a tunnel furnace and a walking beam furnace.

29. A hot rolled steel sheet manufacturing apparatus, comprising:

a continuous casting machine for manufacturing a slab with a thickness of about 50 mm to 150 mm;

a shear machine disposed at an outlet of the continuous casting machine for cutting the slab to a predetermined length;

a slab temperature holding and heating furnace for heating the slab to and holding the slab at a predetermined temperature as the slab is being conveyed on a rolling line;

a plate reduction press machine for pressing the slab by a large reduction ratio into a plate with a predetermined thickness, wherein the large reduction ratio is at least 30% or more in each pass of reduction and forming;

a plurality of finish rolling mills for continuously rolling the plate into a rolled material with a predetermined thickness; and a coiler for reeling the rolled material.

30. The hot rolled steel sheet manufacturing apparatus according to claim 29, further comprising:

a looper for holding slack portions of the slab, wherein the looper is disposed between said plate reduction press machine and said finish rolling mills;

wherein said slab temperature holding and heating furnace is selected from the group consisting of a tunnel furnace and a double walking beam furnace.

31. The hot rolled steel sheet manufacturing apparatus according to claim 29, further comprising:

a element selected from the group consisting of stentering press machine and a first vertical rolling mill, for pressing the slab in a lateral direction, disposed on an upstream side of said plate reduction press machine; and a second vertical rolling mill for pressing the slab in a lateral direction, optionally disposed at an inlet of said finish rolling mills.

32. A method of manufacturing a hot rolled steel sheet, comprising:

manufacturing a slab with a plate thickness of about 50 mm to 150 mm by a continuous casting machine, cutting the slab by a shear machine into predetermined lengths each of which lengths can be reeled into one coil;

heating the slab to and maintaining the slab at a predetermined temperature by a slab temperature holding and heating furnace;

pressing the reheated slab into a pressed material with a predetermined thickness by a plate reduction press machine, wherein the plate reduction machine operates with a forging reduction ratio that is at least 30% or more in each pass of reducing the slab;

rolling the pressed material continuously to the thickness of a final product by a plurality of finish rolling mills; and reeling the final product onto a coiler, coil by coil, as the material is being rolled.

33. A hot rolled steel sheet manufacturing apparatus, comprising:

a line A comprising any one of the apparatuses according to claim 29 through 31, a line B comprising a second continuous casting machine and a second heating furnace; and a second slab temperature holding and heating furnace for transferring a slab from the line B to the line A;

wherein said second slab temperature holding and heating furnace transfers slabs with a length of a coil or a plurality of coils; and wherein said second heating furnace is selected from the group consisting of a tunnel furnace and a walking beam furnace.

34. A hot rolled steel sheet manufacturing apparatus, comprising:

a plurality of continuous casting machines disposed in a rolling line alongside each other for manufacturing slabs with a thickness of about 50 mm to 150 mm;

a shear machine disposed at an outlet of each of the continuous casting machines for cutting the slab into precut slabs having predetermined lengths;

a slab heating and holding furnace disposed downstream of the continuous casting machines for heating the precut slabs, wherein said slab heating and holding furnace is a walking beam type;

an element selected from the group consisting of a stentering press machine and a first vertical rolling mill, installed downstream of the slab heating and holding furnace, for pressing or rolling the slab in a lateral direction;

a plate reduction press machine disposed downstream of said element for pressing the slab with a large reduction ratio, to a predetermined thickness, wherein the large reduction ratio is at least 30% or more in each pass of reduction and forming;

a looper disposed downstream of the plate reduction press machine for holding a slack portion of the slab;

a second vertical rolling mill for pressing the slab in a lateral direction, into a pressed material;

a plurality of finish rolling mills for rolling the pressed material continuously to a rolled material with a predetermined thickness, wherein the second vertical rolling mill is disposed at an inlet of said finish rolling mills; and a coiler disposed downstream of said finish rolling mills for reeling the rolled material.

35. A hot rolled steel sheet manufacturing apparatus, comprising:

a heating furnace for heating a slab;

at least one first roughing mill disposed downstream of the heating furnace, a plate reduction press machine disposed downstream of the first roughing mill, wherein the press is constructed to forge the slab to reduce thickness and to process the slab to eliminate internal defects, wherein a forging reduction ratio for the press machine is at least 30% or more in each pass of reduction and forming of the slab;

at least one second roughing mill disposed downstream of the plate reduction press apparatus;

a plurality of finish rolling mills disposed downstream of the second roughing mill;

a flying shear machine disposed downstream of the plurality of finish rolling mills; and a coiler disposed downstream of the flying shear machine.

36. The hot rolled steel sheet manufacturing apparatus according to claim 35, further comprising:

a stentering press machine disposed between said heating furnace and said first roughing mill for pressing,the slab to a predetermined plate width.

37. A hot rolled steel sheet manufacturing apparatus, comprising:

continuous casting facilities for continuously casting a hot slab;

rough processing facilities for processing the hot slab cast by the continuous casting facilities and forming the slab into a sheet bar, wherein the rough processing facilities are disposed downstream of the continuous casting facilities and the rough processing facilities include a plate reduction press constructed to forge the slab to reduce thickness and to process the slab to eliminate internal defects, wherein a forging reduction ratio for the press is at least 30% or more in each pass of reduction and forming of the slab;

a group of finish rolling mills for rolling the sheet bar manufactured by the rough processing facilities and forming the sheet bar into a hot rolled steel sheet, wherein the group of finish rolling mills are disposed downstream of the rough processing facilities;

a coiler for reeling the hot rolled steel sheet, wherein said coiler is disposed downstream of the group of finish rolling mills; and cutting means for cutting the hot rolled steel sheet while it is moving between the group of finish rolling mills and the coiler.

38. The hot rolled steel sheet manufacturing apparatus of claim 37, wherein the plate reduction press is constructed to increase speed for the slab during the forging and processing of the slab.

* * * * *